US012416142B2

(12) United States Patent
Kondo et al.

(10) Patent No.: US 12,416,142 B2
(45) Date of Patent: Sep. 16, 2025

(54) DISCHARGE VALVE DEVICE, FLUSH WATER TANK DEVICE, AND FLUSH TOILET

(71) Applicant: TOTO LTD., Kitakyushu (JP)

(72) Inventors: Yuta Kondo, Kitakyushu (JP); Haruki Matsuda, Kitakyushu (JP); Koichiro Hiwa, Kitakyushu (JP); Yuki Shimokawa, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 123 days.

(21) Appl. No.: 18/100,793

(22) Filed: Jan. 24, 2023

(65) Prior Publication Data

US 2023/0243138 A1 Aug. 3, 2023

(30) Foreign Application Priority Data

Jan. 28, 2022 (JP) ..... 2022-012162
Jan. 28, 2022 (JP) ..... 2022-012163
Jan. 28, 2022 (JP) ..... 2022-012164

(51) Int. Cl.
*E03D 3/12* (2006.01)
*E03D 1/35* (2006.01)

(52) U.S. Cl.
CPC *E03D 3/12* (2013.01); *E03D 1/35* (2013.01)

(58) Field of Classification Search
CPC .... E03D 3/12; E03D 1/14; E03D 1/33; E03D 1/35
USPC ..... 4/324, 325, 395–404, 416
See application file for complete search history.

(56) References Cited

U.S. PATENT DOCUMENTS

2004/0111793 A1* 6/2004 Sutherland ..... E03D 1/142 4/325
2013/0055496 A1* 3/2013 YYoshioka ..... E03D 1/33 4/324
2021/0270025 A1 9/2021 Hayashi et al.

FOREIGN PATENT DOCUMENTS

JP H07-011680 A 1/1995
JP H08-134979 A 5/1996
JP 2014-185491 A 10/2014
JP 2019-157601 A 9/2019
JP 2021-055449 A1 4/2021
JP 2021-134630 A 9/2021

OTHER PUBLICATIONS

Office Action for JP Application No. 2022-012163, dated Jul. 18, 2023.

(Continued)

*Primary Examiner* — Tuan N Nguyen
(74) *Attorney, Agent, or Firm* — IceMiller LLP

(57) ABSTRACT

A discharge valve device includes a valve body, an actuation shaft, a water storage cylinder, and a float, and from when the valve body opens to when the valve body closes, either flushing mode of a large flushing mode in which the flush water in a water storage tank is supplied from a discharge opening to the flush toilet in a first flush water amount or a small flushing mode in which the flush water is supplied in a second flush water amount smaller than the first flush water amount is selectively executable, and the water storage cylinder or the float is configured to change a lowering speed of the float with decrease in water level in the water storage cylinder depending on the selected large flushing mode or small flushing mode.

20 Claims, 24 Drawing Sheets

(56) References Cited

OTHER PUBLICATIONS

Office Action for JP Application No. 2022-012164, dated Jul. 18, 2023.
Office Action (with translation) issued in JP 2022-012162, dated Jun. 19, 2025 [6 pages].

* cited by examiner

DISCHARGE VALVE DEVICE, FLUSH WATER TANK DEVICE, AND FLUSH TOILET

CROSS-REFERENCE TO RELATED APPLICATIONS

This application claims benefit of priority to Japanese Patent Applications No. 2022-012162 (filed on Jan. 28, 2022), No. 2022-012163 (filed on Jan. 28, 2022), and No. 2022-012164 (filed on Jan. 28, 2022), the entire contents of which are incorporated herein by reference.

BACKGROUND OF THE INVENTION

Field of the Invention

The present invention relates to a discharge valve device, a flush water tank device, and a flush toilet, and more particularly to a discharge valve device provided in a flush water tank device that supplies flush water to a flush toilet, a flush water tank device including this discharge valve device, and a flush toilet including this flush water tank device.

Description of the Related Art

Conventionally, as a discharge valve device provided in a flush water tank that supplies flush water to a flush toilet, for example, a device has been known that includes a discharge valve to open and close a discharge opening of a flush water tank and that uses buoyancy by a float in an operation of opening and closing this discharge valve as disclosed in Japanese Patent Laid-Open No. 2014-185491 and Japanese Patent Laid-Open No. 2019-157601. First, the conventional discharge valve device disclosed in Japanese Patent Laid-Open No. 2014-185491 includes a valve body that opens and closes the discharge opening provided in a bottom of the flush water tank, an actuation shaft that moves up and down to open and close the valve body, a water storage cylinder in which this actuation shaft is inserted in a vertical direction and that stores part of flush water in the flush water tank, and the float that is disposed in this water storage cylinder and that causes buoyancy to act on the actuation shaft. Further, in the conventional discharge valve device disclosed in Japanese Patent Laid-Open No. 2014-185491, since the float is disposed in the water storage cylinder, the float is not affected by flow of flush water outside the water storage cylinder, and a valve opening time of the discharge valve can be kept constant. An amount of flush water drained from the discharge opening of the flush water tank during large flushing is different from an amount of flush water during small flushing.

Next, a conventional discharge valve device described in Japanese Patent Laid-Open No. 2019-157601 described above is a so-called ball tap type of discharge valve device including two floats, a float for large flushing and a float for small flushing. In this discharge valve device, a valve opening time of the discharge valve during large flushing is set longer than a valve opening time of the discharge valve during small flushing, and hence the flush water amount during large flushing can be set larger than the flush water amount during small flushing.

In the conventional discharge valve device described in Japanese Patent Laid-Open No. 2014-185491 described above, during large flushing and small flushing, the valve opening time of the discharge valve is kept constant, while a difference is made in amount of flush water drained from the discharge opening of the flush water tank. Accordingly, especially during small flushing, immediately after the discharge valve is opened, a flow rate per unit time of flush water drained from the discharge opening (hereinafter referred to as "instantaneous flow rate") [L/min] indicates about the same maximum value (so-called "water draining peak") as in large flushing. However, subsequently, while the discharge valve is opened, the instantaneous flow rate [L/min] noticeably decreases as compared with large flushing. Therefore, maintaining the instantaneous flow rate [L/min] as high as possible has been a conventionally required issue to ensure satisfactory flushing performance. Further, in the conventional discharge valve device described in Patent Laid-Open No. 2019-157601 described above, two floats, the float for large flushing and the float for small flushing, are used to change the valve opening time of the discharge valve during each of large flushing and small flushing, and hence the instantaneous flow rate [L/min] of flush water drained from the discharge opening during small flushing can be maintained comparatively high. However, there is a problem in that as the instantaneous flow rate [L/min] of the flush water drained from the discharge opening is maintained comparatively high, closing sound generated when the discharge valve closes the discharge opening increases. This leads to a problem in that design of a size of each of two floats, the float for large flushing and the float for small flushing, has to be contrived. To solve the problems, the present inventors have focused on changing a lowering speed of the float with decrease in water level in the water storage cylinder depending on a selected large or small flushing mode, to maintain a comparatively high instantaneous flow rate [L/min] of flush water drained from the discharge opening during small flushing and to reduce the closing sound generated when the discharge valve closes the discharge opening. Accordingly, the present inventors have found various means that can change a lowering time of the float and the valve opening time of the valve body depending on the flushing mode.

That is, an object of the present invention, which has been made to solve the above-described conventionally requested issues and conventional technical problems, is to provide a discharge valve device, a flush water tank device and a flush toilet in which changing a lowering speed of a float with decrease in water level in a water storage cylinder depending on the selected large flushing mode or small flushing mode can maintain a comparatively high instantaneous flow rate [L/min] of flush water drained from a discharge opening during small flushing and can reduce closing sound generated when a discharge valve closes the discharge opening.

SUMMARY OF THE INVENTION

In order to solve the above-described problems, the present invention provides a discharge valve device provided in a flush water tank that supplies flush water to a flush toilet, the discharge valve device comprising: a valve body configured to open and close a discharge opening provided in a bottom of the flush water tank; an actuation shaft including a lower end provided with the valve body, the actuation shaft being configured to open and close the discharge opening by moving up and down the valve body; a water storage cylinder configured to store a part of flush water in the flush water tank, the water storage cylinder including an outlet port configured to cause flush water in the water storage cylinder to flow outside of the water storage cylinder, the actuation shaft being inserted into the water storage cylinder in a vertical direction; and a float disposed in the water storage cylinder, the float being configured to cause buoyancy obtained by the flush water in the water storage cylinder to act on the actuation shaft, wherein when the float lowers with decrease in water level in the water storage cylinder, the actuation shaft and the valve body are configured to be lowered in conjunction with the float and the valve body is configured to close the discharge opening, during a period from when the valve body opens to when the valve body closes, either flushing mode of a large flushing mode or a small flushing mode is selectively performed, in the large flushing mode the flush water in the flush water tank is supplied from the discharge opening to the flush toilet in a first flush water amount, and in the small flushing mode the flush water is supplied in a second flush water amount smaller than the first flush water amount, and the water storage cylinder or the float is configured to change a lowering speed of the float with the decrease in water level in the water storage cylinder depending on the selected large flushing mode or small flushing mode. According to the present invention described above, to start flushing of the flush toilet, first, on selecting either flushing mode of the large flushing mode or the small flushing mode, the actuation shaft of the discharge valve device is raised, to raise (open) the valve body, and the flush water in the flush water tank is supplied from the discharge opening to the flush toilet. Then, the water level in the water storage cylinder decreases depending on the selected large flushing mode or small flushing mode, and the float in the water storage cylinder lowers with the decrease in water level. Accordingly, as the actuation shaft of the discharge valve device lowers, the valve body lowers (closes), and the supply of flush water from the flush water tank to the flush toilet is stopped, to finish the flushing of the flush toilet. At this time, since the water storage cylinder or the float is configured to change the lowering speed of the float with the decrease in water level in the water storage cylinder depending on the selected large flushing mode or small flushing mode, a lowering time of the float and a valve opening time of the valve body can be changed depending on the selected flushing mode. Therefore, a flow rate per unit time of flush water (hereinafter referred to as "instantaneous flow rate") [L/min] that affects flushing performance can be maintained comparatively high even in the small flushing mode in which the flush water amount is smaller than in the large flushing mode. Further, by changing the lowering speed of the float with the decrease in water level in the water storage cylinder depending on the selected large flushing mode or small flushing mode, closing sound generated when the valve body closes the discharge opening can be reduced.

In the present invention, preferably, the water storage cylinder is configured to increase a total opening area of the outlet port during the small flushing mode as compared to a total opening area of the outlet port during the large flushing mode, when the valve body is opened, and a flush water amount per unit time of the flush water in the water storage cylinder flowing out from the outlet port to the flush water tank in the small flushing mode is larger than in the large flushing mode. According to the present invention described above, the water storage cylinder is configured to increase the total opening area of the outlet port during the small flushing mode as compared to the total opening area of the outlet port during the large flushing mode when the valve body is opened, and the flush water amount per unit time [L/min] of the flush water in the water storage cylinder flowing out from the outlet port to the flush water tank (so-called "water drainage speed") in the small flushing mode is larger than in the large flushing mode. Therefore, the lowering speed of the float during the small flushing mode can be larger than the lowering speed of the float during the large flushing mode. This can make the lowering time of the float and the valve opening time of the valve body during the small flushing mode shorter than the lowering time of the float and the valve opening time of the valve body during the large flushing mode. As a result, the lowering speed of the float with the decrease in water level in the water storage cylinder can be changed by changing the flush water amount per unit time [L/min] of the flush water in the water storage cylinder flowing out from the outlet port to the flush water tank (so-called "water drainage speed") depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the water storage cylinder includes a first outlet port that causes the flush water in the water storage cylinder to flow out to the flush water tank in the large flushing mode, and a second outlet port that causes the flush water in the water storage cylinder to flow out to the flush water tank in the small flushing mode. When the valve body is opened, total opening areas of the first outlet port and the second outlet port are the same as each other, the second outlet port is disposed above the first outlet port, and the water storage cylinder is configured to increase a second flush water amount per unit time of the flush water in the water storage cylinder flowing out from the second outlet port to the flush water tank in the small flushing mode as compared to a first flush water amount per unit time of the flush water in the water storage cylinder flowing out from the first outlet port to the flush water tank in the large flushing mode. According to the present invention described above, when the valve body is opened during the large flushing mode, the flush water in the water storage cylinder flows out from the first outlet port to the flush water tank, whereas when the valve body is opened during the small flushing mode, the flush water in the water storage cylinder flows out from the second outlet port to the flush water tank. At this time, even if the total opening areas of the first outlet port and the second outlet port are the same as each other, the second outlet port is disposed above the first outlet port. Therefore, the second flush water amount per unit time [L/min] of the flush water in the water storage cylinder flowing out from the second outlet port to the flush water tank in the small flushing mode (so-called "second water drainage speed") can be increased as compared to the first flush water amount per unit time [L/min] of the flush water in the water storage cylinder flowing out from the first outlet port to the flush water tank in the large flushing mode (so-called "first water drainage speed"). Therefore, since the lowering speed of the float during the small flushing mode can be larger than the lowering speed of the float during the large flushing mode, the lowering time of the float and the opening time of the valve body during the small flushing mode can be shorter than the lowering time of the float and the valve opening time of the valve body during the large flushing mode. As a result, the lowering speed of the float with the decrease in water level in the water storage cylinder can be changed by changing the flush water amount per unit time [L/min] of the flush water in the water storage cylinder flowing out from the outlet port to the flush water tank (so-called "water drainage speed") depending on the selected large flushing mode or small flushing mode. Therefore, the instantaneous flow rate of the flush water [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the outlet port includes a first outlet port and a second outlet port. The water storage cylinder causes the flush water in the water storage cylinder to flow out from the first outlet port to the flush water tank in the large flushing mode, whereas the water storage cylinder causes the flush water in the water storage cylinder to flow out from both the first outlet port and the second outlet port to the flush water tank in the small flushing mode. According to the present invention described above, when the valve body is opened during the large flushing mode, the flush water in the water storage cylinder flows out from the first outlet port to the flush water tank, whereas when the valve body is opened during the small flushing mode, the flush water in the water storage cylinder flows out from both the first outlet port and the second outlet port to the flush water tank. At this time, a second flush water amount per unit time [L/min] of the flush water in the water storage cylinder flowing out from both the first outlet port and the second outlet port to the flush water tank in the small flushing mode (so-called "second water drainage speed") can be increased as compared to a first flush water amount per unit time [L/min] of the flush water in the water storage cylinder flowing out from the first outlet port to the flush water tank in the large flushing mode (so-called "first water drainage speed"). Therefore, since the lowering speed of the float during the small flushing mode can be larger than the lowering speed of the float during the large flushing mode, the lowering time of the float and the valve opening time of the valve body during the small flushing mode can be shorter than the lowering time of the float and the valve opening time of the valve body during the large flushing mode. As a result, the lowering speed of the float lowering with the decrease in water level in the water storage cylinder can be changed by changing the flush water amount per unit time [L/min] of the flush water in the water storage cylinder flowing out from the outlet port to the flush water tank (so-called "water drainage speed") depending on the selected large flushing mode or small flushing mode. Therefore, the instantaneous flow rate of the flush water [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the second outlet port is disposed above the first outlet port. According to the present invention described above, when the valve body is opened during the large flushing mode, the flush water in the water storage cylinder flows out only from the first outlet port to the flush water tank, whereas when the valve body is opened during the small flushing mode, the flush water in the water storage cylinder flows out from both the first outlet port and the second outlet port to the flush water tank. At this time, since the second outlet port is disposed above the first outlet port, the second flush water amount per unit time [L/min] of the flush water in the water storage cylinder flowing out from both the first outlet port and the second outlet port to the flush water tank in the small flushing mode (so-called "second water drainage speed") can be increased as compared to the first flush water amount per unit time [L/min] of the flush water in the water storage cylinder flowing out only from the first outlet port to the flush water tank in the large flushing mode (so-called "first drainage speed"). Therefore, since the lowering speed of the float during the small flushing mode can be larger than the lowering speed of the float during the large flushing mode, the lowering time of the float and the valve opening time of the valve body during the small flushing mode can be shorter than the lowering time of the float and the valve opening time of the valve body during the large flushing mode. As a result, the lowering speed of the float with the decrease in water level in the water storage cylinder can be changed by changing the flush water amount per unit time [L/min] of the flush water in the water storage cylinder flowing out from the outlet port to the flush water tank (so-called "water drainage speed") depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the water storage cylinder includes a partition that closes a part of the outlet port, and the partition closes a part of the outlet port so that the total opening area of the outlet port during the large flushing mode is smaller than the total opening area of the outlet port during the small flushing mode. According to the present invention described above, the partition that closes a part of the outlet port of the water storage cylinder can close a part of the outlet port so that the total opening area of the outlet port during the large flushing mode is smaller than the total opening area of the outlet port during the small flushing mode. Consequently, since the flush water amount per unit time [L/min] of the flush water in the water storage cylinder flowing out from the outlet port to the flush water tank (so-called "water drainage speed") is larger in the small flushing mode than in the large flushing mode, the lowering speed of the float during the small flushing mode can be larger than the lowering speed of the float during the large flushing mode. This can make the lowering time of the float and the valve opening time of the valve body during the small flushing mode shorter than the lowering time of the float and the valve opening time of the valve body during the large flushing mode. As a result, the lowering speed of the float with the decrease in water level in the water storage cylinder can be changed by changing the flush water amount per unit time [L/min] of the flush water in the water storage cylinder flowing out from the outlet port to the flush water tank (so-called "water drainage speed") depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the partition includes a communication hole that can communicate between inside of the water storage cylinder and inside of the flush water tank in a state where the outlet port is closed, the communication hole including an opening cross-sectional area smaller than an opening cross-sectional area of the outlet port. The partition causes the flush water in the water storage cylinder to flow out from the communication hole into the flush water tank in the state where the outlet port is closed in the large flushing mode, whereas the partition opens the outlet port and causes the flush water in the water storage cylinder to flow out from the whole outlet port into the flush water tank in the small flushing mode. According to the present invention described above, in the large flushing mode, the partition closes the outlet port, so that the flush water in the water storage cylinder can flow out into the flush water tank from the communication hole of the partition including a smaller opening cross-sectional area than that of the outlet port. On the other hand, in the small flushing mode, as the partition opens the outlet port, the flush water in the water storage cylinder can flow out from the whole outlet port into the flush water tank. Accordingly, the flush water amount per unit time [L/min] of the flush water in the water storage cylinder flowing out from the whole outlet port to the flush water tank (so-called "water drainage speed") in the small flushing mode is larger than the flush water amount per unit time [L/min] of the flush water in the water storage cylinder flowing out from the communication hole of the partition to the flush water tank (so-called "water drainage speed") in the large flushing mode. Therefore, the lowering speed of the float during the small flushing mode can be larger than the lowering speed of the float during the large flushing mode. This can make the valve opening time of the valve body during the small flushing mode shorter than the valve opening time of the valve body during the large flushing mode. As a result, the lowering speed of the float with the decrease in water level in the water storage cylinder can be changed by changing the flush water amount per unit time [L/min] of the flush water in the water storage cylinder flowing out from the outlet port to the flush water tank (so-called "water drainage speed") depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body closes the discharge opening can be reduced.

Next, the present invention provides a flush water tank device including the discharge valve device. The present invention including this configuration can provide the flush water tank device including the discharge valve device in which changing a lowering speed of a float with decrease in water level in a water storage cylinder depending on the selected large flushing mode or small flushing mode can maintain a comparatively high instantaneous flow rate [L/min] of flush water drained from a discharge opening during small flushing, and can reduce closing sound generated when a valve body closes the discharge opening.

Next, the present invention provides a flush toilet including the flush water tank device. The present invention including this configuration can provide the flush toilet including the flush water tank device in which changing a lowering speed of a float with decrease in water level in a water storage cylinder depending on a selected large flushing mode or small flushing mode can maintain a comparatively high instantaneous flow rate [L/min] of flush water drained from a discharge opening during small flushing and can reduce closing sound generated when a valve body closes the discharge opening.

Next, the present invention provides a discharge valve device provided in a flush water tank that supplies flush water to a flush toilet, the discharge valve device including a valve body that opens and closes a discharge opening provided in a bottom of the flush water tank, an actuation shaft including a lower end provided with the valve body, and moving up and down to open and close the valve body, a water storage cylinder in which the actuation shaft is inserted in a vertical direction and that stores part of flush water in the flush water tank, in the water storage cylinder, an outlet port being formed to cause flush water in the water storage cylinder to flow outside, and a float that is disposed in the water storage cylinder and that causes buoyancy obtained by the flush water in the water storage cylinder to act on the actuation shaft, wherein when the float lowers with decrease in water level in the water storage cylinder, the actuation shaft and the valve body are configured to be lowered in conjunction with the float, and the valve body is configured to close the discharge opening. During a period from when the valve body opens to when the valve body closes, either flushing mode of a large flushing mode or a small flushing mode is selectively performed, in the large flushing mode the flush water in the flush water tank is supplied from the discharge opening to the flush toilet in a first flush water amount, and in the small flushing mode the flush water is supplied in a second flush water amount smaller than the first flush water amount. A first total outflow amount of the flush water in the water storage cylinder flowing out from the outlet port to the flush water tank in the large flushing mode is larger than a second total outflow amount of the flush water in the water storage cylinder flowing out from the outlet port to the flush water tank in the small flushing mode. According to the present invention described above, when starting flushing of the flush toilet, first, on selecting either flushing mode of the large flushing mode or the small flushing mode, the actuation shaft of the discharge valve device is raised to raise (open) the valve body, and the flush water in the flush water tank is supplied from the discharge opening to the flush toilet. Then, the water level in the water storage cylinder decreases depending on the selected large flushing mode or small flushing mode, and the float in the water storage cylinder lowers with the decrease in water level. Therefore, the actuation shaft of the discharge valve device lowers, the valve body lowers (closes), and the supply of flush water from the flush water tank to the flush toilet is stopped, to finish the flushing of the flush toilet. At this time, since the first total outflow amount of the flush water in the water storage cylinder flowing out from the outlet port to the flush water tank in the large flushing mode is larger than the second total outflow amount of the flush water in the water storage cylinder flowing out from the outlet port to the flush water tank in the small flushing mode, the lowering speed of the float during the small flushing mode can be larger than the lowering speed of the float during the large flushing mode. This can make the lowering time of the float and the valve opening time of the valve body during the small flushing mode shorter than the lowering time of the float and the valve opening time of the valve body during the large flushing mode. As a result, the lowering speed of the float with the decrease in water level in the water storage cylinder can be changed by changing the flush water amount of the flush water in the water storage cylinder flowing out from the outlet port to the flush water tank (so-called "water drainage amount") depending on the selected large flushing mode or small flushing mode. Therefore, the flow rate per unit time of flush water (hereinafter referred to as "instantaneous flow rate") [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the water storage cylinder includes a water storage cylinder body including the outlet port, and a small tank communicatively connected to the water storage cylinder body, the small tank includes a communication opening that communicates with the water storage cylinder body, and a partition that opens and closes the communication opening, and the partition opens the communication opening to communicate between the water storage cylinder body and the small tank in the large flushing mode, whereas the partition closes the communication opening to separate the water storage cylinder body and the small tank in the small flushing mode. In the present invention including the configuration, the small tank communicatively connected to the water storage cylinder body includes a communication opening that communicates with the water storage cylinder body, and a partition that opens and closes the communication opening, so that the partition can communicate between the water storage cylinder body and the small tank by opening the communication opening in the large flushing mode. On the other hand, the partition of the small tank can separate the water storage cylinder body and the small tank by closing the communication opening in the small flushing mode. As a result, the first total outflow amount of the flush water in the water storage cylinder flowing out from the outlet port to the flush water tank in the large flushing mode can be larger than the second total outflow amount of the flush water in the water storage cylinder flowing out from the outlet port to the flush water tank in the small flushing mode, so that the lowering speed of the float during the small flushing mode can be larger than the lowering speed of the float during the large flushing mode. This can make the lowering time of the float and the valve opening time of the valve body during the small flushing mode shorter than the lowering time of the float and the valve opening time of the valve body during the large flushing mode. As a result, the lowering speed of the float with the decrease in water level in the water storage cylinder can be changed by changing the flush water amount of the flush water in the water storage cylinder flowing out from the outlet port to the flush water tank (so-called "water drainage amount") depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the partition is provided rotatably with respect to the communication opening, rotates in a direction to open the communication opening in the large flushing mode, and rotates in a direction to close the communication opening in the small flushing mode. According to the present invention described above, if the partition does not rotate with respect to the communication opening but is provided slidably with respect to the communication opening and when the communication opening is closed by the partition, a seal portion in contact with the partition and the communication opening has a risk of being damaged due to wear or the like caused by repeating sliding to open and close the partition with respect to the communication opening. However, according to the present invention, the partition is provided rotatably with respect to the communication opening, can rotate in the direction to open the communication opening in the large flushing mode, and can rotate in the direction to close the communication opening in the small flushing mode. Consequently, as compared with a form in which the partition slides to open and close the communication opening, a risk of the partition normally contacting the communication opening regardless of the flushing mode can be avoided while suppressing the number of parts. This can reduce a risk of damage due to wear or the like on a portion (seal portion) in contact with the partition that closes the communication opening in the small tank.

In the present invention, preferably, the communication opening includes a locking portion that is provided at a rim of the communication opening and that rotatably supports the partition, and the locking portion restricts rotation of the partition, when the partition rotates in the direction to close the communication opening and contacts the locking portion in the small flushing mode. According to the present invention described above, the communication opening of the small tank includes the locking portion that is provided at the rim of the communication opening and that rotatably supports the partition, so that the locking portion can reliably restrict the rotation of the partition, when the partition rotates in the direction to close the communication opening and contacts the locking portion in the small flushing mode. Further, in a state where the partition is in contact with the locking portion in the small flushing mode, the partition and the rim of the communication opening can be reliably brought in contact and sealed by the locking portion, so that water tightness between the water storage cylinder body and the small tank can be improved. Therefore, in the small flushing mode, the flush water in the small tank can be reliably inhibited from flowing into the water storage cylinder body from the communication opening.

In the present invention, preferably, the partition further includes a water weight portion configured to store flush water, the small tank further includes an auxiliary outlet port that is formed in a bottom surface of the small tank and that causes the flush water in the small tank to flow outside. In a state where the partition abuts on the locking portion, the water weight portion is to store flush water and the auxiliary outlet port of the small tank is opened. When the flush water in the small tank flows out from the auxiliary outlet port, the partition rotates in a direction apart from the locking portion and causes the flush water in the water weight portion to flow outside. According to the present invention described above, the partition includes the water weight portion that stores flush water, and the small tank includes the auxiliary outlet port that is formed in the bottom surface of the small tank and that causes the flush water in the small tank to flow outside. Therefore, in the state where the partition abuts on the locking portion, the water weight portion can store flush water, and the flush water in the small tank flows out from the auxiliary outlet port. Further, when the flush water in the small tank flows out from the auxiliary outlet port, the partition rotates in the direction apart from the locking portion, and the flush water in the water weight portion can flow out. Therefore, a series of rotating operations until the partition opens the closed communication opening of the small tank can be executed reliably and smoothly by using change in water level in the small tank and change in amount of flush water stored in the water weight portion.

In the present invention, preferably, the partition at an initial position has a state where the partition is not in contact with the locking portion and the communication opening is opened and any flush water is not stored in the water weight portion, in a standby period in which any flushing mode is not executed and a period in which the large flushing mode is executed, the partition is maintained at the initial position, to close the auxiliary outlet port of the small tank, and flush water is storable in the small tank, whereas in a period in which the small flushing mode is executed, the partition rotates from the initial position and contacts the locking portion, to maintain a state where the communication opening is closed, and then, when the flush water in the small tank flows out from the auxiliary outlet port, the partition causes the flush water in the water weight portion to flow outside while rotating toward the initial position and then returns to the initial position. According to the present invention described above, the partition at the initial position has the state where the partition is not in contact with the locking portion and the communication opening is opened and any flush water is not stored in the water weight portion, in the standby period in which any flushing mode is not executed and the period in which the large flushing mode is executed, the partition is maintained at the initial position, to close the auxiliary outlet port of the small tank, and flush water can be stored in the small tank. On the other hand, in the period in which the small flushing mode is executed, the partition rotates from the initial position and contacts the locking portion, to maintain the state where the communication opening is closed, and then, when the flush water in the small tank flows out from the auxiliary outlet port, the partition causes the flush water in the water weight portion to flow outside while rotating toward the initial position and can then return to the initial position. As a result, the lowering speed of the float with the decrease in water level in the water storage cylinder can be efficiently changed by efficiently changing the flush water amount (so-called "water drainage amount") of the flush water in the water storage cylinder flowing out from the outlet port to the flush water tank depending on the selected large flushing mode or small flushing mode.

In the present invention, preferably, a top edge of the water storage cylinder body and a top edge of the small tank are flush with each other, and in a state where the communication opening is closed by the partition, an upper end of the partition protrudes upward from the top edge of the communication opening and the top edge of the small tank. According to the present invention described above, the top edge of the water storage cylinder body and the top edge of the small tank are flush with each other, and in the state where the communication opening of the small tank is closed by the partition, the upper end of the partition protrudes upward from the top edge of the communication opening or the top edge of the small tank, which can reliably suppress inflow from the small tank into the water storage cylinder body.

Further, the present invention provides a flush water tank device including the discharge valve device. The present invention including this configuration can provide the flush water tank device including the discharge valve device in which changing the flush water amount of the flush water in the water storage cylinder flowing out from the outlet port to the flush water tank (so-called "water drainage amount") depending on the selected large flushing mode or small flushing mode can change the lowering speed of the float with the decrease in water level in the water storage cylinder, can maintain comparatively high the instantaneous flow rate [L/min] of the flush water drained from the discharge opening during the small flushing, and can reduce the closing sound generated when the valve body closes the discharge opening.

Further, the present invention provides a flush toilet including the flush water tank device. The present invention including this configuration can provide the flush toilet including the flush water tank device including the discharge valve device in which changing the flush water amount of the flush water in the water storage cylinder flowing out from the outlet port to the flush water tank (so-called "water drainage amount") depending on the selected large flushing mode or small flushing mode can change the lowering speed of the float with the decrease in water level in the water storage cylinder, can maintain comparatively high the instantaneous flow rate [L/min] of the flush water drained from the discharge opening during small flushing, and can reduce the closing sound generated when the valve body closes the discharge opening.

Next, the present invention provides a discharge valve device provided in a flush water tank that supplies flush water to a flush toilet, the discharge valve device including a valve body that opens and closes a discharge opening provided in a bottom of the flush water tank, an actuation shaft including a lower end provided with the valve body, and moving up and down to open and close the valve body, a water storage cylinder in which the actuation shaft is inserted in a vertical direction and that stores part of flush water in the flush water tank, in the water storage cylinder, an outlet port being formed to cause flush water in the water storage cylinder to flow outside, and a float that is disposed in the water storage cylinder and that causes buoyancy obtained by the flush water in the water storage cylinder to act on the actuation shaft, wherein when the float lowers with decrease in water level in the water storage cylinder, the actuation shaft and the valve body are configured to be lowered in conjunction with the float, and the valve body is configured to close the discharge opening, during a period from when the valve body opens to when the valve body closes, either flushing mode of a large flushing mode or a small flushing mode is selectively performed, in the large flushing mode the flush water in the flush water tank is supplied from the discharge opening to the flush toilet in a first flush water amount, and in the small flushing mode the flush water is supplied in a second flush water amount smaller than the first flush water amount, and the float is configured to decrease buoyancy obtained during the small flushing mode as compared to buoyancy obtained during the large flushing mode. According to the present invention described above, to start flushing of the flush toilet, first, on selecting either flushing mode of the large flushing mode or the small flushing mode, the actuation shaft of the discharge valve device is raised, to raise (open) the valve body, and the flush water in the flush water tank is supplied from the discharge opening to the flush toilet. Then, the water level in the water storage cylinder decreases depending on the selected large flushing mode or small flushing mode, and the float in the water storage cylinder lowers with the decrease in water level. Thus, as the actuation shaft of the discharge valve device lowers, the valve body lowers (closes), and the supply of flush water from the flush water tank to the flush toilet is stopped, to finish the flushing of the flush toilet. At this time, since the buoyancy obtained in the float during the small flushing mode decreases as compared to the buoyancy obtained during the large flushing mode, the lowering time of the float during the small flushing mode can be shorter than the lowering time of the float during the large flushing mode. This can make the lowering time of the float and the valve opening time of the valve body during the small flushing mode shorter than the lowering time of the float and the valve opening time of the valve body during the large flushing mode. As a result, when the flush water in the water storage cylinder flows out from the outlet port to the flush water tank, a balance position between the water level in the water storage cylinder and the float can be changed and the lowering time of the float with the decrease in water level in the water storage cylinder can be changed, by changing the buoyancy that acts on the float depending on the selected large flushing mode or small flushing mode. Therefore, the flow rate per unit time of flush water (hereinafter referred to as "instantaneous flow rate") [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the float includes a storing portion for storing flush water in a part of the float, and the storing portion is configured so that the amount of flush water stored during the small flushing mode is larger than the amount of flush water stored during the large flushing mode. According to the present invention described above, since the float includes the storing portion for storing flush water in a part of the float, this storing portion makes the amount of flush water stored during the small flushing mode larger than the amount of flush water stored during the large flushing mode. Consequently, a weight of the storing portion during the small flushing mode is also larger than a weight of the storing portion during the large flushing mode, and hence the buoyancy obtained in the float during the small flushing mode decreases as compared to the buoyancy obtained during the large flushing mode. This can make the lowering time of the float during the small flushing mode shorter than the lowering time of the float during the large flushing mode. This can make the lowering time of the float and the valve opening time of the valve body during the small flushing mode shorter than the lowering time of the float and the valve opening time of the valve body during the large flushing mode. As a result, when the flush water in the water storage cylinder flows out from the outlet port to the flush water tank, the balance position between the water level in the water storage cylinder and the float can be changed and the lowering time of the float with the decrease in water level in the water storage cylinder can be changed, by changing the buoyancy that acts on the float depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body closes the discharge opening can be reduced.

In the present invention, preferably, the storing portion is provided in an upper part of the float and includes a peripheral wall surrounding a part of the upper part of the float to store flush water, and a partition provided to open and close an outlet formed in a part of the peripheral wall. The partition opens the outlet of the peripheral wall and allows flush water in the storing portion to flow out of the outlet during the large flushing mode, whereas the partition closes the outlet of the peripheral wall and maintains a state where flush water is stored in the storing portion to make the storing portion a water weight during the small flushing mode. According to the present invention described above, when the large flushing mode is executed, the partition opens the outlet of the peripheral wall of the storing portion provided in the upper part of the float, so that the flush water in the storing portion flows out from the outlet, and any flush water is not stored in the storing portion in the upper part of the float. Therefore, the buoyancy of the float can be set comparatively large. On the other hand, when the small flushing mode is executed, the partition closes the outlet of the peripheral wall, so that the flush water in the storing portion cannot flow out from the outlet, and flush water is stored in the storing portion in the upper part of the float. In this state, the storing portion itself functions as the water weight. This can set the buoyancy of the float during the small flushing mode to be smaller than during the large flushing mode. As a result, the lowering time of the float and the valve opening time of the valve body can be reliably switched, by changing the buoyancy that acts on the float depending on the selected large flushing mode or small flushing mode. Further, the valve opening time of the valve body is not affected by manufacturing error of the flush water tank or the flush toilet to which the discharge valve device is applied, and hence proper flushing can be executed.

In the present invention, preferably, the float includes a peripheral wall provided in a lower part of the float and surrounding a part of the lower part of the float to store flush water, a communication port formed in a part of the peripheral wall to communicate inside and outside the float, and a partition provided to open and close the communication port. The partition closes the communication port of the peripheral wall to regulate communication of flush water or air inside and outside the float during the large flushing mode, whereas the partition opens the communication port of the peripheral wall to enable the communication of flush water or air inside and outside the float during the small flushing mode. According to the present invention described above, when the large flushing mode is executed, the partition closes the communication port of the peripheral wall provided in the lower part of the float, so that the communication of flush water or air inside and outside the float is regulated. Therefore, air trapped in the float can set the buoyancy of the float to be comparatively large. On the other hand, when the small flushing mode is executed, the partition opens the communication port of the peripheral wall, to enable the communication of flush water or air inside and outside the float. Accordingly, part of air in the float is discharged from the communication port of the peripheral wall to outside of the float, and in the float, the flush water outside the float can partially flow into a lower region in the float by a volume of the discharged air. Therefore, a volume of air occupying inside of the float during the small flushing mode is smaller than a volume of air occupying the inside of the float during the large flushing mode, and hence the buoyancy of the float during the small flushing mode can be set smaller than during the large flushing mode As a result, the lowering time of the float and the valve opening time of the valve body can be reliably switched by changing the buoyancy that acts on the float depending on the selected large flushing mode or small flushing mode. Further, the valve opening time of the valve body is not affected by the manufacturing error of the flush water tank or the flush toilet to which the drain valve device is applied, and hence proper flushing can be executed even for the flush toilet to which the device is applied.

In the present invention, preferably, the float includes a top surface that closes an upper region of the peripheral wall and a lower opening formed along a bottom edge of the peripheral wall, and forms a generally cylindrical shape opened downward, and the communication port is provided at a height position between the top surface and the lower opening. According to the present invention described above, in a state where the communication port of the peripheral wall of the float is closed by the partition during the large flushing mode, the float is filled with air, and the flush water outside the float is inhibited from flowing into the float from the lower opening. On the other hand, in a state where the communication port of the peripheral wall of the float is opened by the partition during the small flushing mode, part of air in the float is discharged from the communication port, so that the flush water outside the float can flow into the float close to a height of the communication port from the lower opening and/or the communication port. The buoyancy that acts on the float during the small flushing mode decreases as compared to the buoyancy that acts on the float during the large flushing mode. As a result, the lowering time of the float and the valve opening time of the valve body can be reliably switched by changing the buoyancy that acts on the float depending on the selected large flushing mode or small flushing mode. Further, since the valve opening time of the valve body is not affected by the manufacturing error of the flush water tank or the flush toilet to which the drain valve device is applied, proper flushing can be executed even for the flush toilet to which the device is applied.

Next, the present invention provides a discharge valve device provided in a flush water tank that supplies flush water to a flush toilet, the discharge valve device including a valve body that opens and closes a discharge opening provided in a bottom of the flush water tank, an actuation shaft including a lower end provided with the valve body and moving up and down to open and close the valve body, and a float that is connected to the actuation shaft and that causes buoyancy obtained by the flush water in the flush water tank to act on the actuation shaft. When the float lowers with decrease in water level in the flush water tank, the actuation shaft and the valve body are configured to be lowered in conjunction with the float, and the valve body is configured to close the discharge opening. During a period from when the valve body opens to when the valve body closes, either flushing mode of a large flushing mode or a small flushing mode is selectively performed, in the large flushing mode the flush water in the flush water tank is supplied from the discharge opening to the flush toilet in a first flush water amount, and in the small flushing mode the flush water is supplied in a second flush water amount smaller than the first flush water amount. The float is configured to decrease the buoyancy obtained during the small flushing mode as compared to the buoyancy obtained during the large flushing mode. According to the present invention described above, to start flushing of the flush toilet, first, on selecting either flushing mode of the large flushing mode or the small flushing mode, the actuation shaft of the discharge valve device is raised, to raise (open) the valve body, and the flush water in the flush water tank is supplied from the discharge opening to the flush toilet. Then, when the water level in the flush water tank decreases depending on the selected large flushing mode or small flushing mode, the float lowers with the decrease in water level. Accordingly, as the actuation shaft of the discharge valve device lowers, the valve body lowers (closes), and the supply of flush water from the flush water tank to the flush toilet is stopped, to finish the flushing of the flush toilet. At this time, the buoyancy obtained in the float during the small flushing mode decreases as compared to the buoyancy obtained during the large flushing mode, and hence the lowering time of the float during the small flushing mode can be shorter than the lowering time of the float during the large flushing mode. This can make the lowering time of the float and the valve opening time of the valve body during the small flushing mode shorter than the lowering time of the float and the valve opening time of the valve body during the large flushing mode. As a result, a balance position between the water level in the flush water tank and the float can be changed and the lowering time of the float with the decrease in water level in the flush water tank can be changed, by changing the buoyancy that acts on the float depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body closes the discharge opening can also be reduced.

Further, the present invention provides a flush water tank device including the discharge valve device. The present invention including this configuration can provide the flush water tank device including the discharge valve device in which changing the buoyancy that acts on the float depending on the selected large flushing mode or small flushing mode can change the lowering time of the float with the decrease in water level, can maintain comparatively high the instantaneous flow rate [L/min] of flush water drained from the discharge opening during small flushing, and can reduce the closing sound generated when the valve body closes the discharge opening.

Furthermore, the present invention provides a flush toilet including the flush water tank device. The present invention including this configuration can provide the flush toilet including the flush water tank device including the discharge valve device in which changing the buoyancy that acts on the float depending on the selected large flushing mode or small flushing mode can change the lowering time of the float with the decrease in water level, can maintain comparatively high the instantaneous flow rate [L/min] of the flush water drained from the discharge opening during small flushing, and can reduce the closing sound generated when the valve body closes the discharge opening.

According to the discharge valve device, the flush water tank device, and the flush toilet of the present invention, changing the lowering speed of the float with decrease in water level in the water storage cylinder depending on the selected large flushing mode or small flushing mode can maintain comparatively high the instantaneous flow rate [L/min] of flush water drained from the discharge opening during the small flushing and can reduce the closing sound generated when the drain valve closes the discharge opening.

DETAILED DESCRIPTION OF THE PREFERRED EMBODIMENTS

Figure 1:
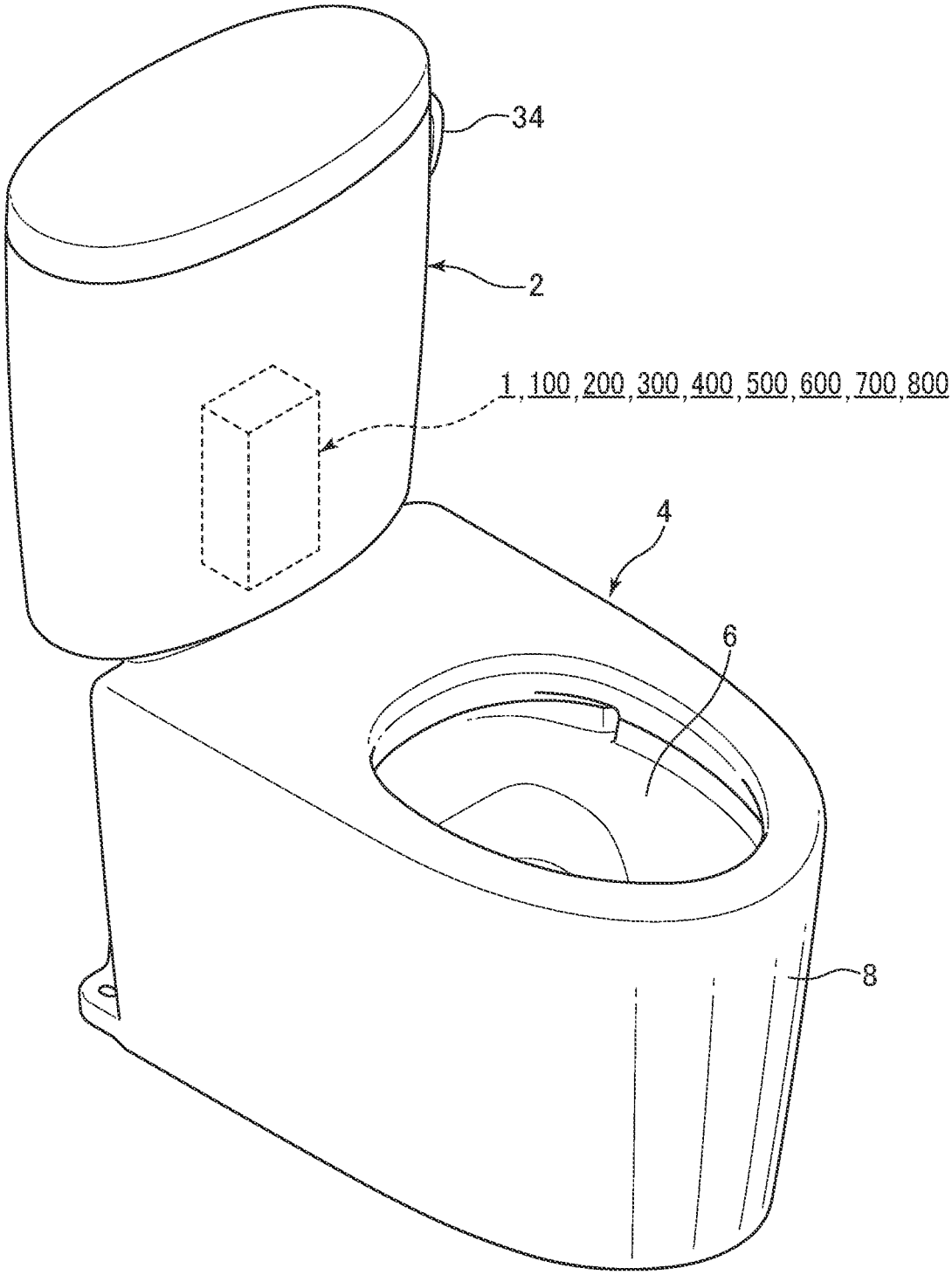
FIG. 1 is a perspective view of a flush water tank device and a flush toilet to which a discharge valve device according to first to ninth embodiments of the present invention is applied as seen from diagonally above.
Figure 2:
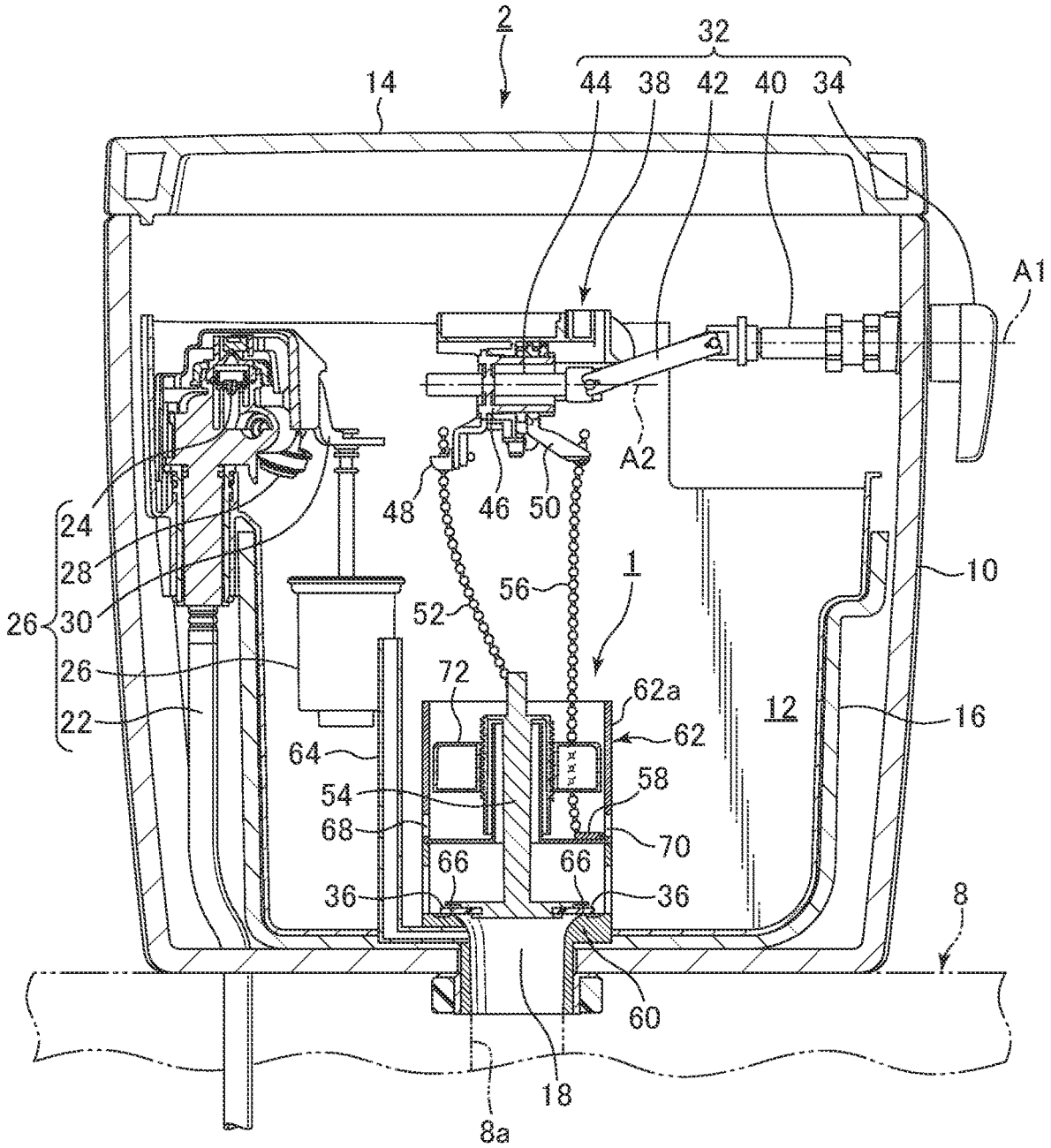
FIG. 2 is a front sectional view of a flush water tank device including a discharge valve device according to the first embodiment of the present invention.

Hereinafter with reference to the accompanying drawings, some embodiments relating to a discharge valve device of the present invention, a flush water tank device including the discharge valve device and a flush toilet including the flush water tank device will be described. First, with FIGS. 1 to 3B, a discharge valve device 1 according to a first embodiment of the present invention, a flush water tank device 2 including the discharge valve device 1 and a flush toilet 4 including the flush water tank device 2 will be described. As shown in FIGS. 1 and 2, the flush toilet 4 including the flush water tank device 2 to which the discharge valve device 1 according to the first embodiment of the present invention is applied includes a ceramic toilet main body 8 that forms a bowl 6. On a rear side of an upper surface of the toilet main body 8, the flush water tank device 2 described later in detail is provided. When flush water stored in the flush water tank device 2 is supplied to the toilet main body 8 of the flush toilet 4 by actuation of the discharge valve device 1 of the present embodiment, inside of the bowl 6 is flushed. Here, as a form of the flush toilet 4 including the flush water tank device 2 to which the discharge valve device 1 of the present embodiment is applied, for example, a form of so-called "siphon-type flush toilet" may be applied that suctions waste in the bowl 6 by use of a siphon action and that discharges the waste at once to outside from a drain trap (not shown) on a downstream side, or a form of so-called "flush-away-type flush toilet" that pushes away waste by water flow due to water drop in the bowl 6 may be applied.

Next, with reference to FIG. 2, a schematic configuration of the flush water tank device 2 to which the discharge valve device 1 of the present embodiment is applied will be described. As shown in FIG. 2, the flush water tank device 2 includes a ceramic exterior tank 10, a storage tank 12 that is a flush water tank disposed inside the exterior tank to store flush water for flushing the toilet, and a lid body 14 placed above the exterior tank 10. First, the storage tank 12 is attached to the exterior tank 10 via an insulating body 16 surrounding an outer periphery of the storage tank. Further, a discharge opening 18 communicating with a water conduit 8*a* of the toilet main body 8 is provided in a bottom of each of the storage tank 12 and the exterior tank 10. The discharge opening 18 can be opened and closed by the discharge valve device 1 of the present embodiment, which will be described later in detail. For the lid body 14 of the flush water tank device 2 of the present embodiment, a form in which hand washing means, such as a hand washing bowl (washbasin) or a hand washing faucet, is not provided on an upper surface of the lid body will be described, and a form in which the hand washing means is provided is also applicable.

Next, as shown in FIG. 2, the flush water tank device 2 includes a water supply device 20 that supplies flush water into the storage tank 12. The water supply device 20 includes a water supply pipe 22, a valve unit 24 including a water supply valve (not shown), a water supplying float 26, a discharge pipe 28, and the like. First, the water supply pipe 22 connects a water supply source (not shown) such as an external water pipe and the valve unit 24, and can supply, to the valve unit 24, flush water supplied from the water supply source (not shown) such as the external water pipe. Next, the water supplying float 26 is coupled to the valve unit 24 via a lever 30 and moves up and down depending on a water level in the storage tank 12, to open and close the water supply valve (not shown) of the valve unit 24. Further, the discharge pipe 28 is connected to a downstream side of the valve unit 24. As the water supply valve (not shown) opens and closes, flush water from the valve unit 24 into the storage tank 12 can be discharged and stopped (supplied and stopped).

Next, as shown in FIG. 2, the flush water tank device 2 includes an operation device 32 that operates the discharge valve device 1 to open and close the valve. The operation device 32 includes an operation lever 34 that is manually rotationally operated by a user, an actuating portion (pulling-up actuating portion 38) that pulls up a valve body 36 of the discharge valve device 1, and a plurality of rotary shafts (outer rotary shaft 40, inner rotary shaft 42) that couple the operation lever 34 and the pulling-up actuating portion 38, respectively.

First, the operation lever 34 is provided on one of left and right outer sides of the exterior tank 10 (the right side of the exterior tank 10 of the flush water tank device 2 shown in FIG. 2 as seen from a front side) and can be rotationally operated about a rotation center axis A1 extending in a left-right direction, manually by the user. Next, the outer rotary shaft 40 is provided in the exterior tank 10, extends in the left-right direction and has one end side (operation lever 34 side) coupled to the operation lever 34. Further, the other end side (inner end side) of the outer rotary shaft 40 is coupled to one end side (outer end side) of the inner rotary shaft 42 disposed inside the outer rotary shaft.

Next, the pulling-up actuating portion 38 has an upper end portion fixed to an upper end and a center side of the storage tank 12. The pulling-up actuating portion 38 includes a rotary spindle portion 44 coupled to the other end side (inner end side) of the inner rotary shaft 42, and a cylindrical rotating portion 46 provided on an outer peripheral side of the rotary spindle portion 44. When the rotary spindle portion 44 rotates about a rotation center axis A2, the cylindrical rotating portion 46 can rotate integrally with the rotary spindle portion 44 about the rotation center axis A2. Also, the cylindrical rotating portion 46 includes a first swing lever 48 involved in pulling up the valve body 36 when the valve body 36 of the discharge valve device 1 is opened to start flushing of the toilet, and a second swing lever 50 involved in switching a toilet flushing mode to either one of a large flushing mode or a small flushing mode. Further, the first swing lever 48 is connected to an upper side of a first bead chain 52, and a lower side of the first bead chain 52 is connected to an upper end portion of an actuation shaft 54 that actuates (linearly moves) the valve body 36 of the discharge valve device 1, which will be described later in detail. On the other hand, the second swing lever 50 is connected to an upper side of a second bead chain 56, and a lower side of the second bead chain 56 is connected to a part of a partition for switching large or small flushing (switching valve 58 for switching large or small flushing) of the discharge valve device 1 described later in detail.

For example, to start toilet flushing by the large flushing mode, when the operation lever 34 shown in FIG. 2 is rotated at a predetermined angle (for example, 90 degrees) to one side (front side of FIG. 2) about the rotation center axis A1, the outer rotary shaft 40 and the inner rotary shaft 42 coupled to the operation lever 34 rotate to one side, and the rotary spindle portion 44 of the pulling-up actuating portion 38 rotates to one side about the rotation center axis A2. Accordingly, the cylindrical rotating portion 46 of the pulling-up actuating portion 38 rotates integrally with the rotary spindle portion 44 about the rotation center axis A2 to one side (front side of FIG. 2). The first swing lever 48 swings (rotates) to one side (front side of FIG. 2) to pull up the first bead chain 52, and the second swing lever 50 swings (rotates) to one side (front side of FIG. 2) to pull up the second bead chain 56. On the other hand, to start toilet flushing by the small flushing mode, when the operation lever 34 shown in FIG. 2 is rotated at a predetermined angle (for example, 90 degrees) on the other side (back side of FIG. 2) about the rotation center axis A1, the outer rotary shaft 40 and the inner rotary shaft 42 coupled to the operation lever 34 rotate to the other side, and the rotary spindle portion 44 of the pulling-up actuating portion 38 rotates to the other side about the rotation center axis A2. Consequently, the cylindrical rotating portion 46 of the pulling-up actuating portion 38 also rotates integrally with the rotary spindle portion 44 about the rotation center axis A2 to the other side (back side of FIG. 2). The first swing lever 48 swings (rotates) to the other side (back side of FIG. 2) to pull up the first bead chain 52, while the second swing lever 50 does not swing, and the second bead chain 56 is not pulled up.

In the present embodiment, a form in which the user manually operates the operation lever 34 will be described as the operation device 32 that operates the discharge valve device 1, but the embodiment is not limited to such a form, and another form is also applicable. For example, as another form of the operation device, a controller may electrically control actuation of a drive unit (motor or the like) of the pulling-up actuating portion based on a signal input from the user with an operation button or the like, and accordingly a pulling-up operation of the valve body 36 of the discharge valve device 1 with the first swing lever 48 and a switch operation of the large and small flushing modes with the second swing lever 50 may be automatically performed. Further, each of the bead chains 52 and 56 of the discharge valve device 1 of the present embodiment may be a linear wire member.

Next, details of the discharge valve device 1 of the present embodiment will be described with reference to FIGS. 2 to 3B. Here, in states (I) to (VI) of the discharge valve device 1 in each of the large flushing mode and the small flushing mode shown in FIGS. 3A and 3B, a state (standby state) before starting valve opening of the valve body 36 is obtained as the state (I), and thereafter, in time series, a valve opened state of the valve body 36 is obtained as states (II) to (V), and a valve closed state of the valve body 36 is obtained as state (VI).

First, as shown in FIG. 2, the discharge valve device 1 of the present embodiment includes a discharge opening forming portion 60 attached to a bottom surface of the storage tank 12 to form the discharge opening 18, a water storage cylinder 62 provided above the discharge opening forming portion 60, and an overflow pipe 64 attached to the discharge opening forming portion 60 to communicate with the discharge opening 18. Next, as shown in FIG. 2, the discharge valve device 1 includes a valve seat 66 formed at a top edge of the discharge opening 18, the valve body 36 provided to be closable and movable linearly upward with respect to the valve seat 66, and the actuation shaft 54 including a lower end provided with the valve body 36 and linearly moving (moving up and down) in a vertical direction to open and close the valve body 36. The actuation shaft 54 is provided to be inserted in the water storage cylinder 62 in the vertical direction. Further, the water storage cylinder 62 stores part of the flush water in the storage tank 12, and left and right side walls 62*a* are provided with a first outlet port 68 and a second outlet port 70, respectively, that cause the flush water in the water storage cylinder 62 to flow outside (into the storage tank 12). Further, a float 72 is disposed in the water storage cylinder 62. The float 72 is concentrically provided on an outer peripheral side of the actuation shaft 54, moves (moves up and down) in conjunction with a water level in the water storage cylinder 62, and allows buoyancy obtained by the flush water in the water storage cylinder 62 to act on the actuation shaft 54.

Next, as shown in FIG. 2, the partition for switching large or small flushing (switching valve 58) is openably and closably provided in the second outlet port 70 on one side of the left and right side walls 62*a* of the water storage cylinder 62 (on the right side as the water storage cylinder 62 in FIG. 2 is seen from the front side). As shown in FIG. 3A, to execute the toilet flushing by the large flushing mode, the partition (switching valve 58) can close the second outlet port 70, when the second bead chain 56 is pulled up by the second swing lever 50. On the other hand, as shown in FIG. 3B, to execute the toilet flushing by the small flushing mode, the partition (switching valve 58) can open the second outlet port 70, when the second bead chain 56 loosens without being pulled up by the second swing lever 50.

Figure 3A:
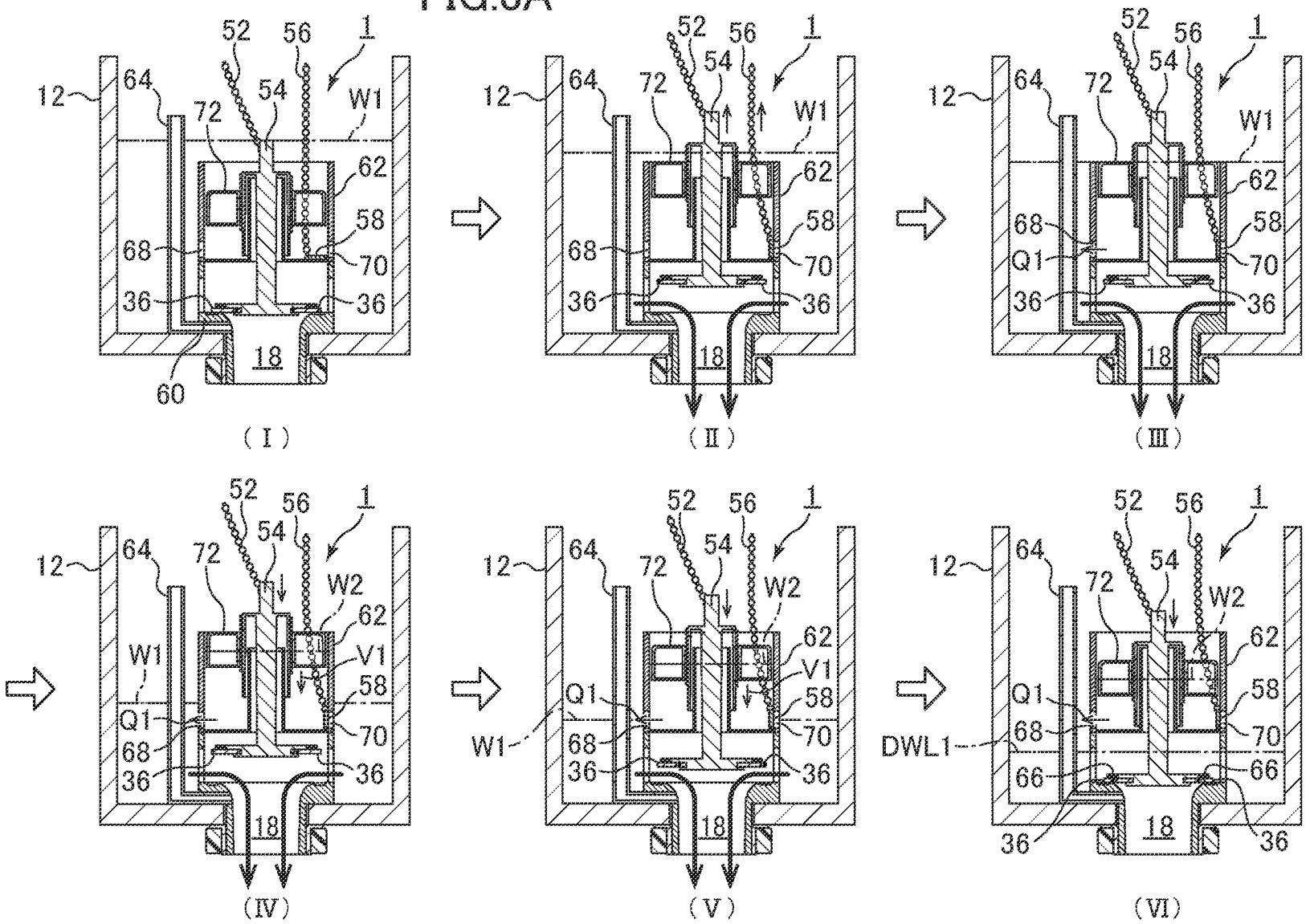
FIG. 3A is a schematic diagram showing a configuration of the discharge valve device according to the first embodiment of the present invention and a series of operations from a standby state until a valve is started to open and closed by a large flushing mode.

That is, as shown in the states (II) to (V) of FIG. 3A, when the valve body 36 is opened for the large flushing mode, the first outlet port 68 is normally open, and the second outlet port 70 is closed by the switching valve 58. On the other hand, as shown in the states (II) to (V) of FIG. 3B, when the valve body 36 is opened for the small flushing mode, the first outlet port 68 is normally open, and the second outlet port 70 is opened by the switching valve 58. These settings are such that a total opening area S2 of the outlet ports 68 and 70 when the valve body 36 is opened in the small flushing mode shown in the states (II) to (V) of FIG. 3B increases as compared to a total opening area S1 of the outlet ports 68 and 70 of the water storage cylinder 62 when the valve body 36 is opened in the large flushing mode shown in the states (II) to (V) of FIG. 3A (S2<S1). Therefore, a flush water amount Q2 per unit time [L/min] of the flush water in the water storage cylinder 62 flowing out from each outlet port 68, 70 to the storage tank 12 when the valve body 36 is opened during the small flushing mode (so-called "water drainage speed Q2") is larger than a flush water amount Q1 per unit time [L/min] of the flush water in the water storage cylinder 62 flowing out only from the first outlet port 68 to the storage tank 12 when the valve body 36 is opened during the large flushing mode (so-called "water drainage speed Q1") (Q2>Q1).

Figure 3B:
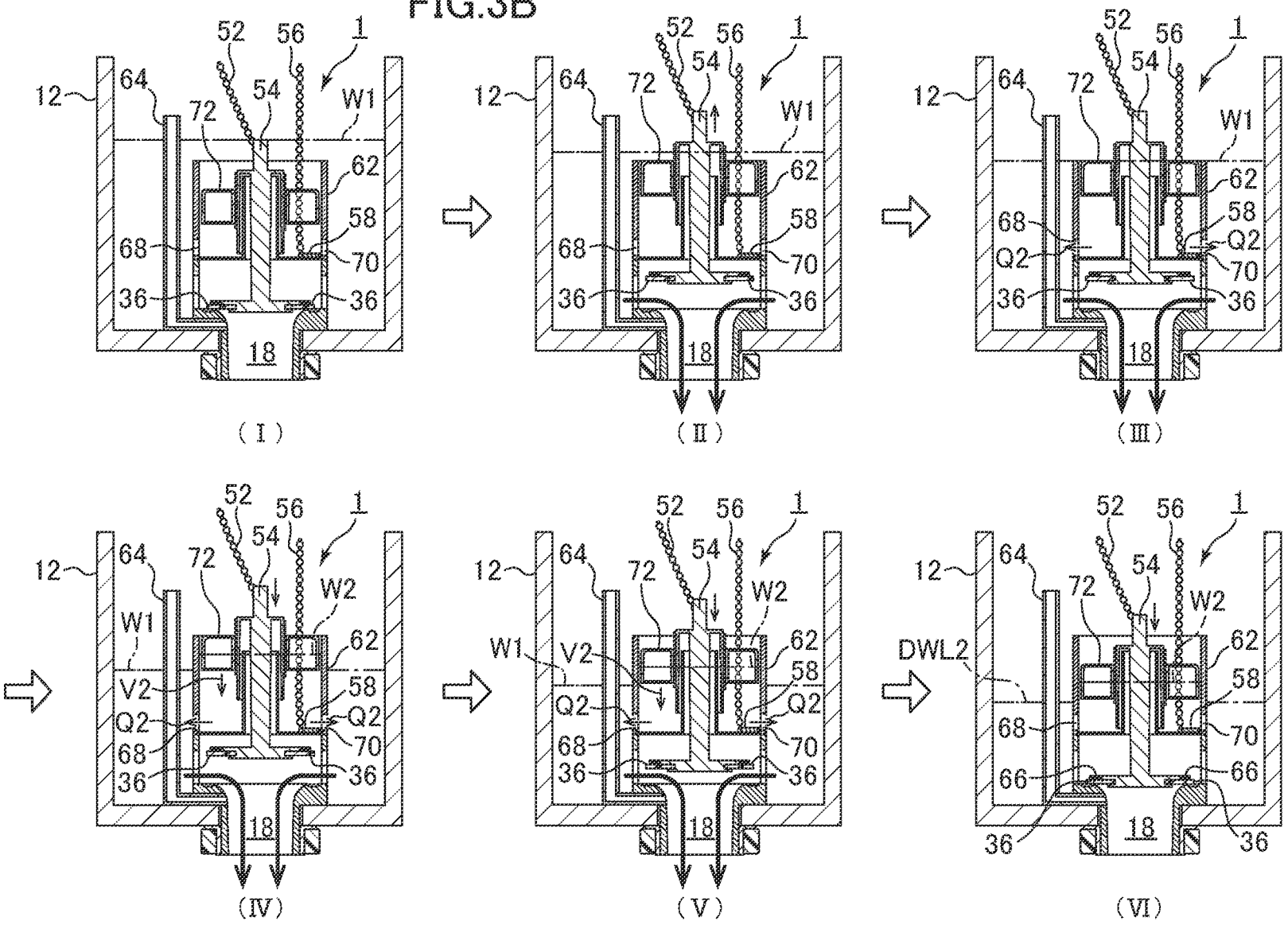
FIG. 3B is a schematic diagram showing a configuration of the discharge valve device according to the first embodiment of the present invention and a series of operations from the standby state until the valve is started to open and closed by a small flushing mode.

Here, in the states (I) to (VI) of each of FIGS. 3A and 3B, the water level in the storage tank 12 is denoted with sign W1, and the water level in the water storage cylinder 62 is denoted with sign W2. Since the flush water amount Q2 per unit time of the flush water flowing out from the outlet ports 68 and 70 of the water storage cylinder 62 to the storage tank 12 during the small flushing mode is larger than the flush water amount Q1 per unit time of the flush water flowing only from the first outlet port 68 of the water storage cylinder 62 during the large flushing mode (Q2>Q1), a lowering speed v2 of the water level W2 in the water storage cylinder 62 that lowers during the small flushing mode is also larger than a lowering speed v1 of the water level W1 in the water storage cylinder 62 that lowers during the large flushing mode (v2>v1). This also makes the lowering speed v2 of the float 72 when the float 72 lowers in conjunction with decrease in water level in the water storage cylinder 62 during the small flushing mode to be larger than the lowering speed v1 of the float 72 during the large flushing mode (v2>v1).

Next, an operation of the discharge valve device 1 according to the first embodiment of the present invention will be described with reference to FIGS. 2 to 3B. First, with reference to FIGS. 2 and 3A, the large flushing mode executed by the discharge valve device 1 according to the first embodiment of the present invention will be described. To start the large flushing mode from the standby state (I) of FIGS. 2 and 3A, for example, when the user rotates the operation lever 34 shown in FIG. 2 at 90 degrees to the front side, each of the first swing lever 48 and the second swing lever 50 in an initial position state (standby state) shown in FIG. 2 is swung, and each of the first bead chain 52 and the second bead chain 56 is pulled up. Accordingly, as the actuation shaft 54 and the valve body 36 of the discharge valve device 1 are pulled up to linearly move upward via the first bead chain 52, the float 72 is also integrally pulled up via the actuation shaft 54 (see the state (II) of FIG. 3A). Further, as a part of the partition (switching valve 58) for switching large or small flushing of the discharge valve device 1 is pulled up via the second bead chain 56, the switching valve 58 rotates to close the second outlet port 70 of the water storage cylinder 62 (see the state (II) of FIG. 3A).

At this time, as shown in the state (II) of FIG. 3A, the float 72 and the valve body 36 are raised to the highest position, and the discharge opening 18 of the storage tank 12 is opened by the raised valve body 36, to start draining of flush water from inside of the storage tank 12 to the discharge opening 18. Thereafter, as shown in the state (III) of FIG. 3A, when the water level W1 in the storage tank 12 decreases close to the upper end of the water storage cylinder 62 and further to a water level lower than the upper end of the water storage cylinder 62, a water pressure due to the water level W2 in the water storage cylinder 62 is higher than a water pressure due to the water level W1 in the storage tank 12 outside the cylinder. Therefore, the flush water in the water storage cylinder 62 flows out from the first outlet port 68 into the storage tank 12 outside the cylinder. Then, as shown in the state (IV) of FIG. 3A, the water level W2 in the water storage cylinder 62 is higher than the water level W1 in the storage tank 12 outside the cylinder, but the flush water in the water storage cylinder 62 continues to flow out of the first outlet port 68. Therefore, as the water level W2 in the water storage cylinder 62 gradually decreases, the float 72 also lowers in conjunction with lowering of the water level W2.

Next, as shown in the state (V) of FIG. 3A, when the water level W1 in the storage tank 12 outside the water storage cylinder 62 decreases to below an upper end of the first outlet port 68 of the water storage cylinder 62, outside of the first outlet port 68 of the water storage cylinder 62 is open to the atmosphere. This increases a speed at which the flush water in the water storage cylinder 62 flows out of the first outlet port 68, and the water level W2 in the water storage cylinder 62 further decreases. Therefore, the float 72 also lowers, and the actuation shaft 54 and the valve body 36 also lower integrally. Then, as shown in the state (VI) of FIG. 3A, when the valve body 36 contacts the valve seat 66, the discharge opening 18 is closed. Accordingly, draining of flush water from the inside of the storage tank 12 to the discharge opening 18 is stopped, and supply of flush water from the flush water tank device 2 to the toilet main body 8 by the large flushing mode is finished. At this time, the float 72, the actuation shaft 54 and the valve body 36 are in a stopped state, but a minimum water level DWL1 (draining stop water level so-called "dead water line") in the storage tank 12 is located below a lower end of the first outlet port 68 of the water storage cylinder 62. For this reason, the flush water in the water storage cylinder 62 continues to flow out from the first outlet port 68 to the storage tank 12 side. As only the water level W2 in the water storage cylinder 62 gradually decreases, a water pressure in the water storage cylinder 62 also decreases. At this time, as the water pressure in the water storage cylinder 62 decreases, the switching valve 58 that closes the second outlet port 70 of the water storage cylinder 62 is actuated (rotated) from a state where the valve closed state is maintained with the water pressure of the flush water in the water storage cylinder 62 in a direction to open the second outlet port 70, thereby obtaining the valve opened state. That is, after the large flushing mode is finished, the switching valve 58 is in a state of opening the second outlet port 70 in the standby state until the next flushing mode is started.

Next, with reference to FIGS. 2 and 3B, a small flushing mode executed by the discharge valve device 1 according to the first embodiment of the present invention will be described. To start the small flushing mode from FIG. 2 and the standby state (I) of FIG. 3B, for example, when the user rotates the operation lever 34 shown in FIG. 2 at 90 degrees to the back side, only the first swing lever 48 in the state at the initial position (standby state) shown in FIG. 2 is swung, and only the first bead chain 52 is pulled up. Accordingly, as the actuation shaft 54 and the valve body 36 of the discharge valve device 1 are pulled up and move linearly upward via the first bead chain 52, the float 72 is also integrally pulled up via the actuation shaft 54 (see state (II) of FIG. 3B). On the other hand, the second swing lever 50 is not swung, and hence the second bead chain 56 cannot be pulled up, thereby maintaining a state where the second outlet port 70 of the water storage cylinder 62 is normally opened by the switching valve 58 for switching large or small flushing. The state where the switching valve 58 is normally open is maintained thereafter until the small flushing mode ends (see states (II) to (VI) of FIG. 3B).

Further, as shown in the state (II) of FIG. 3B, the float 72 and the valve body 36 are raised to the highest position, and the discharge opening 18 of the storage tank 12 is opened by the raised valve body 36, to start the draining of flush water from the inside of the storage tank 12 to the discharge opening 18. Thereafter, as shown in the state (III) of FIG. 3B, when the water level W1 in the storage tank 12 decreases close to the upper end of the water storage cylinder 62 and further to a water level below the upper end of the water storage cylinder 62, the water pressure due to the water level W2 in the water storage cylinder 62 is higher than the water pressure due to the water level W1 in the storage tank 12 outside the cylinder. Therefore, the flush water in the water storage cylinder 62 flows out of the first outlet port 68 and the second outlet port 70, into the storage tank 12 outside the cylinder. Then, as shown in the states (IV) and (V) of FIG. 3B, the water level W2 in the water storage cylinder 62 is higher than the water level W1 in the storage tank 12 outside the cylinder, but the flush water in the water storage cylinder 62 continues to flow out of the outlet ports 68 and 70. Therefore, as the water level W2 in the water storage cylinder 62 gradually decreases, the float 72 also lowers in conjunction with lowering of the water level W2.

At this time, the flush water amount Q2 per unit time flowing out from the outlet ports 68 and 70 of the water storage cylinder 62 to the storage tank 12 during the small flushing mode shown in the state (IV) and (V) of FIG. 3B becomes larger than the flush water amount Q1 per unit time flowing out only from the first outlet port 68 of the water storage cylinder 62 to the storage tank 12 during the large flushing mode shown in the state (IV) and (V) of FIG. 3A (Q2>Q1). Accordingly, the lowering speed v2 when the water level W2 in the water storage cylinder 62 and the float 72 lower during the small flushing mode also becomes larger than the lowering speed v1 when the water level W1 in the water storage cylinder 62 and the float 72 lower during the large flushing mode (v2>v1).

Then, as shown in the state (VI) of FIG. 3B, when the valve body 36 contacts the valve seat 66, the discharge opening 18 is closed, and the draining of flush water from the inside of the storage tank 12 to the discharge opening 18 is stopped. Accordingly, the supply of flush water from the flush water tank device 2 to the toilet main body 8 by the small flushing mode is finished. At this time, a minimum water level DWL2 (draining stop water level so-called "dead water line") in the storage tank 12 during the small flushing mode in the state (IV) of FIG. 3B is located above the minimum water level DWL1 in the storage tank 12 during the large flushing mode in the state (VI) of FIG. 3A. That is, the minimum water level DWL2 during the small flushing mode is higher than the minimum water level DWL1 during the large flushing mode, by which the amount of flush water drained from the storage tank 12 to the discharge opening 18 during the small flushing mode is lower than the amount of flush water drained from the storage tank 12 to the discharge opening 18 during the large flushing mode.

According to the discharge valve device 1 of the first embodiment of the present invention described above, to start the flushing of the flush toilet 4, first, on selecting either flushing mode of the large flushing mode or the small flushing mode, the actuation shaft 54 of the discharge valve device 1 is raised to raise (open) the valve body 36, and the flush water in the storage tank 12 of the flush water tank device 2 is supplied from the discharge opening 18 to the toilet main body 8 of the flush toilet 4. Then, the water level W2 in the water storage cylinder 62 decreases depending on the selected large flushing mode or small flushing mode, and the float 72 in the water storage cylinder 62 lowers with the decrease in water level W2. Accordingly, as the actuation shaft 54 of the discharge valve device 1 lowers, the valve body 36 lowers (closes), and the supply of flush water from the storage tank 12 to the flush toilet 4 is stopped, to finish the flushing of the flush toilet 4. At this time, the lowering speeds v1 and v2 of the float 72 with the decrease in water level in the water storage cylinder 62 can be changed depending on the selected large flushing mode or small flushing mode, and hence a lowering time of the float 72 and a valve opening time of the valve body 36 can be changed depending on the selected flushing mode. Therefore, a flow rate per unit time of flush water (instantaneous flow rate) [L/min] that affects the flushing performance can be maintained comparatively high even in the small flushing mode in which the flush water amount is smaller than in the large flushing mode. Further, closing sound generated when the valve body 36 closes the discharge opening 18 can be reduced by changing the lowering speeds v1 and v2 of the float 72 with the decrease in water level in the water storage cylinder 62 depending on the selected large flushing mode or small flushing mode.

Further, according to the discharge valve device 1 of the present embodiment, the total opening area S2 of the outlet ports 68 and 70 of the water storage cylinder 62 when the valve body 36 is opened during the small flushing mode is set larger than the total opening area S1 of the outlet port 68 of the water storage cylinder 62 when the valve body 36 is opened during the large flushing mode (S2>S1). Consequently, the flush water amount Q2 per unit time [L/min] (so-called "water drainage speed Q2") of the flush water in the water storage cylinder 62 flowing out from the outlet ports 68 and 70 to the storage tank 12 when the valve body 36 is opened during the small flushing mode is larger than the flush water amount Q1 per unit time [L/min] (so-called "water drainage speed Q1") of flush water flowing out only from the first outlet port 68 to the storage tank 12 when the valve is opened during the large flushing mode, and hence the lowering speed v2 of the float 72 during the small flushing mode can be larger than the lowering speed v1 of the float 72 during the large flushing mode (v2>v1). Consequently, the lowering time of the float 72 and the valve opening time of the valve body 36 during the small flushing mode can be shorter than the lowering time of the float 72 and the valve opening time of the valve body 36 during the large flushing mode. As a result, the lowering speeds v1, v2 of the float 72 with the decrease in water level in the water storage cylinder 62 can be changed by changing the flush water amounts Q1, Q2 per unit time [L/min] of the flush water in the water storage cylinder 62 flowing out from the outlet ports 68, 70 to the storage tank 12 (so-called "water drainage speeds Q1, Q2") depending on the selected large flushing mode or small flushing mode, Therefore, the instantaneous flow rate of flush water [L/min] that affects the flushing performance can be maintained comparatively high even in the small flushing mode in which the flush water amount is smaller than in the large flushing mode. Further, the closing sound generated when the valve body 36 closes the discharge opening 18 can be reduced.

Further, according to the discharge valve device 1 of the present embodiment, when the valve body 36 is opened during the large flushing mode, the flush water in the water storage cylinder 62 flows out from the first outlet port 68 to the flush water tank, whereas when the valve body 36 is opened during the small flushing mode, the flush water in the water storage cylinder 62 flows out from both the first outlet port 68 and the second outlet port 70 to the storage tank 12. At this time, the second flush water amount Q2 per unit time [L/min] of the flush water in the water storage cylinder 62 flowing out from both the first outlet port 68 and the second outlet port 70 to the storage tank 12 in the small flushing mode (so-called "second water drainage speed Q2") can be increased, as compared to the first flush water amount Q1 per unit time [L/min] of the flush water in the water storage cylinder 62 flowing out from the first outlet port 68 to the storage tank 12 in the large flushing mode (so-called "first water drainage speed Q1"). Therefore, since the lowering speed v2 of the float 72 during the small flushing mode can be larger than the lowering speed v1 of the float 72 during the large flushing mode, the lowering time of the float 72 and the valve opening time of the valve body 36 during the small flushing mode can be shorter than the lowering time of the float 72 and the valve opening time of the valve body 36 during the large flushing mode. As a result, the lowering speed v1, v2 of the float 72 with the decrease in water level in the water storage cylinder 62 can be changed by changing the flush water amount Q1, Q2 per unit time [L/min] of the flush water in the water storage cylinder 62 flowing out from the outlet port 68, 70 to the storage tank 12 (so-called "water drainage speed Q1, Q2") depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body 36 closes the discharge opening 18 can be reduced.

Further, according to the discharge valve device 1 of the present embodiment, the switching valve 58 for switching large or small flushing that closes a part (second outlet port 70) of the outlet ports 68 and 70 of the water storage cylinder 62 can close a part (second outlet port 70) of the outlet ports 68 and 70 so that the total opening area S1 of the outlet port 68 during the large flushing mode is smaller than the total opening area S2 of the outlet ports 68 and 70 during the small flushing mode. Accordingly, since the flush water amount Q2 per unit time [L/min] of the flush water in the water storage cylinder 62 flowing out from the outlet ports 68 and 70 to the storage tank 12 when the valve body 36 is opened during the small flushing mode (so-called "water drainage speed Q2") is larger than the flush water amount Q1 per unit time [L/min] of the flush water in the water storage cylinder 62 flowing out only from the first outlet port 68 when the valve body 36 is opened during the large flushing mode (so-called "water drainage speed Q1") (Q2>Q1), the lowering speed v2 of the float 72 during the small flushing mode can be larger than the lowering speed v1 of the float 72 during the large flushing mode (v2>v1). Therefore, the lowering time of the float 72 and the valve opening time of the valve body 36 during the small flushing mode can be shorter than the lowering time of the float 72 and the valve opening time of the valve body 36 during the large flushing mode. As a result, the lowering speed v1, v2 of the float 72 with the decrease in water level in the water storage cylinder 62 can be changed by changing the flush water amount Q1, Q2 per unit time [L/min] of the flush water in the water storage cylinder 62 flowing out from the outlet port 68, 70 to the storage tank 12 (so-called "water drainage speed Q1, Q2") depending on the selected large flushing mode or small flushing mode. Therefore, the instantaneous flow rate of flush water [L/min] that affects the flushing performance can be maintained comparatively high even in the small flushing mode in which the flush water amount is smaller than in the large flushing mode. Further, the closing sound generated when the valve body 36 closes the discharge opening 18 can be reduced.

Next, with reference to FIGS. 1, 4A, and 4B, a discharge valve device 100 according to a second embodiment of the present invention will be described. Here, in the discharge valve device 100 according to the second embodiment of the present invention shown in FIGS. 4A and 4B, the same part as in the discharge valve device 1 according to the first embodiment of the present invention described above is denoted with the same sign and is not described.

Figure 4A:
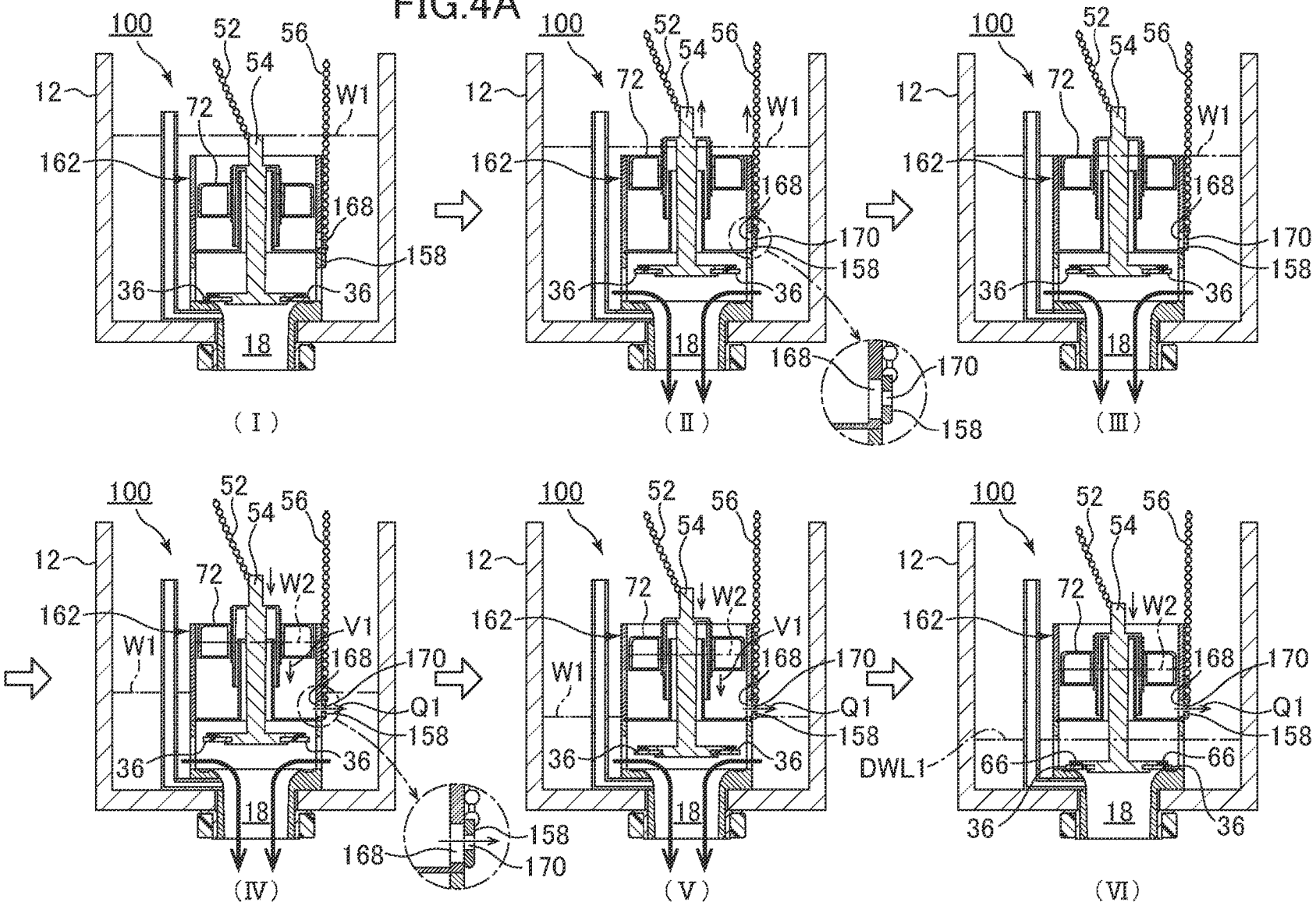
FIG. 4A is a schematic diagram showing a configuration of a discharge valve device according to the second embodiment of the present invention and a series of operations from a standby state until a valve is started to open and closed by the large flushing mode.
Figure 4B:
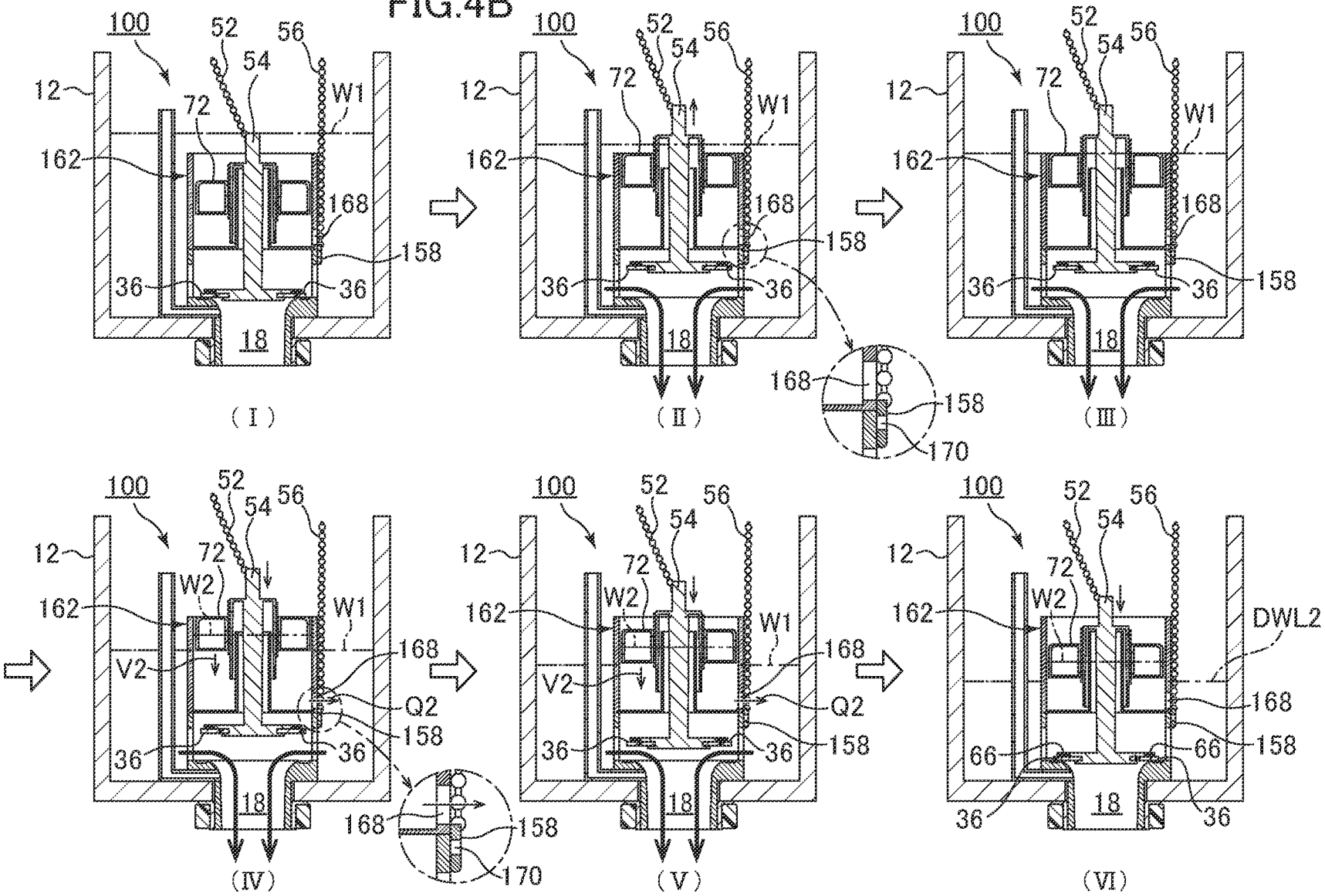
FIG. 4B is a schematic diagram showing a configuration of the discharge valve device according to the second embodiment of the present invention and a series of operations from the standby state until the valve is started to open and closed by the small flushing mode.

First, as shown in FIGS. 4A and 4B, in the discharge valve device 100 according to the second embodiment of the present invention, a water storage cylinder 162 includes a single outlet port 168 in one of left and right side walls 162*a*. Also, in the outlet port 168 of the water storage cylinder 162, a partition (switching valve 158) for switching large or small flushing is openably and closably provided. The switching valve 158 can slide in a vertical direction depending on a second bead chain 56 moving up and down, to open and close the outlet port 168. Further, in the discharge valve device 100 of the present embodiment, the switching valve 158 includes a communication hole 170 that can communicate between inside of the water storage cylinder 162 and inside of a storage tank 12 in a state where the outlet port 168 is closed. The communication hole 170 has an opening sectional area set smaller than the outlet port 168. Furthermore, in the discharge valve device 100 of the present embodiment, even if the outlet port 168 of the water storage cylinder 162 is closed by the switching valve 158, the communication hole 170 can normally communicate between the inside of the water storage cylinder 162 and the inside of the storage tank 12, and these structures are different from the structure of the discharge valve device 1 according to the first embodiment of the present invention described above.

Next, with reference to FIGS. 4A and 4B, an operation of the discharge valve device 100 according to the second embodiment of the present invention will be described. First, in a standby state shown in state (I) of FIGS. 4A and 4B, the switching valve 158 opens the outlet port 168 of the water storage cylinder 162. Then, when a large flushing mode is started from the standby state shown in the state (I) of FIG. 4A, in state (II) of FIG. 4A, an actuation shaft 54 and a valve body 36 are pulled upward by a first bead chain 52. At this time, the switching valve 158 is also pulled upward by the second bead chain 56 to slide upward, and the outlet port 168 of the water storage cylinder 162 is closed by the switching valve 158 (see state (II) of FIG. 4A).

The state where the outlet port 168 of the water storage cylinder 162 is closed by the switching valve 158 is maintained from subsequent state (III) of FIG. 4A to state (VI) of FIG. 4A in which the valve body 36 is closed and the large flushing mode ends. However, as shown in the states (II) to (VI) of FIG. 4A, even if the outlet port 168 of the water storage cylinder 162 is closed by the switching valve 158, the communication hole 170 normally communicates between the inside of the water storage cylinder 162 and the inside of the storage tank 12. Then, as shown in the states (IV) to (VI) of FIG. 4A, when a water level W1 in the storage tank 12 outside the water storage cylinder 162 becomes lower than a water level W2 in the water storage cylinder 162, a water pressure in the water storage cylinder 162 is higher than a water pressure in the storage tank 12. Therefore, even in a state where the outlet port 168 of the water storage cylinder 162 is closed by the switching valve 158, the flush water in the water storage cylinder 162 can flow out from the communication hole 170 into the storage tank 12 due to a difference in pressure between the inside of the water storage cylinder 162 and the inside of the storage tank 12 outside the cylinder.

On one hand, when a small flushing mode is started from the standby state shown in the state (I) of FIG. 4B, in the state (II) of FIG. 4B, the actuation shaft 54 and the valve body 36 are pulled upward by the first bead chain 52. On the other hand, the switching valve 158 is not pulled upward by the second bead chain 56 and does not slide upward, and hence the outlet port 168 of the water storage cylinder 162 is opened by the switching valve 158 (see state (II) of FIG. 4B). Then, a state where the outlet port 168 of the water storage cylinder 162 is normally opened by the switching valve 158 is maintained from the standby state (I) of FIG. 4B to state (VI) of FIG. 4B where the small flushing mode is finished. Additionally, in the state (VI) of FIG. 4B where the small flushing mode is finished, a minimum water level DWL2 in the storage tank 12 during the small flushing mode is located above the minimum water level DWL1 in the storage tank 12 during the large flushing mode in the state (VI) of FIG. 4A.

According to the discharge valve device 100 of the second embodiment of the present invention described above, in the large flushing mode shown in FIG. 4A, as the switching valve 158 for switching large or small flushing closes the single outlet port 168 of the water storage cylinder 162, the flush water in the water storage cylinder 162 can flow out into the storage tank 12 from the communication hole 170 of the switching valve 158 that has an opening sectional area smaller than the outlet port 168. On the other hand, in the small flushing mode shown in FIG. 4B, the switching valve 158 normally opens the outlet port 168, and hence the flush water in the water storage cylinder 162 can flow out from the whole outlet port 168 into the storage tank 12. Accordingly, a flush water amount Q2 per unit time [L/min] of the flush water in the water storage cylinder 162 flowing out from the whole outlet port 168 to the storage tank 12 in the small flushing mode (so-called "water drainage speed Q2") becomes larger than a flush water amount Q1 per unit time [L/min] of the flush water in the water storage cylinder 162 flowing out from the communication hole 170 of the switching valve 158 to the storage tank 12 in the large flushing mode (so-called "water drainage speed Q1") (Q2>Q1). Therefore, a lowering speed v2 of a float 72 during the small flushing mode can be larger than a lowering speed v1 of the float 72 during the large flushing mode. Consequently, a valve opening time of the valve body 36 during the small flushing mode can be shorter than a valve opening time of the valve body 36 during the large flushing mode. As a result, the lowering speed of the float 72 with the decrease in water level in the water storage cylinder 162 can be changed by changing the flush water amount Q1, Q2 per unit time [L/min] of the flush water in the water storage cylinder 162 flowing out from the outlet port 168 to the storage tank 12 (so-called "water drainage speed Q1, Q2") depending on the selected large flushing mode or small flushing mode. Therefore, an instantaneous flow rate of flush water [L/min] that affects flushing performance can be maintained comparatively high even in the small flushing mode in which the flush water amount is smaller than in the large flushing mode. Further, the closing sound generated when the valve body 36 closes the discharge opening 18 can be reduced.

Next, with reference to FIGS. 1, 5A and 5B, a discharge valve device 200 according to a third embodiment of the present invention will be described. Here, in the discharge valve device 200 according to the third embodiment of the present invention shown in FIGS. 5A and 5B, the same part as in the discharge valve devices 1 and 100 according to the first and second embodiments of the present invention described above is denoted with the same sign and is not described.

Figure 5A:
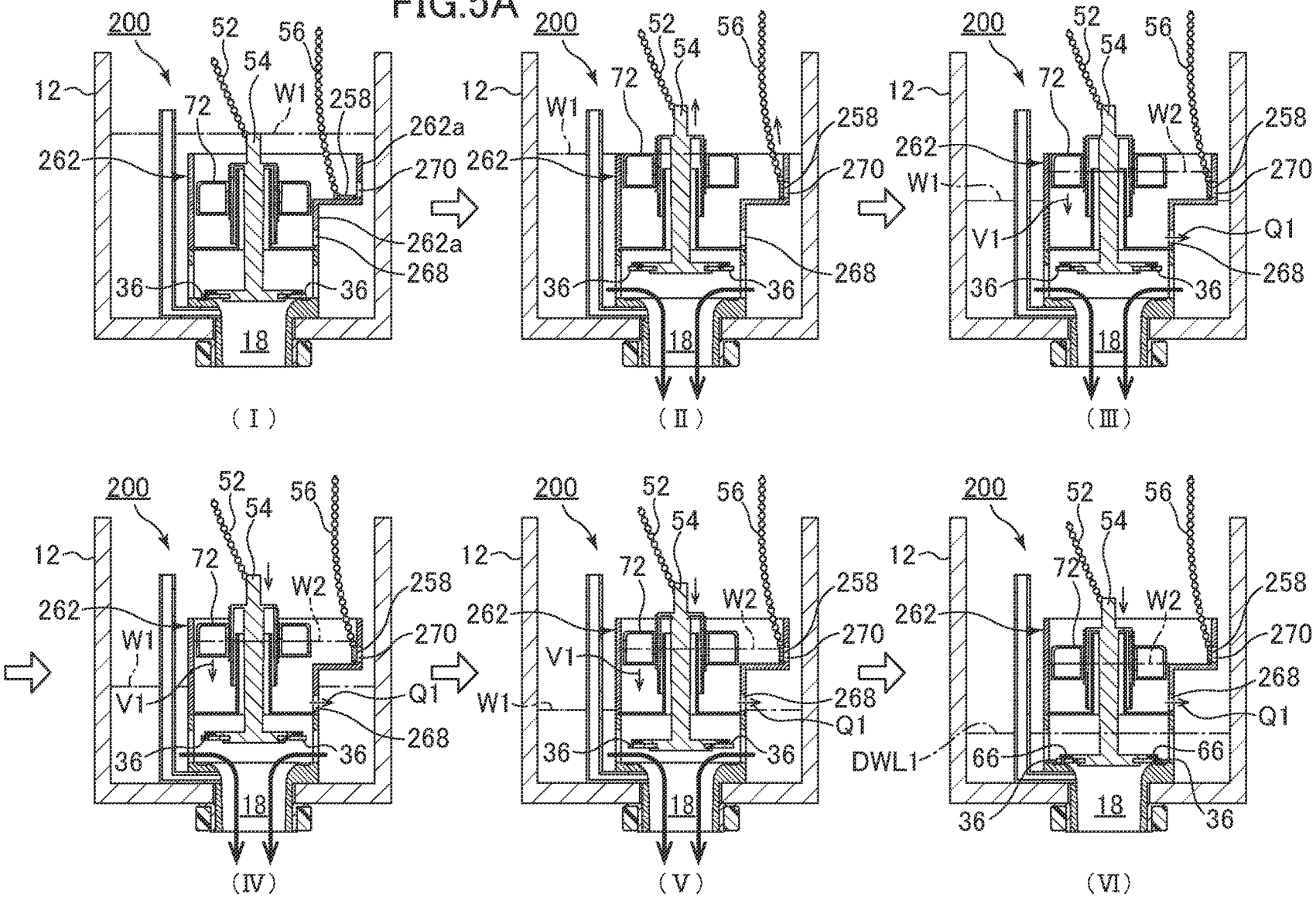
FIG. 5A is a schematic diagram showing a configuration of a discharge valve device according to the third embodiment of the present invention and a series of operations from a standby state until a valve is started to open and closed by the large flushing mode.
Figure 5B:
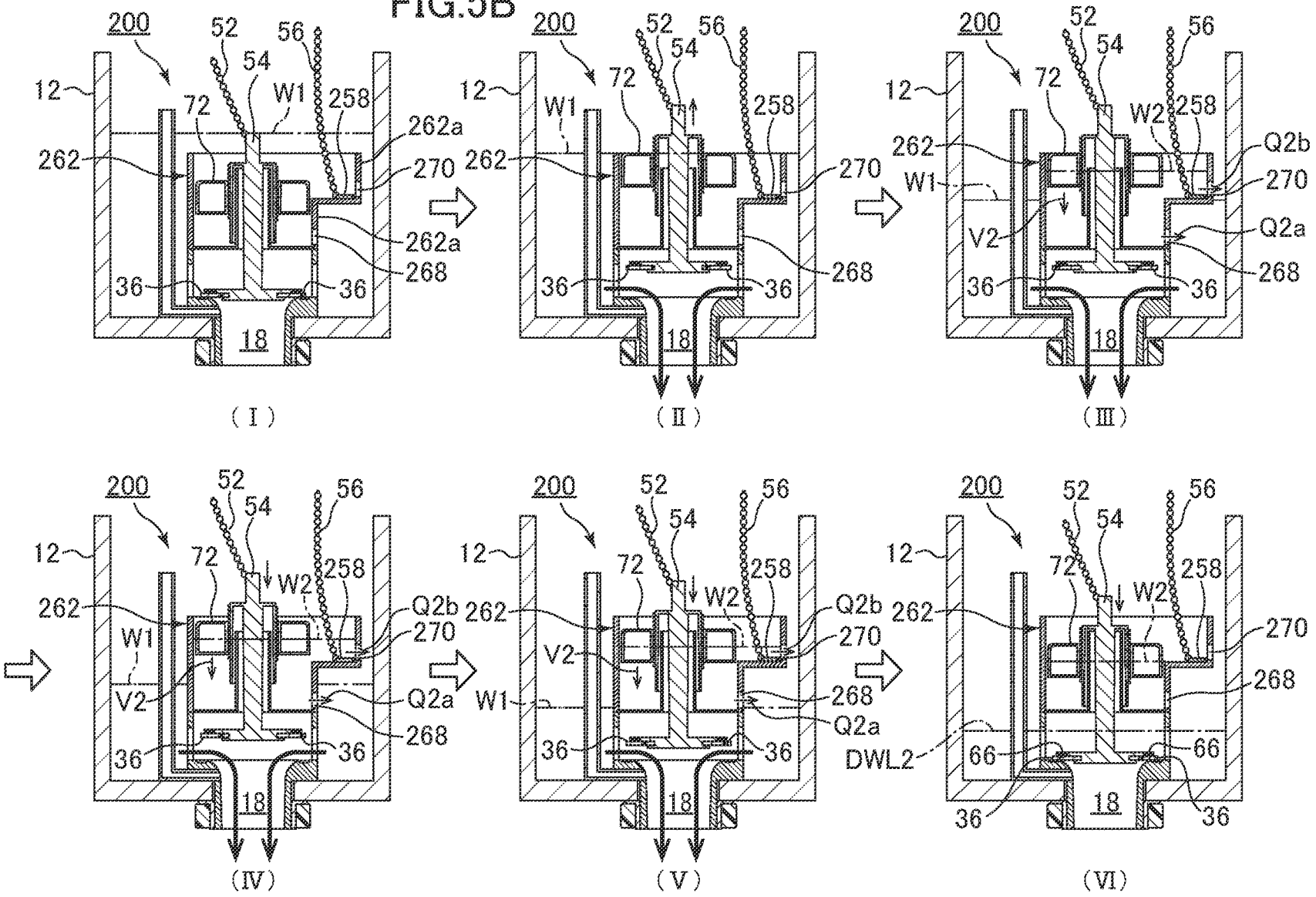
FIG. 5B is a schematic diagram showing a configuration of the discharge valve device according to the third embodiment of the present invention and a series of operations from the standby state until the valve is started to open and closed by the small flushing mode.

First, as shown in FIGS. 5A and 5B, in the discharge valve device 200 according to the third embodiment of the present invention, a water storage cylinder 262 includes a first outlet port 268 disposed below and a second outlet port 270 disposed above the first outlet port 268 in one of left and right side walls 262*a*. Further, in the second outlet port 270 of the water storage cylinder 262, a partition (switching valve 258) for switching large or small flushing is openably and closably provided. As the switching valve 258 rotates from a horizontal posture to a vertical posture depending on a second bead chain 56 moving up and down, the second outlet port 270 can be opened and closed. Accordingly, in a large flushing mode shown in FIG. 5A, the second outlet port 270 of the water storage cylinder 262 is closed by the switching valve 258, and hence the flush water in the water storage cylinder 262 flows out only from the lower first outlet port 268 to a storage tank 12. On the other hand, in the small flushing mode shown in FIG. 5B, since the second outlet port 270 of the water storage cylinder 262 is opened by the switching valve 258, the flush water in the water storage cylinder 262 flows out from both the first outlet port 268 and the second outlet port 270 to the storage tank 12. Further, when a valve body 36 is opened, the water storage cylinder 262 is configured to increase a total opening area S2 of the first outlet port 268 and the second outlet port 270 during a small flushing mode as compared to a total opening area 51 only of the first outlet port 268 during the large flushing mode. Accordingly, a flush water amount Q2 per unit time [L/min] of the flush water in the water storage cylinder 262 flowing out from the first outlet port 268 and the second outlet port 270 to the storage tank 12 during the small flushing mode (so-called "water drainage speed Q2") is set larger than a flush water amount Q1 per unit time [L/min] of the flush water in the water storage cylinder 262 flowing out only from the first outlet port 268 to the storage tank 12 during the large flushing mode (so-called "water drainage speed Q1") (Q2>Q1).

Next, with reference to FIGS. 5A and 5B, an operation of the discharge valve device 200 according to the third embodiment of the present invention will be described. First, in a standby state shown in state (I) of FIGS. 5A and 5B, the switching valve 258 is in the horizontal posture and the second outlet port 270 of the water storage cylinder 262 is open. Then, when the large flushing mode is started from the standby state shown in the state (I) of FIG. 5A, in state (II) of FIG. 5A, an actuation shaft 54 and the valve body 36 are pulled upward by a first bead chain 52. At this time, the switching valve 258 is pulled upward by the second bead chain 56 and rotated from the horizontal posture to the vertical posture, and the outlet port 268 of the water storage cylinder 262 is closed by the switching valve 258 (see state (II) of FIG. 5A). The state where the outlet port 268 of the water storage cylinder 262 is closed by the switching valve 258 is maintained from the subsequent state (III) of FIG. 5A to state (VI) of FIG. 5A where the valve body 36 is closed and the large flushing mode ends. However, as shown in states (II) to (VI) of FIG. 5A, even if the second outlet port 270 of the water storage cylinder 262 is closed by the switching valve 258, the first outlet port 268 is normally open to normally communicate between the inside of the water storage cylinder 262 and the inside of the storage tank 12. Then, as shown in the states (III) to (VI) of FIG. 5A, when a water level W1 in the storage tank 12 outside the water storage cylinder 262 is lower than a water level W2 in the water storage cylinder 262, a water pressure in the water storage cylinder 262 is higher than a water pressure in the storage tank 12. Therefore, even in the state where the second outlet port 270 of the water storage cylinder 262 is closed by the switching valve 258, the flush water in the water storage cylinder 262 can flow out from the first outlet port 268 into the storage tank 12 due to a difference in pressure between the inside of the water storage cylinder 262 and the inside of the storage tank 12 outside the cylinder.

On one hand, when the small flushing mode is started from the standby state shown in the state (I) of FIG. 5B, in the state (II) of FIG. 5B, the actuation shaft 54 and the valve body 36 are pulled upward by the first bead chain 52. On the other hand, since the switching valve 258 is not pulled upward by the second bead chain 56 and does not rotate from the horizontal posture to the vertical posture, the second outlet port 270 of the water storage cylinder 262 is opened by the switching valve 258 (see state (II) of FIG. 5B). Then, a state where the second outlet port 270 of the water storage cylinder 262 is normally opened by the switching valve 258 is maintained from the standby state (I) of FIG. 5B to the state (VI) of FIG. 5B where the small flushing mode ends.

Next, in the state during the small flushing mode shown in the state (III) to (V) of FIG. 5B, the water level W1 in the storage tank 12 is lower than the water level W2 in the water storage cylinder 262, and the water level W2 in the water storage cylinder 262 is located above a lower end of the second outlet port 270. Therefore, the flush water in the water storage cylinder 262 flows out from the first outlet port 268 in a flush water amount Q2*a* per unit time [L/min] (so-called "water drainage speed Q2*a*") and flows out from the second outlet port 270 in a flush water amount Q2*b* per unit time [L/min] (so-called "water drainage speed Q2*b*"). At this time, in a state where the water level W1 in the storage tank 12 is lower than the second outlet port 270, the second outlet port 270 is open to the atmosphere, and hence the water drainage speed Q2*b* in the second outlet port 270 is equal to or larger than the water drainage speed Q2*a* in the first outlet port 268 (Q2*b* Q2*a*). As shown in the state (VI) of FIG. 5B, in a state where the small flushing mode is finished, a minimum water level DWL2 in the storage tank 12 during the small flushing mode is located above a minimum water level DWL1 in the storage tank 12 during the large flushing mode in the state (VI) of FIG. 5A.

According to the discharge valve device 200 of the third embodiment of the present invention described above, a total opening area S2 of the first outlet port 268 and the second outlet port 270 of the water storage cylinder 262 during the small flushing mode is configured to increase as compared to a total opening area S1 only of the first outlet port 268 of the water storage cylinder 262 during the large flushing mode, and the second outlet port 270 is disposed above the first outlet port 268. Accordingly, when the valve body 36 is opened during the large flushing mode shown in FIG. 5A, the flush water in the water storage cylinder 262 flows out only from the first outlet port 268 to the storage tank 12, whereas when the valve body 36 is opened during the small flushing mode shown in FIG. 5B, the flush water in the water storage cylinder 262 flows out from both the first outlet port 268 and the second outlet port 270 to the storage tank 12. Further, a second flush water amount Q2 per unit time [L/min] of the flush water in the water storage cylinder 262 flowing out from both the first outlet port 268 and the second outlet port 270 to the storage tank 12 in the small flushing mode (so-called "second water drainage speed Q2") can be increased as compared to a first flush water amount Q1 per unit time [L/min] of the flush water in the water storage cylinder 262 flowing out only from the first outlet port 268 to the storage tank 12 in the large flushing mode (so-called "first water drainage speed Q1"). Therefore, a lowering speed v2 of a float 72 during the small flushing mode can be larger than a lowering speed v1 of the float 72 during the large flushing mode, and hence a lowering time of the float 72 and a valve opening time of the valve body 36 during the small flushing mode can be shorter than a lowering time of the float 72 and a valve opening time of the valve body 36 during the large flushing mode. As a result, the lowering speed v1, v2 of the float 72 with the decrease in water level in the water storage cylinder 262 can be changed by changing the flush water amount Q1, Q2 per unit time [L/min] of the flush water in the water storage cylinder 262 flowing out from the outlet port 268, 270 to the storage tank 12 (so-called "water drainage speed Q1, Q2") depending on the selected large flushing mode or small flushing mode. Therefore, an instantaneous flow rate of flush water [L/min] that affects the flushing performance can be maintained comparatively high even in the small flushing mode in which the flush water amount is smaller than in the large flushing mode. Further, closing sound generated when the valve body 36 closes a discharge opening 18 can be reduced.

Next, with reference to FIGS. 1, 6A and 6B, a discharge valve device 300 according to a fourth embodiment of the present invention will be described. Here, in the discharge valve device 300 according to the fourth embodiment of the present invention shown in FIGS. 6A and 6B, the same part as in the discharge valve devices 1, 100 and 200 according to the first to third embodiments of the present invention described above is denoted with the same sign and is not described.

Figure 6A:
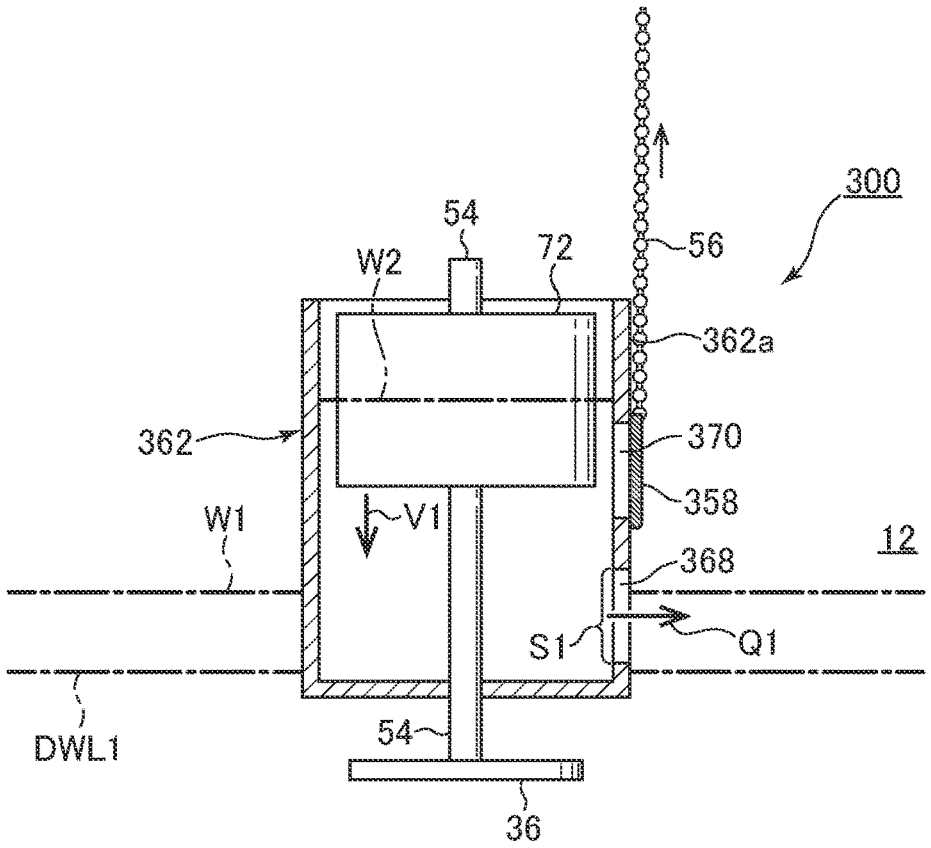
FIG. 6A is a conceptual diagram of a configuration of a discharge valve device according to the fourth embodiment of the present invention and a state where a float is lowered after a valve is started to open by the large flushing mode.
Figure 6B:
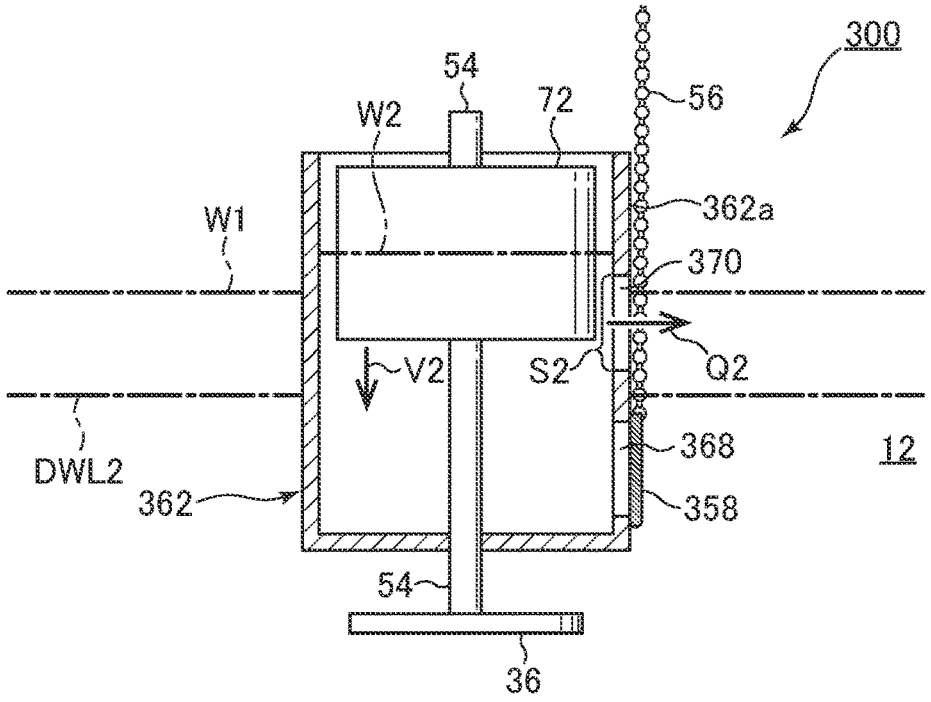
FIG. 6B is a conceptual diagram of the configuration of the discharge valve device according to the fourth embodiment of the present invention and a state where the float is lowered after the valve is started to open by the small flushing mode.

First, as shown in FIGS. 6A and 6B, in the discharge valve device 300 according to the fourth embodiment of the present invention, a water storage cylinder 362 includes a first outlet port 368 disposed below, and a second outlet port 370 disposed above the first outlet port 368 in one of left and right side walls 362*a*. Further, a partition (switching valve 358) for switching large or small flushing is provided to be openable and closable with respect to each of the first outlet port 368 and the second outlet port 370 of the water storage cylinder 362. The switching valve 358 can slide in a vertical direction with a second bead chain 56 moving up and down depending on large and small flushing modes. That is, during the large flushing mode shown in FIG. 6A, as the switching valve 358 is pulled up by the second bead chain 56 and slides upward, the first outlet port 368 is opened by the switching valve 358, and the second outlet port 370 is closed by the switching valve 358. On the other hand, during the small flushing mode shown in FIG. 6B, the switching valve 358 is not pulled up by the second bead chain 56, so that the first outlet port 368 is closed by the switching valve 358, and the second outlet port 370 is opened by the switching valve 358.

Furthermore, a total opening area S1 of the first outlet port 368 opened by the switching valve 358 during the large flushing mode is the same as a total opening area S2 of the second outlet port 370 opened by the switching valve 358 during the small flushing mode (S1=S2). Then, in the discharge valve device 300 of the present embodiment, in the same manner as in the discharge valve devices 1, 100 and 200 according to the first to third embodiments of the present invention described above, when the large flushing mode is started, a water level W1 in a storage tank 12 outside the water storage cylinder 362 decreases to below a water level W2 in the water storage cylinder 362. Thereafter, when the water level W1 in the storage tank 12 lowers to below an upper end position of the first outlet port 368, a first flush water amount Q1 per unit time [L/min] of the flush water in the water storage cylinder 362 flowing out from the first outlet port 368 into the storage tank 12 (so-called "water drainage speed Q1") is accelerated. On the other hand, when the small flushing mode is started, the water level W1 in the storage tank 12 outside the water storage cylinder 362 decreases to below a water level W2 in the water storage cylinder 362. Thereafter, when the water level W1 in the storage tank 12 decreases to below an upper end position of the second outlet port 370, a second flush water amount Q2 per unit time [L/min] of the flush water in the water storage cylinder 362 flowing out from the second outlet port 370 into the storage tank 12 (so-called "water drainage speed Q2") is accelerated. These settings are such that the second flush water amount Q2 per unit time [L/min] of the flush water in the water storage cylinder 362 flowing out from the second outlet port 370 to the storage tank 12 in the small flushing mode (so-called "water drainage speed Q2") increases as compared to the first flush water amount Q1 per unit time [L/min] of the flush water in the water storage cylinder 362 flowing out from the first outlet port 368 to the storage tank 12 in the large flushing mode (so-called "water drainage speed Q1") (Q1<Q2).

According to the discharge valve device 300 of the fourth embodiment of the present invention described above, when the valve body 36 is opened during the large flushing mode, the flush water in the water storage cylinder 362 flows out from the first outlet port 368 to the storage tank 12. On the other hand, when the valve body 36 is opened during the small flushing mode, the flush water in the water storage cylinder 362 flows out from the second outlet port 370 to the storage tank 12. At this time, even if the total opening areas S1 and S2 of the first outlet port 368 and the second outlet port 370 are the same as each other, the second outlet port 370 is disposed above the first outlet port 368, and hence as compared to the first water amount Q1 per unit time [L/min] of the flush water in the water storage cylinder 362 flowing out from the first outlet port 368 to the storage tank 12 in the large flushing mode (so-called "first water drainage speed Q1"), the second flush water amount Q2 per unit time [L/min] of the flush water in the water storage cylinder 362 flowing out from the second outlet port 370 to the flush water tank in the small flushing mode (so-called "second water drainage rate speed") can be increased. Therefore, a lowering speed v2 of a float 72 during the small flushing mode can be larger than a lowering speed v1 of the float 72 during the large flushing mode, and hence a lowering time of the float 72 and a valve opening time of the valve body 36 during the small flushing mode can be shorter than a lowering time of the float 72 and a valve opening time of the valve body 36 during the large flushing mode. As a result, the lowering speed v1, v2 of the float 72 with the decrease in water level in the water storage cylinder 362 can be changed by changing the flush water amount Q1, Q2 per unit time [L/min] of the flush water in the water storage cylinder 362 flowing out from the outlet port 368 or 370 to the storage tank 12 (so-called "water drainage speed Q1, Q2") depending on the selected large flushing mode or small flushing mode. Therefore, an instantaneous flow rate of flush water [L/min] that affects flushing performance can be maintained comparatively high even in the small flushing mode in which the flush water amount is smaller than in the large flushing mode. Further, closing sound generated when the valve body 36 closes a discharge opening 18 can be reduced.

In the discharge valve devices 1, 100, 200 and 300 according to the first to fourth embodiments of the present invention described above, as means for changing the lowering speed v1, v2 of the float 72 with the decrease in water level in the water storage cylinder 62, 162, 262 or 362 depending on the selected large flushing mode or small flushing mode, some forms of changing the flush water amount Q1, Q2 per unit time [L/min] of the flush water in each water storage cylinder 62, 162, 262 or 362 flowing out from each outlet port 68, 70, 168, 170, 268, 270, 368 or 370 to the storage tank 12 (so-called "water drainage speed Q1, Q2") have been described, but are not limited to these examples, and a form other than the forms of changing the so-called "water drainage speed" is also applicable. For example, as the other form, a total outflow amount [L] (so-called "water drainage amount") of the flush water in the water storage cylinder flowing out from the outlet port to the storage tank may be changed depending on the selected large flushing mode or small flushing mode. Alternatively, as yet another form, buoyancy that acts on the float may be changed with the flush water in the storage tank or in the water storage cylinder depending on the selected large flushing mode or small flushing mode.

Next, with reference to FIGS. 1 and 7 to 11B, a discharge valve device 400 according to a fifth embodiment of the present invention will be described. Here, in the discharge valve device 400 according to the fifth embodiment of the present invention shown in FIGS. 7 to 11B, the same part as in the discharge valve devices 1, 100, 200 and 300 according to the first to fourth embodiments of the present invention described above is denoted with the same sign and is not described. Further, in states (I) to (VI) of the discharge valve device 400 in each of a large flushing mode and a small flushing mode shown in FIGS. 11A and 11B, a state (standby state) before valve opening of a valve body 36 is started is shown in state (I), and thereafter, in time series, a valve opened state of the valve body 36 is shown in states (II) to (V), and a valve closed state of the valve body 36 is shown in state (VI).

First, as shown in FIGS. 7 to 10, a water storage cylinder 462 of the discharge valve device 400 of the present embodiment includes a water storage cylinder body 468, and a small tank 470 that is communicatively connected to the water storage cylinder body 468. Each of the water storage cylinder body 468 and the small tank 470 stores part of the flush water in a storage tank 12. Further, in a side wall 468*a* of the water storage cylinder body 468, an outlet port 472 that causes the flush water in the water storage cylinder body 468 to flow outside (into the storage tank 12) is provided. The outlet port 472 is normally open, and normally communicates between inside of the water storage cylinder body 468 and inside of the storage tank 12 outside the cylinder body. Further, a float 474 is disposed in the water storage cylinder body 468. The float 474 is concentrically provided on an outer peripheral side of an actuation shaft 54 and moves (moves up and down) in conjunction with a water level in the water storage cylinder body 468, so that buoyancy obtained by the flush water in the water storage cylinder body 468 can act on the actuation shaft 54.

Next, as shown in FIGS. 7 to 11B, a connecting portion of the small tank 470 connected to the side wall 468*a* of the water storage cylinder body 468 is provided with a communication opening 476 that can communicate with the water storage cylinder body 468. Further, in the communication opening 476, a partition (switching valve 458) for switching large or small flushing is openably and closably provided. For the partition (switching valve 458) for switching large or small flushing, as shown in FIGS. 7 to 11A, when toilet flushing by the large flushing mode is executed, a second bead chain 56 loosens without being pulled up by a second swing lever 50, and the partition is rotated in a direction C1 to open the communication opening 476 and can open the communication opening 476. Accordingly, during the large flushing mode, the water storage cylinder body 468 and the small tank 470 communicate with each other via the opened communication opening 476. On the other hand, for the partition (switching valve 458) for switching large or small flushing, as shown in FIGS. 7 to 10 and 11B, when toilet flushing by the small flushing mode is executed, the second bead chain 56 is pulled up by the second swing lever 50, the partition is rotated in a direction C2 to close the communication opening 476, and the communication opening 476 can be closed. Accordingly, during the small flushing mode, the water storage cylinder body 468 and the small tank 470 are separated from each other by the switching valve 458 that closes the communication opening 476.

Figure 8:
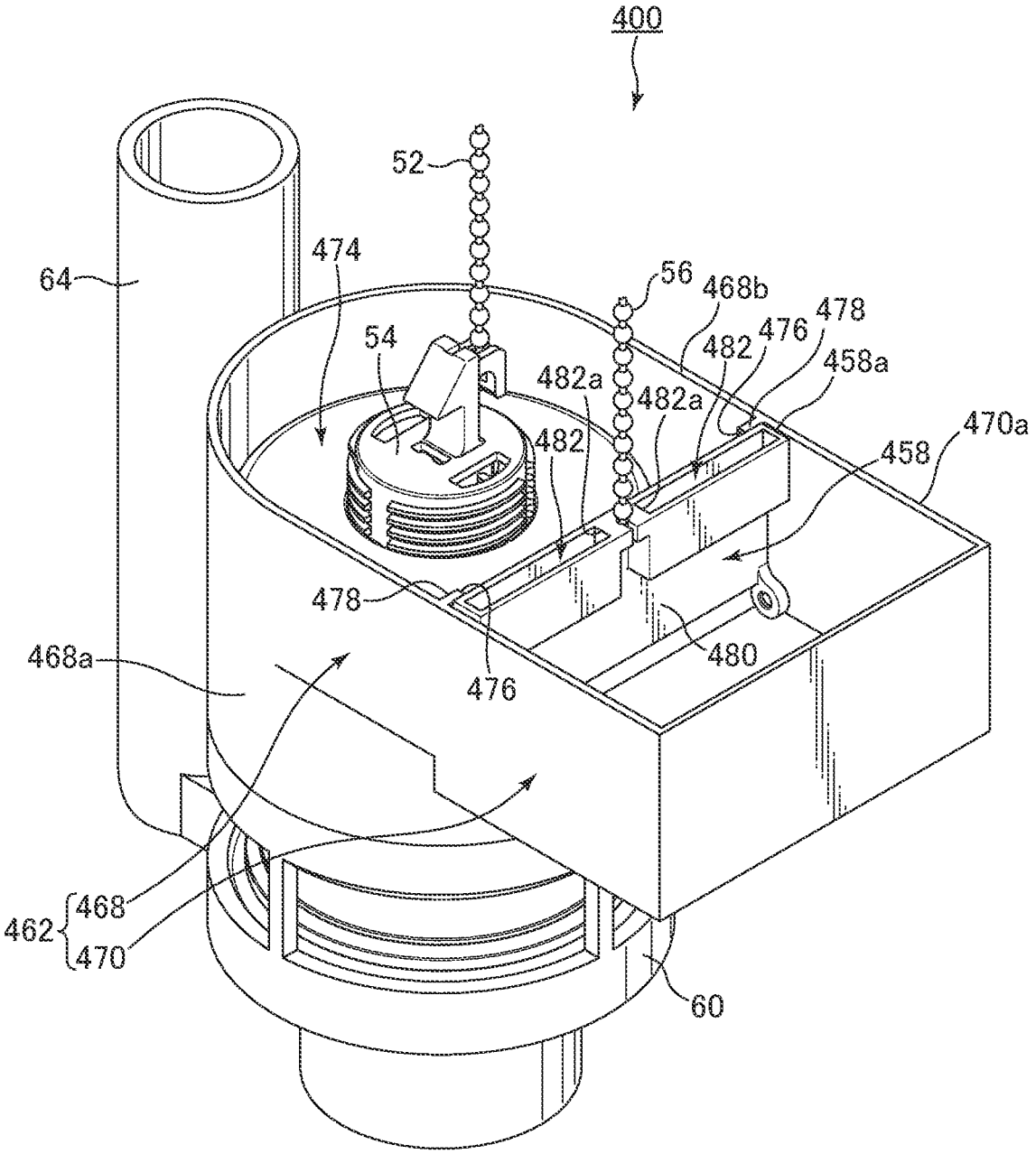
FIG. 8 is a perspective view of the discharge valve device according to the fifth embodiment of the present invention as seen from diagonally above.
Figure 9:
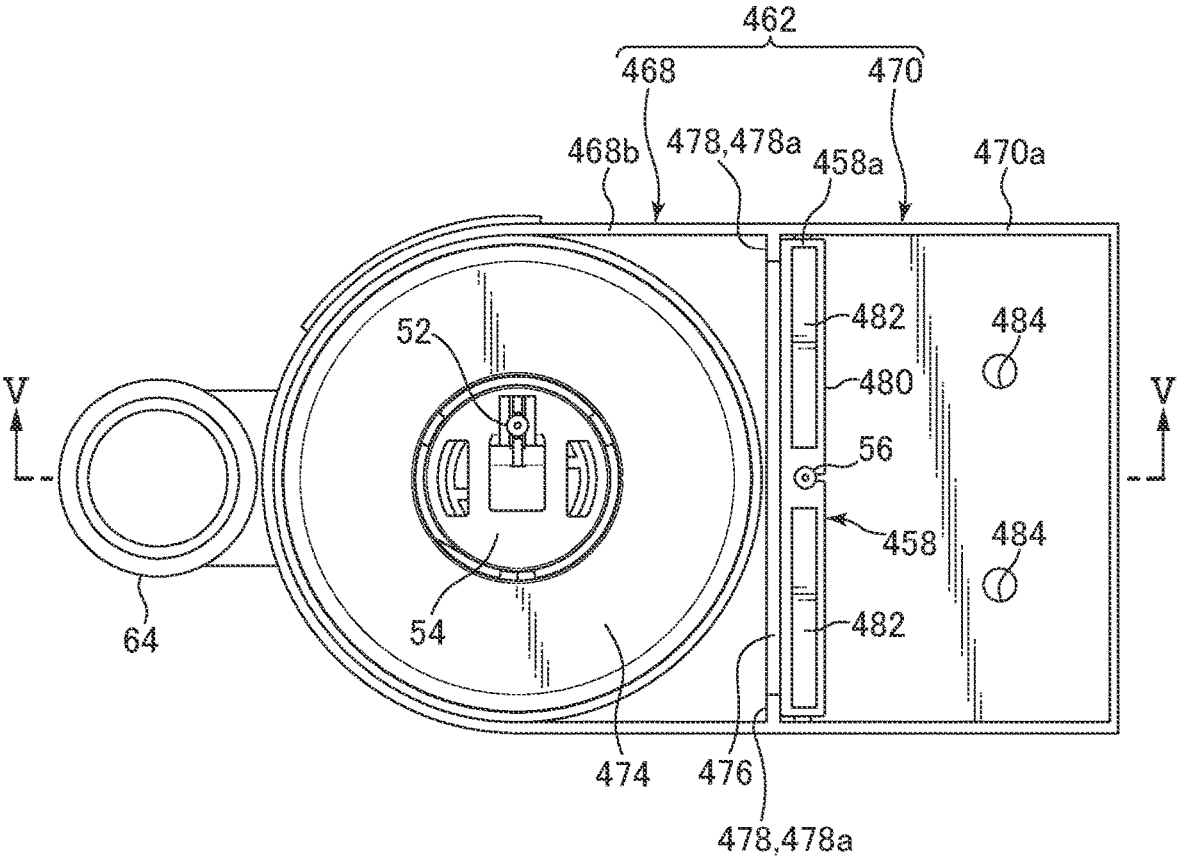
FIG. 9 is a top view of the discharge valve device according to the fifth embodiment of the present invention.
Figure 10:
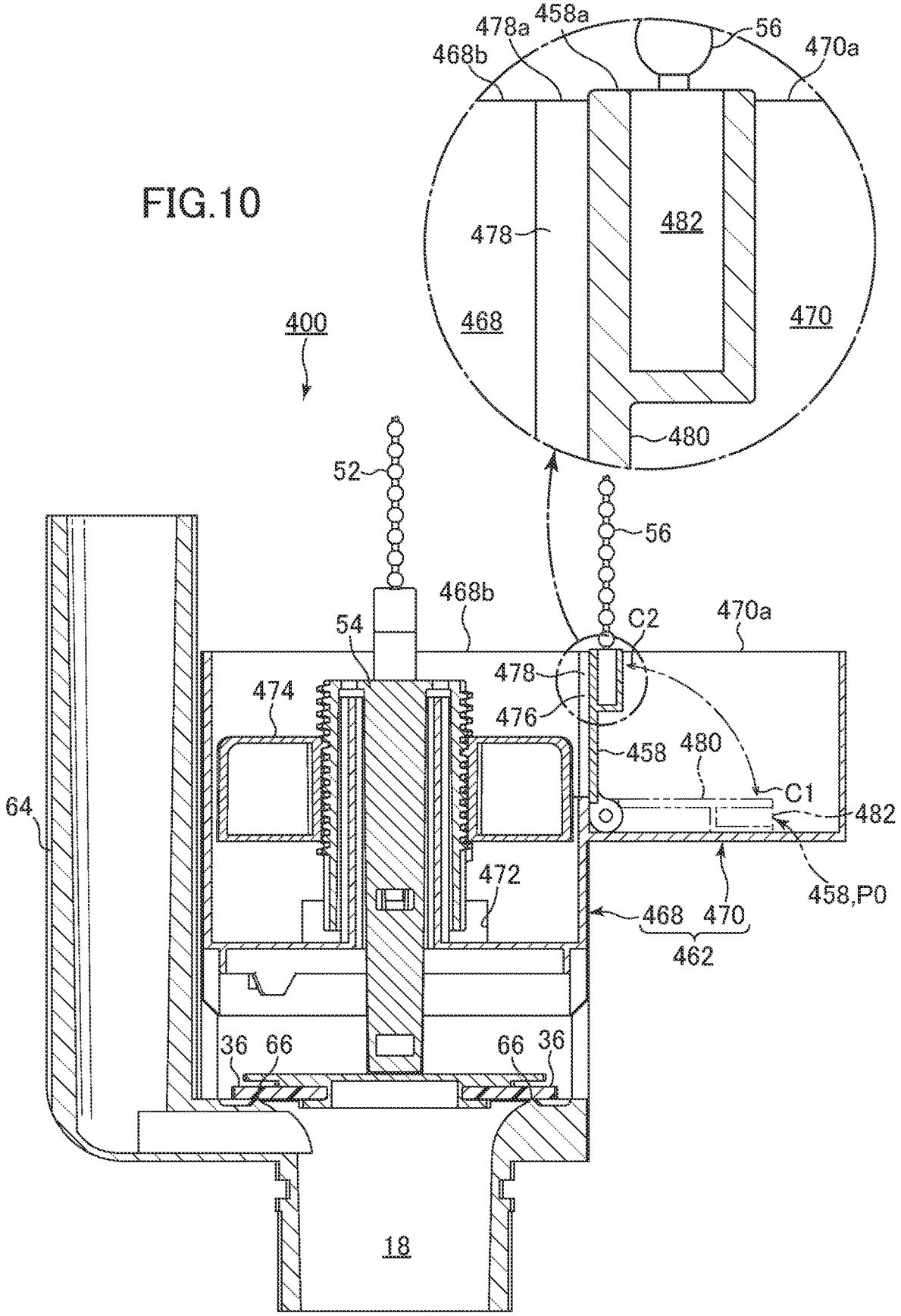
FIG. 10 is a cross-sectional view along the X-X-line of FIG. 9.

Next, as shown in FIGS. 8 to 10, a locking portion 478 that rotatably supports the switching valve 458 is provided on both left and right sides of a rim and a lower end side in the communication opening 476. The locking portion 478 rotates in the direction C2 in which the switching valve 458 closes the communication opening 476 in the small flushing mode and contacts the locking portion 478, and rotation of the switching valve 458 is restricted by the locking portion 478.

Next, as shown in FIGS. 8 to 10, the switching valve 458 includes a valve body portion 480 and a water weight portion 482. First, for the valve body portion 480 of the switching valve 458, in a state where the communication opening 476 is closed by the switching valve 458, a pulling-up force by the second swing lever 50 and the second bead chain 56 and a water pressure of the flush water in the small tank 470 bring the whole valve body portion 480 into a standing posture extending in a vertical direction, and left, right and lower peripheral edge portions of the valve body portion 480 contact the locking portion 478. Further, a plurality of (two) water weight portions 482 of the switching valve 458 are provided on an upper side of the valve body portion 480 with the standing posture and on the small tank 470 side. Each of these water weight portions 482 can store flush water in the water weight portion 482 in a state where the valve body portion 480 is in the standing posture.

Further, as shown in FIG. 9, a pair of left and right auxiliary outlet ports 484 that allow the flush water in the small tank 470 to flow out are provided in a bottom surface of the small tank 470. Further, in the state of the standing posture where the valve body portion 480 abuts on the locking portion 478, the water weight portion 482 can store flush water, and at this time, each of the auxiliary outlet ports 484 of the small tank 470 is opened by the valve body portion 480. Furthermore, when the flush water in the small tank 470 flows out from each auxiliary outlet port 484, the water pressure in the small tank 470 that presses the valve body portion 480 in a valve closing direction decreases, and hence the valve body portion 480 rotates in a direction apart from the locking portion 478 (valve opening direction). Accordingly, the valve body portion 480 and the water weight portion 482 are easily rotated from the standing posture to a falling posture due to an own weight of the water weight portion 482. Then, when the water weight portion 482 tilts, the valve body portion 480 and the water weight portion 482 (signs 480 and 482 shown with a virtual line in FIG. 10) shift to the falling posture (horizontal posture) while the flush water in the water weight portion 482 flows out. Further, when the valve body portion 480 and the water weight portion 482 are in a state of the falling posture (horizontal posture), each auxiliary outlet port 484 is closed by a lower surface of the water weight portion 482 with the falling posture.

Figure 11A:
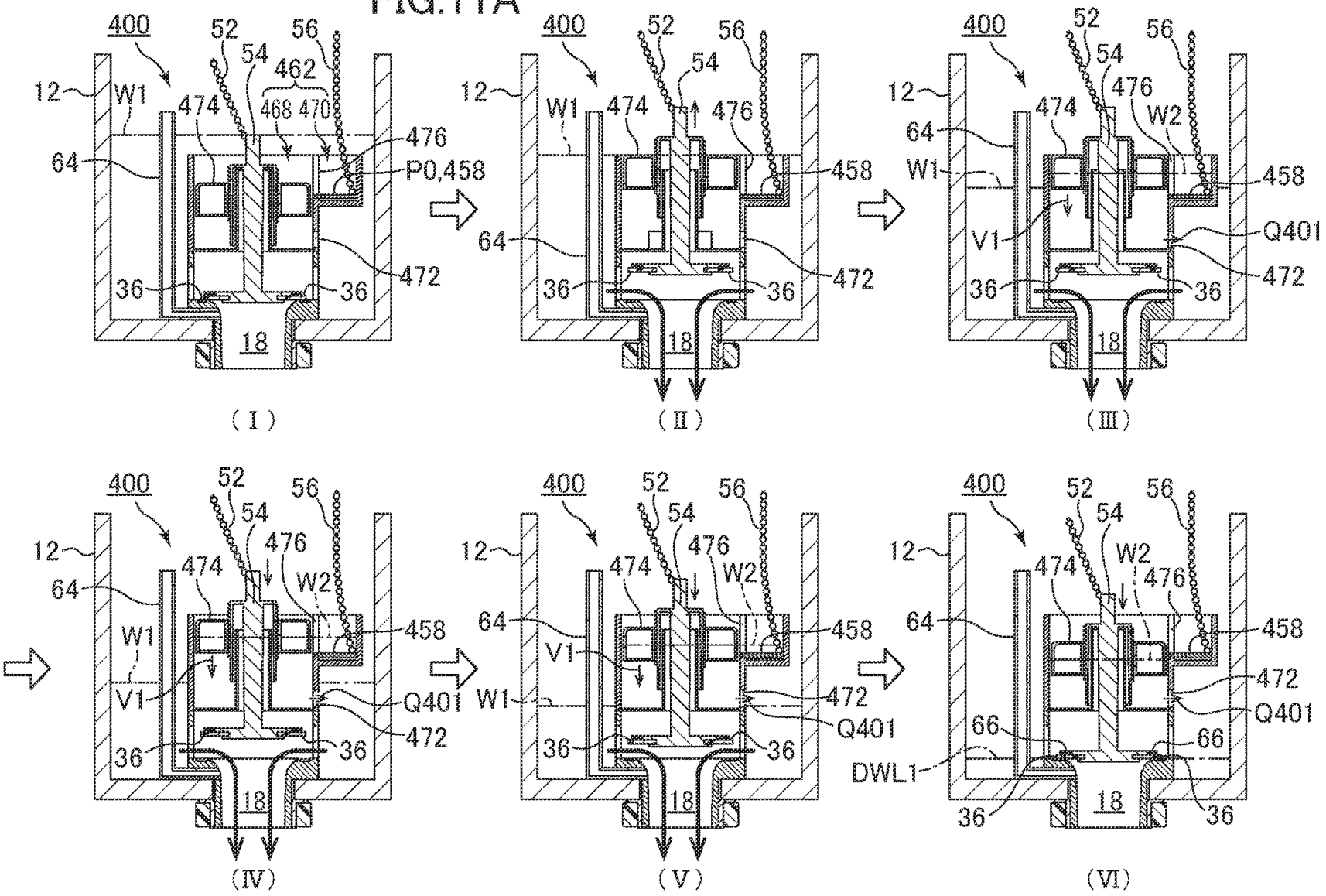
FIG. 11A is a schematic diagram showing a configuration of the discharge valve device according to the fifth embodiment of the present invention and a series of operations from a standby state until a valve is started to open and closed by the large flushing mode.
Figure 11B:
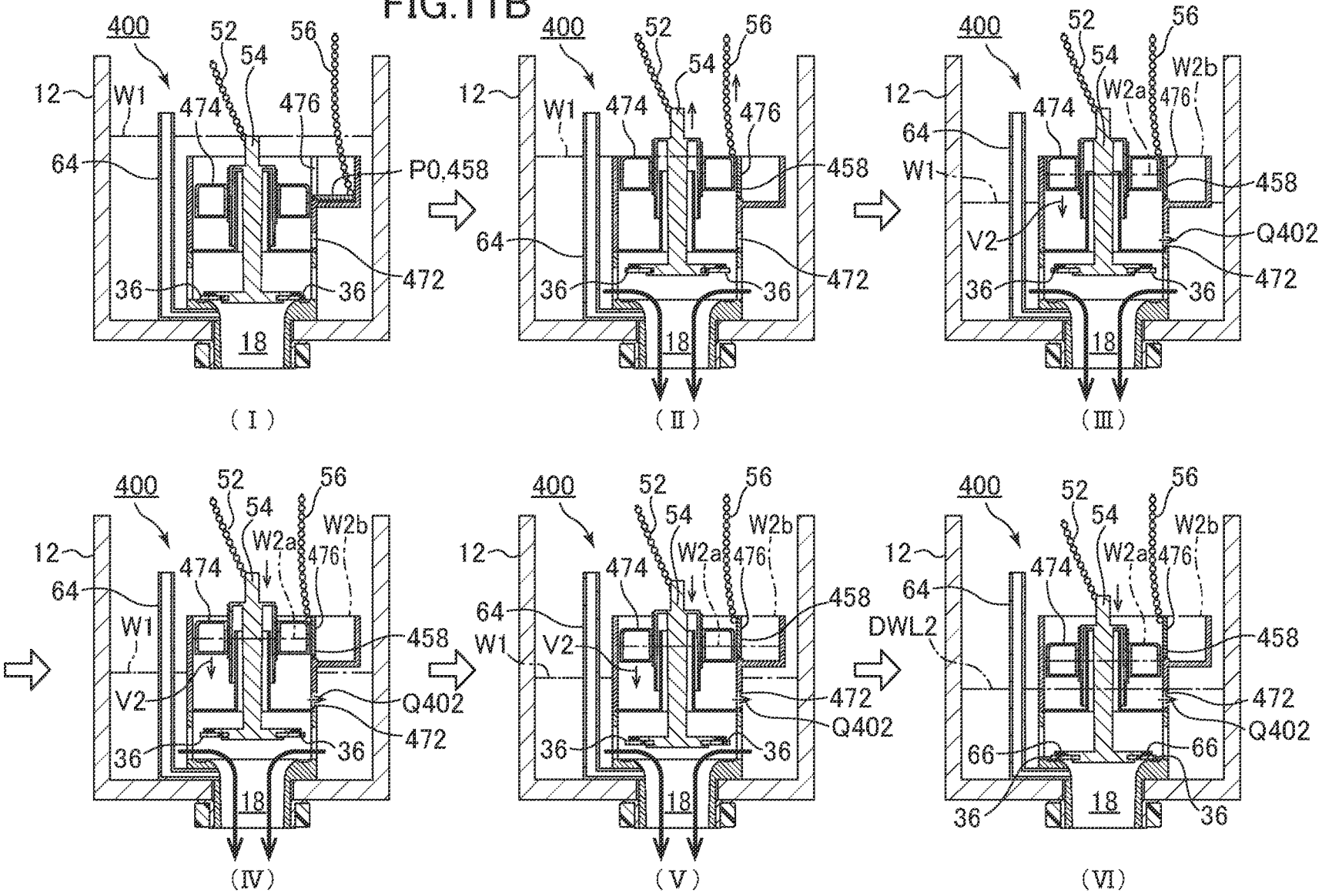
FIG. 11B is a schematic diagram showing a configuration of the discharge valve device according to the fifth embodiment of the present invention and a series of operations from the standby state until the valve is started to open and closed by the small flushing mode.

Additionally, at an initial position P0 in a standby period before the large and small flushing modes are started (see state (I) in FIGS. 11A and 11B), the valve body portion 480 and the water weight portion 482 of the switching valve 458 are in the falling posture (horizontal posture). Further, after the standby period shown in the state (I) of FIG. 11A, even in a period in which the large flushing mode shown in the states (II) to (VI) of FIG. 11A is executed, the valve body portion 480 and the water weight portion 482 of the switching valve 458 are in the initial position P0, and the state of the falling posture (horizontal posture) is maintained. Furthermore, in the state of the falling posture (horizontal posture) where the valve body portion 480 and the water weight portion 482 of the switching valve 458 are in the initial position P0, the valve body portion 480 of the switching valve 458, without abutting on the locking portion 478, opens the communication opening 476 and closes each auxiliary outlet port 484. Further, in the state where the valve body portion 480 and the water weight portion 482 are in the falling posture (horizontal posture), an opening end portion 482*a* (see FIG. 8) at a tip of the water weight portion 482 is directed in a horizontal direction, so that the flush water in the small tank 470 can flow into the water weight portion 482 from the opening end portion 482*a*, and the flush water can be stored in the water weight portion 482. On the other hand, in a period in which the small flushing mode shown in the states (II) to (VI) of FIG. 11B is executed, the valve body portion 480 and the water weight portion 482 of the switching valve 458 rotate from the initial position P0 to contact the locking portion 478. Accordingly, when a state where the communication opening 476 is closed is maintained and then the flush water in the small tank 470 flows out from each auxiliary outlet port 484, the valve body portion 480 and the water weight portion 482 rotate toward the initial position P0 to cause the flush water in the water weight portion 482 to flow out and then return to the initial position P0 of the standby state (I).

Next, as shown in FIGS. 8 to 10, a top edge 468*b* of the water storage cylinder body 468, a top edge 470*a* of the small tank 470, and an upper end 478*a* of the locking portion 478 are flush with one another. Further, as shown in FIGS. 8 and 10, in a state where the communication opening 476 is closed by the switching valve 458, an upper end 458*a* of the switching valve 458 (valve body portion 480 and water weight portion 482) protrudes upward from a top edge of the communication opening 476 and the top edge 470*a* of the small tank 470. According to the configuration of the discharge valve device 400 of the present embodiment, in the large flushing mode of the states (III) to (VI) of FIG. 11A, a first total outflow amount (first water drainage amount) Q401 [L] of the flush water in the water storage cylinder 462 flowing out from the outlet port 472 into the storage tank 12 is larger than a second total outflow amount (second water drainage amount) Q402 [L] of the flush water in the water storage cylinder 462 flowing out from the outlet port 472 into the storage tank 12 (Q401>Q402) in the small flushing mode of the states (III) to (VI) of FIG. 11B.

Figure 7:
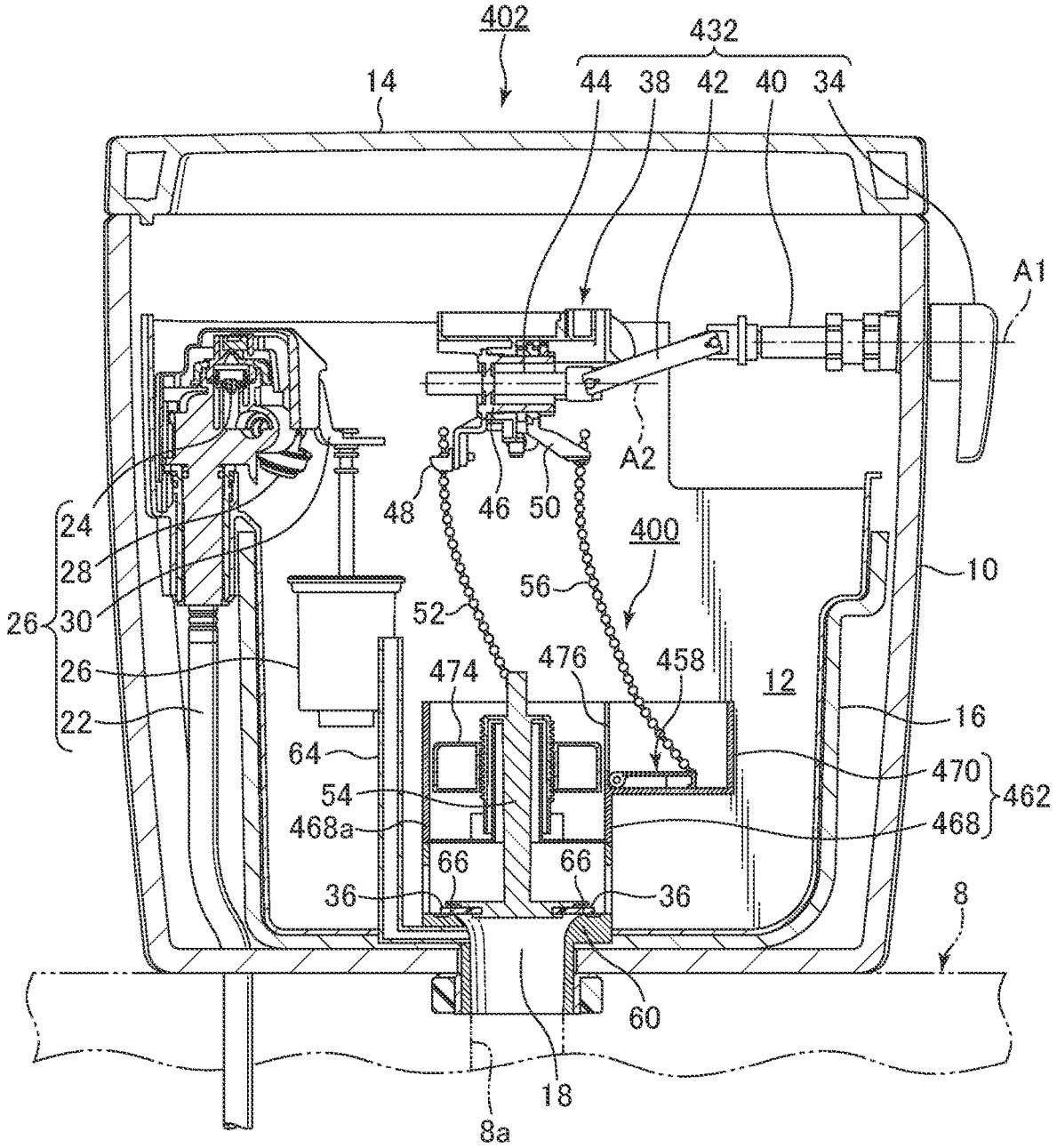
FIG. 7 is a front sectional view of a flush water tank device including a discharge valve device according to the fifth embodiment of the present invention.

Next, an operation of the discharge valve device 400 according to the present embodiment will be described with reference to FIGS. 7 to 11B. First, the large flushing mode executed by the discharge valve device 400 according to the present embodiment will be described with reference to with FIGS. 7 to 11A. As shown in FIGS. 7 and 11A, to start the large flushing mode from the standby state (I), for example, when the user rotates an operation lever 34 shown in FIG. 7 at 90 degrees to a front side, only a first swing lever 48 in the initial position state (standby state) shown in FIG. 7 is swung, and only the first bead chain 52 is pulled up. Accordingly, as the actuation shaft 54 and the valve body 36 of the discharge valve device 400 are pulled up and move linearly upward via a first bead chain 52, the float 474 is also integrally pulled up via the actuation shaft 54 (see state (II) of FIG. 11A). On the other hand, since the second bead chain 56 cannot be pulled up by the second swing lever 50, the switching valve 58 is at the initial position P0 and rotated to open the communication opening 476 of the water storage cylinder 462, to obtain a state where the water storage cylinder body 468 communicates with the small tank 470 (see state (II) of FIG. 11A). Thereafter, a state where the water storage cylinder body 468 and the small tank 470 normally communicate is maintained until the large flushing mode is finished (see states (II) to (VI) in FIG. 11B).

At this time, as shown in the state (II) of FIG. 11A, the float 474 and the valve body 36 are raised to the highest position, and in this state, a discharge opening 18 of the storage tank 12 is opened by the raised valve body 36, to start draining of flush water from the inside of the storage tank 12 to the discharge opening 18. Thereafter, as shown in the states (III) to (V) of FIG. 11A, when a water level W1 in the storage tank 12 decreases further to a water level lower than an upper end of the water storage cylinder 462, a water pressure due to a water level W2 in the water storage cylinder 462 is higher than a water pressure due to the water level W1 in the storage tank 12 outside the cylinder, and hence the flush water in the water storage cylinder 462 flows out from the outlet port 472 into the storage tank 12 outside the cylinder. Then, as shown in the states (III) and (IV) of FIGS. 11A, the water level W2 in the water storage cylinder 462 is higher than the water level W1 in the storage tank 12 outside the cylinder, but the flush water in the water storage cylinder 462 continues to flow out of the outlet port 472. Therefore, as the water level W2 in the water storage cylinder 462 gradually decreases, the float 474 also lowers in conjunction with lowering of the water level W2.

Next, as shown in the state (V) of FIG. 11A, when the water level W1 in the storage tank 12 outside the water storage cylinder 462 lowers from an upper end of the outlet port 472 of the water storage cylinder 462, outside of the outlet port 472 of the water storage cylinder 462 is open to the atmosphere. Accordingly, a speed at which the flush water in the water storage cylinder 462 flows out of the outlet port 472 is increased, and the water level W2 in the water storage cylinder 462 further decreases. Therefore, the float 474 also lowers, and the actuation shaft 54 and the valve body 36 also lower integrally. Then, as shown in the state (VI) of FIG. 11A, when the valve body 36 contacts a valve seat 66, the discharge opening 18 is closed. Consequently, draining of flush water from the inside of the storage tank 12 to the discharge opening 18 is stopped, and the supply of flush water from a flush water tank device 402 to a toilet main body 8 by the large flushing mode is finished. At this time, the float 474, the actuation shaft 54 and the valve body 36 are in a stopped state, but a minimum water level DWL1 in the storage tank 12 (draining stop water level so-called "dead water line") is located below a lower end of the outlet port 472 of the water storage cylinder 462. For this reason, the flush water in the water storage cylinder 462 continues to flow out from the outlet port 472 to the storage tank 12 side. As only the water level W2 in the water storage cylinder 462 gradually decreases, the water pressure in the water storage cylinder 462 also decreases. Further, in the standby state after the end of the large flushing mode, the switching valve 458 is in a state where the communication opening 476 is opened, and a state where the water storage cylinder body 468 and the small tank 470 communicate with each other is maintained until the next flushing mode is started.

Next, with reference to FIGS. 7 to 10 and 11B, the small flushing mode executed by the discharge valve device 400 according to the present embodiment will be described. To start the small flushing mode from the standby state (I) of FIGS. 7 and 11B, for example, when the user rotates the operation lever 34 shown in FIG. 7 at 90 degrees to a back side, each of the first swing lever 48 and the second swing lever 50 in the state at the initial position (standby state) shown in FIG. 7 is swung, and each of the first bead chain 52 and the second bead chain 56 is pulled up. Accordingly, as the actuation shaft 54 and the valve body 36 of the discharge valve device 1 are pulled up and move linearly upward via the first bead chain 52, the float 474 is also integrally pulled up via the actuation shaft 54 (see state (II) of FIG. 11B). Further, the switching valve 58 for switching large or small flushing is pulled up via the second bead chain 56, and the switching valve 458 rotates from the state where the communication opening 476 of the water storage cylinder 462 is open (initial position P0) in the direction C2 to close the communication opening 476. Accordingly, the communication opening 476 of the small tank 470 is closed by the switching valve 458, and thereafter, a state where the water storage cylinder body 468 and the small tank 470 are separated by the switching valve 458 is maintained until the small flushing mode ends (see states (II) to (VI) of FIG. 11B).

Further, in the state (II) of FIG. 11B, the float 474 and the valve body 36 are raised to the highest position, and the discharge opening 18 of the storage tank 12 is opened by the raised valve body 36, to start the draining of flush water from the inside of the storage tank 12 to the discharge opening 18. Thereafter, as shown in the states (III) to (V) of FIG. 11B, when the water level W1 in the storage tank 12 decreases to a water level lower than the upper end of the water storage cylinder 462, a water pressure due to a water level W2*a* in the water storage cylinder body 468 is higher than a water pressure due to the water level W1 in the storage tank 12 outside the cylinder body, and hence the flush water in the water storage cylinder body 468 flows out from the outlet port 472 into the storage tank 12 outside the cylinder body. Then, in the states (III) to (V) of FIG. 11B, the water level W2*a* in the water storage cylinder body 468 is higher than the water level W1 in the storage tank 12 outside the cylinder body, and hence the flush water in the water storage cylinder 462 continues to flow out of the outlet port 472. As the water level W2 in the water storage cylinder 462 gradually decreases, the float 474 also lowers in conjunction with lowering of water level W2. Here, in the states (III) to (V) of FIG. 11B, the water level W2*a* in the water storage cylinder body 468 is lower than a water level W2*b* in the small tank 470, and the water pressure in the small tank 470 is higher than a water pressure in the water storage cylinder body 468. Accordingly, the switching valve 458 is pressed in the direction C2 to close the communication opening 476 by the water pressure in the small tank 470, and hence the communication opening 476 of the small tank 470 is closed by the switching valve 458, to maintain a state where the water storage cylinder body 468 and the small tank 470 are separated by the switching valve 458.

Then, as shown in the state (VI) of FIG. 11B, when the valve body 36 contacts the valve seat 66, the discharge opening 18 is closed, and the draining of flush water from the inside of the storage tank 12 to the discharge opening 18 is stopped. Accordingly, the supply of flush water from the flush water tank device 402 to the toilet main body 8 by the small flushing mode is finished. At this time, a minimum water level DWL2 (draining stop water level so-called "dead water line") in the storage tank 12 during the small flushing mode in the state (VI) of FIG. 11B is located above the minimum water level DWL1 in the storage tank 12 during the large flushing mode in the state (VI) of FIG. 11A. That is, the minimum water level DWL2 during the small flushing mode is higher than the minimum water level DWL1 during the large flushing mode, by which the amount of flush water drained from the storage tank 12 to the discharge opening 18 during the small flushing mode is lower than the amount of flush water drained from the storage tank 12 to the discharge opening 18 during the large flushing mode. Additionally, the first total outflow amount (first water drainage amount) Q401 [L] of the flush water in the water storage cylinder 462 flowing out from the outlet port 472 into the storage tank 12 in the large flushing mode of the states (III) to (VI) of FIG. 11A is larger than the second total outflow amount (second water drainage amount) Q402 [L] of the flush water in the water storage cylinder 462 flowing out from the outlet port 472 into the storage tank 12 in the small flushing mode of the states (III) to (VI) of FIG. 11B (Q401>Q402).

According to the discharge valve device 400 of the fifth embodiment of the present invention described above, to start flushing of the flush toilet 4, first, on selecting either flushing mode of the large flushing mode or the small flushing mode, the actuation shaft 54 of the discharge valve device 400 is raised to raise (open) the valve body 36, and the flush water in the storage tank 12 is supplied from the discharge opening 18 to a water conduit 8*a* of the toilet main body 8 of the flush toilet 4. Then, the water level W2 in the water storage cylinder 462 decreases depending on the selected large flushing mode or small flushing mode, and the float 474 in the water storage cylinder 462 lowers as the water level W2 decreases. Accordingly, as the actuation shaft 54 of the discharge valve device 400 lowers, the valve body 36 lowers (closes), and the supply of flush water from the storage tank 12 to the flush toilet 4 is stopped, to finish the flushing of the flush toilet 4. At this time, the first total outflow amount Q401 [L] of the flush water in the water storage cylinder 462 flowing out from the outlet port 472 to the storage tank 12 in the large flushing mode is larger than the second total outflow amount Q402 [L] of the flush water in the water storage cylinder 462 flowing out from the outlet port 472 to the storage tank 12 in the small flushing mode (Q401>Q402). Accordingly, a lowering speed v2 of the float 474 during the small flushing mode can be larger than a lowering speed v1 of the float 474 in the large flushing mode (v2>v1). Therefore, a lowering time of the float 474 and a valve opening time of the valve body 36 during the small flushing mode can be shorter than a lowering time of the float 474 and a valve opening time of the valve body 36 during the large flushing mode. As a result, the lowering speed v1, v2 of the float 474 with the decrease in water level W2 in the water storage cylinder 462 can be changed by changing the flush water amount of the flush water in the water storage cylinder 462 flowing out from the outlet port 472 to the storage tank 12 (so-called "water drainage amount Q401, Q402") depending on the selected large flushing mode or small flushing mode. Therefore, a flow rate per unit time of flush water (hereinafter referred to as "instantaneous flow rate") [L/min] that affects flushing performance can be maintained comparatively high even in the small flushing mode in which the flush water amount is smaller than in the large flushing mode. Further, closing sound generated when the valve body 36 closes the discharge opening 18 can be reduced.

Further, according to the discharge valve device 400 of the present embodiment, the small tank 470 communicatively connected to the water storage cylinder body 468 includes the communication opening 476 communicating with the water storage cylinder body 468, and the switching valve 458 for switching large or small flushing that opens and closes the communication opening 476. Accordingly, the switching valve 458 can communicate between the water storage cylinder body 468 and the small tank 470 by opening the communication opening 476 in the large flushing mode. On the other hand, the switching valve 458 of the small tank 470 can separate the water storage cylinder body 468 and the small tank 470 by closing the communication opening 476 in the small flushing mode. As a result, since the first total outflow amount Q401 [L] of the flush water in the water storage cylinder 462 flowing out from the outlet port 472 to the storage tank 12 in the large flushing mode can be larger than the second total outflow amount Q402 [L] of the flush water in the water storage cylinder 462 flowing out from the outlet port 472 to the storage tank 12 in the small flushing mode, the lowering speed v2 of the float 474 during the small flushing mode can be larger than the lowering speed v1 of the float 474 during the large flushing mode. Accordingly, the lowering time of the float 474 and the valve opening time of the valve body 36 during the small flushing mode can be shorter than the lowering time of the float 474 and the valve opening time of the valve body 36 during the large flushing mode. As a result, the lowering speed v1 and v2 of the float 474 with the decrease in water level in the water storage cylinder 462 can be changed by changing the flush water amounts Q401 and Q402 [L] (so-called "water drainage amounts Q401 and Q402") of the flush water in the water storage cylinder 462 flowing out from the outlet port 472 to the storage tank 12 depending on the selected large flushing mode or small flushing mode. Therefore, the instantaneous flow rate of the flush water [L/min] that affects the flushing performance can be maintained comparatively high even in the small flushing mode in which the flush water amount is smaller than in the large flushing mode. Further, the closing sound generated when the valve body 36 closes the discharge opening 18 can be reduced.

Further, according to the discharge valve device 400 of the present embodiment, if the switching valve 458 for switching large or small flushing does not rotate with respect to the communication opening 476, and the switching valve 458 is provided slidably with respect to the communication opening 476 and when the communication opening 476 is closed by the switching valve 458, a seal portion in which the switching valve 458 and the communication opening 476 are in contact might have a risk of being damaged by wear or the like due to repeated sliding of the switching valve 458 to open and close the communication opening 476. However, according to the discharge valve device 400 of the present embodiment, the switching valve 458 is provided rotatably with respect to the communication opening 476. The communication opening 476 can be rotated in the direction C1 to open the communication opening 476 in the large flushing mode and can be rotated in the direction C2 to close the communication opening 476 in the small flushing mode. Accordingly, as compared to a form in which the switching valve 458 slides to open and close the communication opening 476, a risk of normal contact of the switching valve 458 with the communication opening 476 regardless of the flushing mode can be avoided while suppressing the number of parts. Therefore, the risk of damage due to wear or the like on a portion (seal portion) of the communication opening 476 of the small tank 470 that contacts the switching valve 458 during closing can be reduced.

Further, according to the discharge valve device 400 of the present embodiment, the communication opening 476 of the small tank 470 includes the locking portion 478 that is provided at the rim of the opening and that rotatably supports the switching valve 458. Accordingly, when the switching valve 458 rotates in the direction C2 to close the communication opening 476 and contacts the locking portion 478 in the small flushing mode, the locking portion 478 can reliably restrict the rotation of the switching valve 458. Further, in the state where the switching valve 458 is in contact with the locking portion 478 in the small flushing mode, the locking portion 478 can reliably contact and seal the switching valve 458 and the rim of the communication opening 476, and hence water tightness between the water storage cylinder body 468 and the small tank 470 can be improved. Therefore, in the small flushing mode, flowing of flush water in the small tank 470 into the water storage cylinder body 468 from the communication opening 476 can be reliably suppressed.

Further, according to the discharge valve device 400 of the present embodiment, the switching valve 458 includes a pair of water weight portions 482 that store flush water, and in the bottom surface of the small tank 470, a pair of auxiliary outlet ports 484 for the flush water in the small tank 470 to flow outside are provided. Accordingly, when the switching valve 458 abuts on the locking portion 478, the water weight portions 482 can store flush water, and the flush water in the small tank 470 flows out of the auxiliary outlet ports 484. Further, when the flush water in the small tank 470 flows out from the auxiliary outlet ports 484, the switching valve 458 rotates in the direction apart from the locking portion 478 (direction C1 to open the communication opening 476), and the flush water in the water weight portions 482 can flow outside. Therefore, a series of rotating operations from the state where the communication opening 476 of the small tank 470 is closed by the switching valve 458 until the switching valve opens the communication opening can be reliably and smoothly executed using the change in water level in the small tank 470 and the change in amount of flush water stored in the water weight portions 482.

Further, according to the discharge valve device 400 of the present embodiment, at the initial position P0, the switching valve 458 takes the falling posture (horizontal posture), does not abut on the locking portion 478 and opens the communication opening 476, and any flush water is not stored in the water weight portion 482. In the standby period in which any flushing mode is not executed (see state (I) of FIGS. 11A and 11B) and in the period in which the large flushing mode is executed (see states (II) to (VI) of FIG. 11A), the switching valve 458 is maintained at the initial position P0. Accordingly, the auxiliary outlet port 484 of the small tank 470 is closed by the switching valve 458, and flush water can be stored in the small tank. On the other hand, in the period in which the small flushing mode is executed (see states (II) to (VI) of FIG. 11B), the switching valve 458 rotates from the initial position P0 in the direction C2 to close the communication opening 476 and contacts the locking portion 478 to maintain the state where the communication opening 476 is closed. Thereafter, when the flush water in the small tank 470 flows out from the auxiliary outlet port 484, the switching valve 458 can return to the initial position P0 after causing the flush water in the water weight portion 482 to flow outside, while rotating from the state where the communication opening 476 is closed toward the initial position P0. As a result, the lowering speed v1, v2 of the float 474 with the decrease in water level W2 in the water storage cylinder 462 can be efficiently changed by efficiently changing the flush water amount Q401, Q402 (so-called "water drainage amount Q401, Q402") of the flush water in the water storage cylinder 462 flowing out from the outlet port 472 to the storage tank 12 depending on the selected large flushing mode or small flushing mode.

Further, according to the discharge valve device 400 of the present embodiment, as shown in FIGS. 8 and 10, the top edge 468*b* of the water storage cylinder body 468 and the top edge 470*a* of the small tank 470 are flush with each other. Also, as shown in FIG. 10, in the state where the communication opening 476 of the small tank 470 is closed by the switching valve 458, the upper end 458*a* of the switching valve 458 protrudes upward from the top edge of the communication opening 476 and the top edge 470*a* of the small tank 470. Accordingly, in the state where the communication opening 476 is closed by the switching valve 458, the flush water in the small tank 470 can be reliably inhibited from flowing over the upper end 458*a* of the switching valve 458 into the water storage cylinder body 468.

Next, with reference to FIGS. 1 and 12 to 13B, a discharge valve device 500 according to a sixth embodiment of the present invention will be described. Here, in the discharge valve device 500 of the sixth embodiment of the present invention shown in FIGS. 12 to 13B, the same part as in the discharge valve devices 1, 100, 200, 300 and 400 according to the first to fifth embodiments of the present invention described above is denoted with the same sign and is not described.

Figure 12:
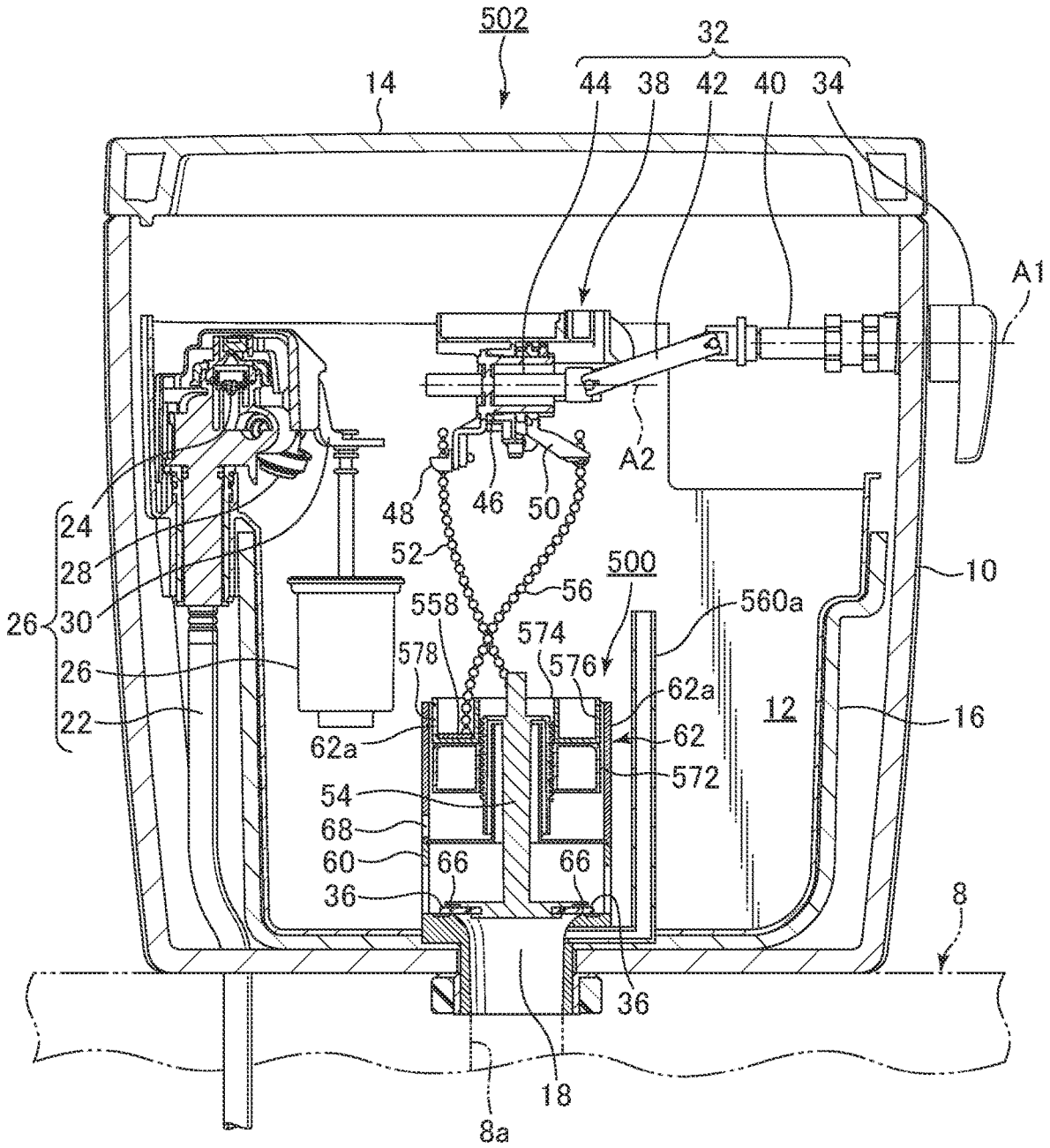
FIG. 12 is a front sectional view of a flush water tank device including a discharge valve device according to the sixth embodiment of the present invention.

As shown in FIG. 12, in the discharge valve device 500 of the present embodiment, to start toilet flushing by a large flushing mode, when an operation lever 34 is rotated at a predetermined angle (for example, 90 degrees) to one side (front side of FIG. 12) about a rotation center axis A1, an outer rotary shaft 40 and an inner rotary shaft 42 that are coupled to the operation lever 34 rotate to one side, and a rotary spindle portion 44 of a pulling-up actuating portion 38 rotates to one side about a rotation center axis A2. Accordingly, a cylindrical rotating portion 46 of the pulling-up actuating portion 38 also rotates integrally with the rotary spindle portion 44 to one side (front side of FIG. 12) about the rotation center axis A2, and a first swing lever 48 swings (rotates) to one side (front side of FIG. 12) to pull up a first bead chain 52, whereas a second swing lever 50 does not swing, and a second bead chain 56 is not pulled up. On the other hand, to start toilet flushing by a small flushing mode, when the operation lever 34 shown in FIG. 12 is rotated at a predetermined angle (for example, 90 degrees) to the other side (back side of FIG. 12) about the rotation center axis A1, the outer rotary shaft 40 and the inner rotary shaft 42 that are coupled to the operation lever 34 rotate to the other side, and the rotary spindle portion 44 of the pulling-up actuating portion 38 rotates to the other side about the rotation center axis A2. Accordingly, the cylindrical rotating portion 46 of the pulling-up actuating portion 38 also rotates integrally with the rotary spindle portion 44 to the other side (back side of FIG. 12) about the rotation center axis A2, and the first swing lever 48 swings (rotates) to the other side (back side of FIG. 12) to pull up the first bead chain 52. The second swing lever 50 also swings (rotates) to the other side (back side of FIG. 12) to pull up the second bead chain 56.

Next, as shown in FIG. 12, the discharge valve device 500 of the present embodiment includes a water storage cylinder 562 provided above a discharge opening forming portion 60, and an overflow pipe 560*a* communicating with a discharge opening 18. Further, in a side wall 62*a* on one of left and right sides of the water storage cylinder 62 (side wall 62*a* on the left side when the water storage cylinder 62 is seen from the front side), an outlet port 68 is provided for the flush water in the water storage cylinder 62 to flow outside.

Further, as shown in FIG. 12, the outlet port 68 of the water storage cylinder 62 is normally open regardless of the large or small flushing mode, and a storing portion 574 for storing flush water is provided in an upper part of a float 572. The storing portion 574 includes a peripheral wall 576 surrounding the storing portion, an outlet 578 formed in a part of the peripheral wall 576, and a partition (switching valve 558 for switching large or small flushing) provided to be openable and closable for the outlet 578. Furthermore, the switching valve 558 opens the outlet 578 of the peripheral wall 576 in the storing portion 574 of the float 572 during the large flushing mode, so that the flush water in the storing portion 574 can flow out from the outlet 578.

On the other hand, the switching valve 558 closes the outlet 578 of the peripheral wall 576 in the storing portion 574 of the float 572 during the small flushing mode and maintains a state where flush water is stored in the storing portion 574, and the storing portion 574 functions as a water weight. Consequently, the amount of flush water stored in the storing portion 574 during the small flushing mode is larger than the amount of flush water stored in the storing portion 574 during the large flushing mode, and hence a weight of the storing portion 574 during the small flushing mode is larger than a weight of the storing portion 574 during the large flushing mode. A buoyancy obtained in the float 572 during the small flushing mode decreases as compared to a buoyancy obtained during the large flushing mode.

Figure 13A:
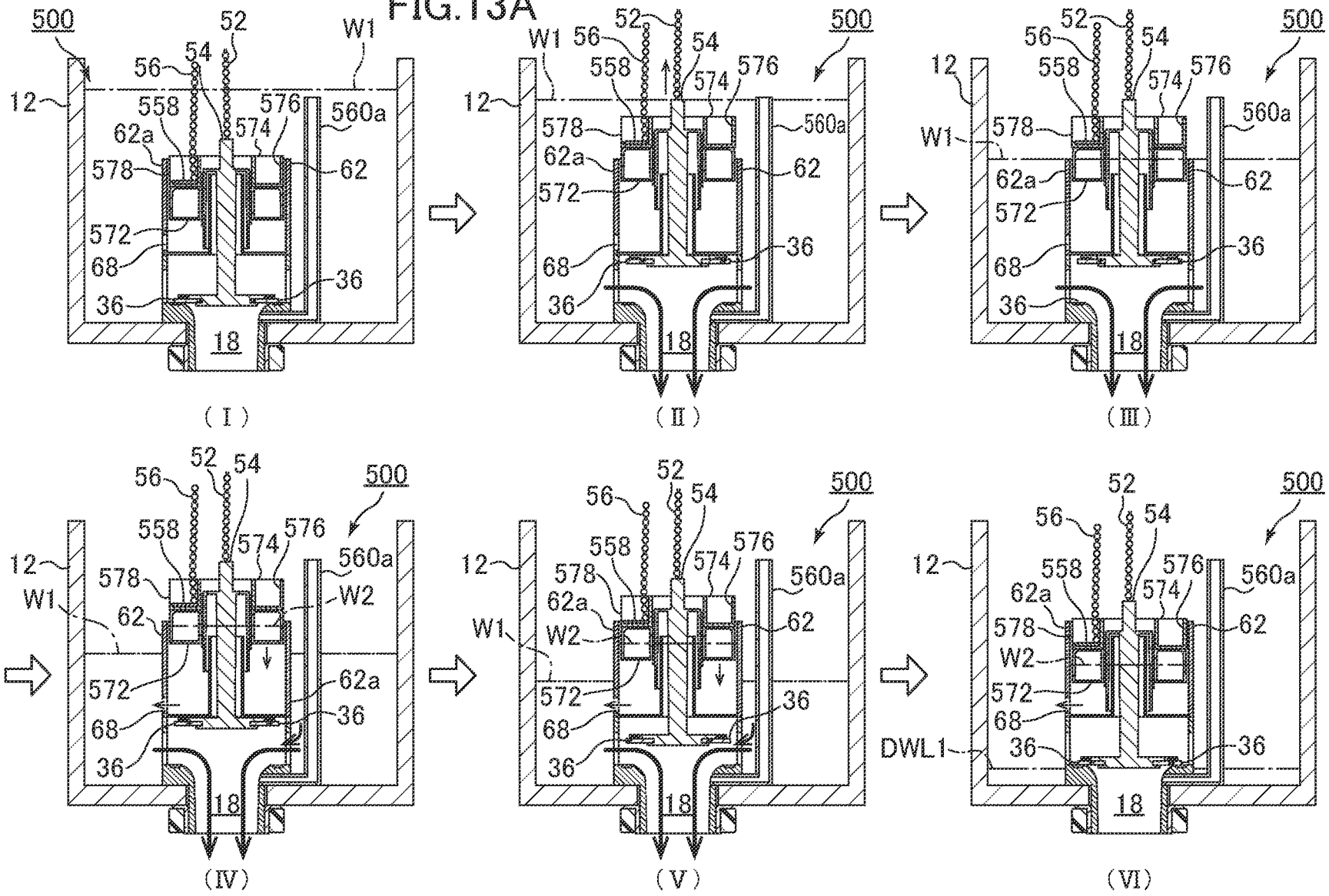
FIG. 13A is a schematic diagram showing a configuration of the discharge valve device according to the sixth embodiment of the present invention and a series of operations from a standby state until a valve is started to open and closed by the large flushing mode.

Additionally, as shown in FIG. 13A, when toilet flushing by the large flushing mode is executed, for the switching valve 558, the second bead chain 56 loosens without being pulled up by the second swing lever 50. Further, as shown in FIG. 13A, the switching valve 558 opens the outlet 578 of the storing portion 574 of the float 572 without being pulled up by the second bead chain 56. Consequently, any flush water is not stored in the storing portion 574 of the float 572.

Figure 13B:
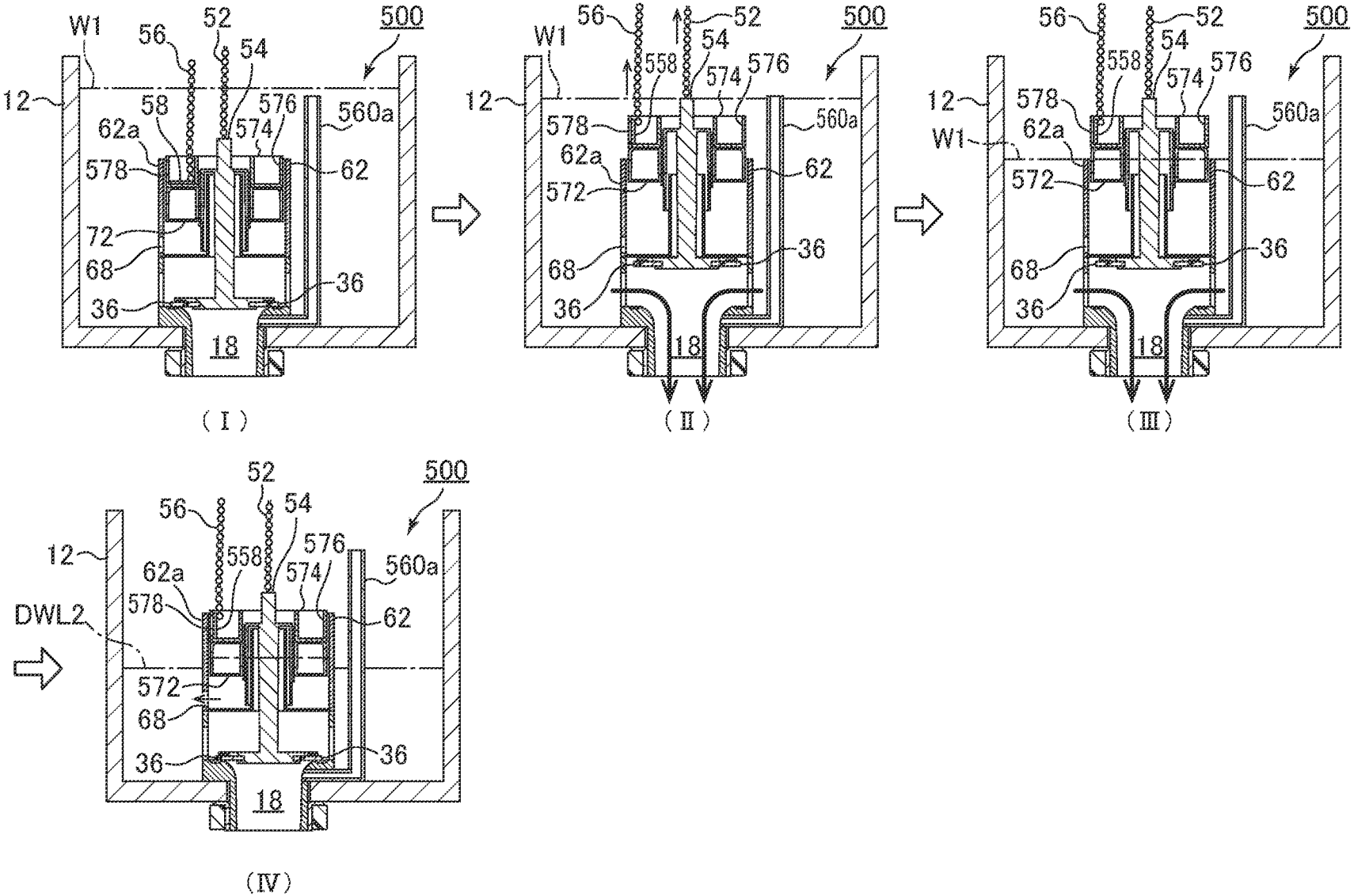
FIG. 13B is a schematic diagram showing a configuration of the discharge valve device according to the sixth embodiment of the present invention and a series of operations from the standby state until the valve is started to open and closed by the small flushing mode.

On the other hand, as shown in FIG. 13B, when the toilet flushing by the small flushing mode is executed, the switching valve 558 allows the second bead chain 56 to be pulled up by the second swing lever 50. The switching valve 558 is pulled up by the second bead chain 56 to close the outlet 578 of the storing portion 574 of the float 572. Accordingly, flush water is stored in the storing portion 574 of the float 572. Consequently, in the float 572, the storing portion 574 functions as the water weight during the small flushing mode, whereas the storing portion 574 is difficult to function as the water weight during the large flushing mode. Therefore, the buoyancy obtained during the small flushing mode decreases as compared to the buoyancy obtained during the large flushing mode. Therefore, in each flushing mode of the large and small flushing modes, a balance position between a water level W2 in the water storage cylinder 62 and the float 572 is changed depending on the selected flushing mode, and hence a lowering time T2 of the float 572 during the small flushing mode is shorter than a lowering time T1 of the float 572 during the large flushing mode (T2<T1).

Next, with reference to FIGS. 12 to 13B, an operation of the discharge valve device 500 according to the sixth embodiment of the present invention will be described. First, with reference to FIGS. 12 and 13A, the large flushing mode executed by the discharge valve device 500 according to the present embodiment will be described. To start the large flushing mode from FIG. 12 and standby state (I) of FIG. 13A, for example, when the user rotates the operation lever 34 shown in FIG. 12 at 90 degrees to the front side, only the first swing lever 48 in a state at an initial position (standby state) shown in FIG. 12 is swung, and only the first bead chain 52 is pulled up. Consequently, as an actuation shaft 54 and a valve body 36 of the discharge valve device 500 are pulled up and move linearly upward via the first bead chain 52, the float 572 is also integrally pulled up via the actuation shaft 54 (see state (II) of FIG. 13A). At this time, since the second bead chain 56 is not pulled up by the second swing lever 50, the switching valve 58 is rotated to open the outlet 578 of the storing portion 574 of the float 572 without being pulled up by the second bead chain 56 (see state (II) of FIG. 13A). This state where the outlet 578 of the storing portion 574 of the float 572 is opened is maintained thereafter until the large flushing mode ends (see states (II) to (VI) of FIG. 13A).

Consequently, in the state (II) of FIG. 13A, the float 572 and the valve body 36 are raised to the highest position, and the discharge opening 18 of a storage tank 12 is opened by the raised valve body 36. Then, the flush water in the storage tank 12 is drained to the discharge opening 18. Thereafter, as shown in the state (III) of FIG. 13A, when the water level W1 in the storage tank 12 decreases close to an upper end of the water storage cylinder 62 and further to a water level lower than the upper end of the water storage cylinder 62, a water pressure due to the water level W2 in the water storage cylinder 62 is higher than a water pressure due to the water level W1 in the storage tank 12, and hence the flush water in the water storage cylinder 62 flows out of the outlet port 68. Then, as shown in the states (IV) and (V) of FIG. 13A, the water level W2 in the water storage cylinder 62 is higher than the water level W1 in the storage tank 12, and the flush water in the water storage cylinder 62 continues to flow out of the outlet port 68. For this reason, as the water level W2 in the water storage cylinder 62 gradually decreases, the float 572 also lowers in conjunction with lowering of the water level W2.

Next, as shown in the state (VI) of FIG. 13A, when the water level W1 in the water storage cylinder 62 and the storage tank 12 lowers from below an upper end of the outlet port 68 of the water storage cylinder 62, outside of the outlet port 68 of the water storage cylinder 62 is open to the atmosphere. Accordingly, a speed at which the flush water in the water storage cylinder 62 flows out of the outlet port 68 is increased, and the water level W2 in the water storage cylinder 62 further lowers. Therefore, the float 572 also lowers, and the actuation shaft 54 and the valve body 36 also integrally lower. Then, when the valve body 36 contacts a valve seat 66, the discharge opening 18 is closed, and draining of flush water from inside of the storage tank 12 to the discharge opening 18 is stopped. Consequently, supply of flush water from a flush water tank device 502 to a toilet main body 8 by the large flushing mode is finished.

Next, with reference to FIGS. 12 and 13B, the small flushing mode executed by the discharge valve device 500 according to the sixth embodiment of the present invention will be described. To start the small flushing mode from FIG. 12 and the standby state (I) of FIG. 13B, for example, when the user rotates the operation lever 34 shown in FIG. 12 at 90 degrees to the back side, each of the first swing lever 48 and the second swing lever 50 in a state (standby state) at the initial position shown in FIG. 12 is swung, and each of the first bead chain 52 and the second bead chain 56 is pulled up. Consequently, as the actuation shaft 54 and the valve body 36 of the discharge valve device 500 are pulled up and move linearly upward via the first bead chain 52, the float 572 is also integrally pulled up via the actuation shaft 54 (see the state (II) of FIG. 13B). Further, the switching valve 58 is pulled up via the second bead chain 56, and the outlet 578 of the storing portion 574 of the float 572 is opened by the switching valve 558. Also, a state where the outlet 578 of the storing portion 574 of the float 572 is closed by the switching valve 558 is maintained thereafter until the small flushing mode ends (see states (II) to (IV) of FIG. 13B).

Further, as shown in the state (II) of FIG. 13B, the float 572 and the valve body 36 are raised to the highest position, and the discharge opening 18 of the storage tank 12 is opened by the raised valve body 36, to start draining of flush water from the inside of the storage tank 12 to the discharge opening 18. Thereafter, as shown in the state (III) of FIG. 13B, when the water level W1 in the storage tank 12 decreases close to the upper end of the water storage cylinder 62, and further to a water level lower than the upper end of the water storage cylinder 62, the water pressure due to the water level W2 in the water storage cylinder 62 is higher than the water pressure due to the water level W1 in the storage tank 12, thereby causing the flush water in the water storage cylinder 62 to flow out of the first outlet port 68.

At this time, in the storing portion 574 of the float 572 in which flush water is stored, a state where the outlet 578 is closed by the switching valve 558 is maintained. Accordingly, the weight of the storing portion 574 (and the amount of flush water stored in the storing portion 574) during the small flushing mode is larger than the weight of the storing portion 574 (and the amount of flush water stored in the storing portion 74) during the large flushing mode. Consequently, during the small flushing mode, since the storing portion 574 of the float 572 acts as the water weight, the buoyancy that acts on the float 572 during the small flushing mode decreases as compared to the buoyancy during the large flushing mode. Therefore, the lowering time T2 of the float 572 during the small flushing mode is shorter than the lowering time T1 of the float 572 during the large flushing mode (T2<T1). Further, the balance position, based on the water storage cylinder 62, between the water level W2 in the water storage cylinder 62 and the float 572 during the small flushing mode is also lower than the balance position during the large flushing mode.

Then, as shown in the state (IV) of FIG. 13B, when the valve body 36 contacts the valve seat 66, the discharge opening 18 is closed, and the draining of flush water from the inside of the storage tank 12 to the discharge opening 18 is stopped. Accordingly, the supply of flush water from the flush water tank device 502 to the toilet main body 8 by the small flushing mode is finished. At this time, a minimum water level DWL2 (water draining stop water level so-called "dead water line") in the storage tank 12 during the small flushing mode in the state (VI) of FIG. 13B is located above a minimum water level DWL1 in the storage tank 12 during the large flushing mode in the state (VI) of FIG. 3A. That is, the minimum water level DWL2 during the small flushing mode is higher than the minimum water level DWL1 during the large flushing mode, by which the amount of flush water drained from the storage tank 12 to the discharge opening 18 during the small flushing mode is lower than the amount of flush water drained from the storage tank 12 to the discharge opening 18 during the large flushing mode.

According to the discharge valve device 500 of the sixth embodiment of the present invention described above, to start flushing of a flush toilet 4, first, on selecting either flushing mode of the large flushing mode or the small flushing mode, the actuation shaft 54 of the discharge valve device 500 is raised, to raise (open) the valve body 36, and the flush water in the storage tank 12 is supplied from the discharge opening 18 to the toilet main body 8 of the flush toilet 4. Then, the water level W2 of the water storage cylinder 62 decreases depending on the selected large flushing mode or small flushing mode, and the float 72 in the water storage cylinder 62 lowers as the water level W2 decreases. Accordingly, as the actuation shaft 54 of the discharge valve device 500 lowers, the valve body 36 lowers (closes), and the flush water in the storage tank 12 is supplied from the discharge opening 18 to the toilet main body 8 of the flush toilet 4. Then, the water level W2 of the water storage cylinder 62 decreases depending on the selected large flushing mode or small flushing mode, and the supply of flush water from the water level W2 to the toilet main body 8 of the flush toilet 4 is stopped, thereby finishing flushing of the flush toilet 4. At this time, since the buoyancy obtained during the small flushing mode decreases as compared to the buoyancy obtained during the large flushing mode in the float 72, the lowering time T2 of the float 572 during the small flushing mode can be shorter than the lowering time T1 of the float 572 during the large flushing mode (T2<T1). This can make the lowering time of the float 572 and the valve opening time of the valve body 36 during the small flushing mode shorter than the lowering time of the float 572 and the valve opening time of the valve body 36 during the large flushing mode. As a result, when allowing the flush water in the water storage cylinder 62 to flow out of the outlet port 68, by changing the buoyancy that acts on the float 572 depending on the selected large flushing mode or small flushing mode, the balance position between the water level W2 in the water storage cylinder 62 and the float 572 can be changed, and the lowering time T1, T2 of the float 572 with the decrease in water level W2 in the water storage cylinder 62 can be changed. Therefore, a flow rate of flush water per unit time that affects flushing performance (hereinafter referred to as "instantaneous flow rate") [L/min] can be maintained comparatively high even in a small flushing mode in which the flush water amount is smaller than in the large flushing mode. Further, closing sound generated when the valve body 36 closes the discharge opening can be reduced.

Further, according to the discharge valve device 500 of the present embodiment, since the float 572 includes the storing portion 574 for storing flush water in a part thereof, the storing portion 574 allows the amount of flush water stored during the small flushing mode to be larger than the amount of flush water stored during the large flushing mode. Therefore, since the weight of the storing portion 574 during the small flushing mode is also larger than the weight of the storing portion 574 during the large flushing mode, the buoyancy obtained during the small flushing mode in the float 572 decreases as compared to the buoyancy obtained during the large flushing mode. This can make the lowering time T2 of the float 572 during the small flushing mode shorter than the lowering time T1 of the float 572 during the large flushing mode (T2<T1). This can make the lowering time of the float 572 and the valve opening time of the valve body 36 during the small flushing mode shorter than the lowering time of the float 572 and the valve opening time of the valve body 36 during the large flushing mode. As a result, when allowing the flush water in the water storage cylinder 62 to flow out from the outlet port 68 to the storage tank 12, changing the buoyancy that acts on the float 572 depending on the selected large flushing mode or small flushing mode can change the balance position between the water level W2 in the water storage cylinder 62 and the float 572 depending on the flushing mode, and can change the lowering time T1, T2 of the float 572 with the decrease in water level in the water storage cylinder 62. Therefore, the instantaneous flow rate of the flush water [L/min] that affects the flushing performance can be maintained comparatively high even in the small flushing mode in which the flush water amount is smaller than in the large flushing mode. Further, the closing sound generated when the valve body 36 closes the discharge opening 18 can be reduced.

Furthermore, according to the discharge valve device 500 of the present embodiment, when the large flushing mode is executed, the switching valve 558 can open the outlet 578 of the peripheral wall 576 of the storing portion 574 provided in the upper part of the float 572. Accordingly, since the flush water in the storing portion 574 flows out of the outlet 578 and the flush water is not stored in the storing portion 574 in the upper part of the float 572, the buoyancy of the float 572 can be set comparatively large. On the other hand, the small flushing mode is executed, the switching valve 558 closes the outlet 578 of the peripheral wall 576 of the storing portion 574, so that the flush water in the storing portion 574 cannot flow out of the outlet 578, and flush water is stored in the storing portion 574 in the upper part of the float 572. In this state, the storing portion 574 itself functions as the water weight. This can set the buoyancy of the float 572 during the small flushing mode to be smaller than during the large flushing mode. As a result, changing the buoyancy that acts on the float 572 depending on the selected large flushing mode or small flushing mode can reliably switch the lowering time of the float 572 and the valve opening time of the valve body 36. Further, the valve opening time of the valve body 36 is not affected by manufacturing error of the flush water tank device 502 and the flush toilet 4 to which the discharge valve device 500 is applied, and hence proper flushing can be executed on the flush toilet 4 to which the device is applied.

Next, with reference to FIGS. 14A and 14B, a discharge valve device 600 according to a seventh embodiment of the present invention will be described. Here, in the discharge valve device 600 according to the seventh embodiment of the present invention shown in FIGS. 14A and 14B, the same part as in the discharge valve devices 1, 100, 200, 300, 400 and 500 according to the first to sixth embodiments of the present invention described above is denoted with the same sign and is not described.

Figure 14A:
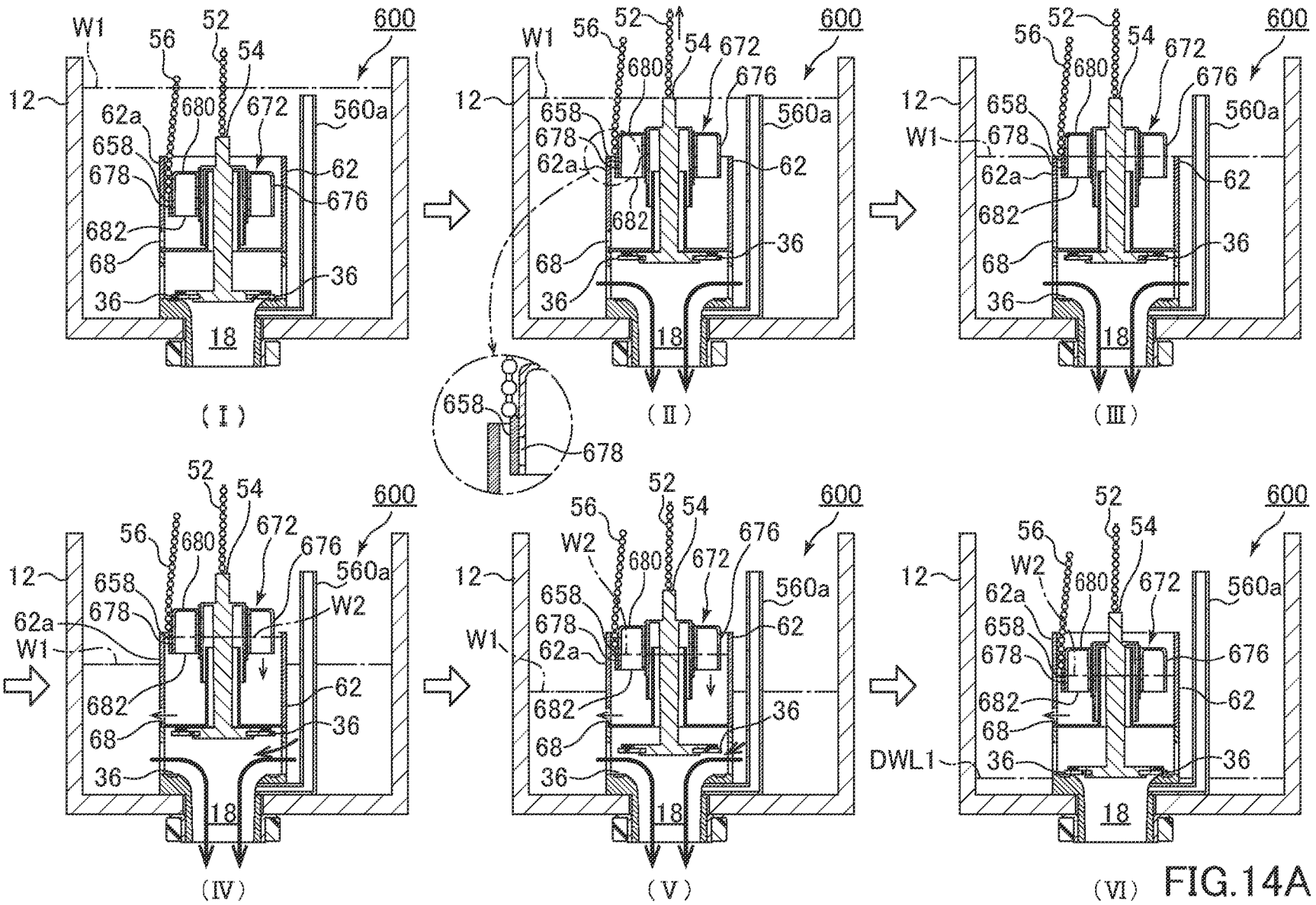
FIG. 14A is a schematic diagram showing a configuration of a discharge valve device according to the seventh embodiment of the present invention and a series of operations from a standby state until a valve is started to open and closed by the large flushing mode.
Figure 14B:
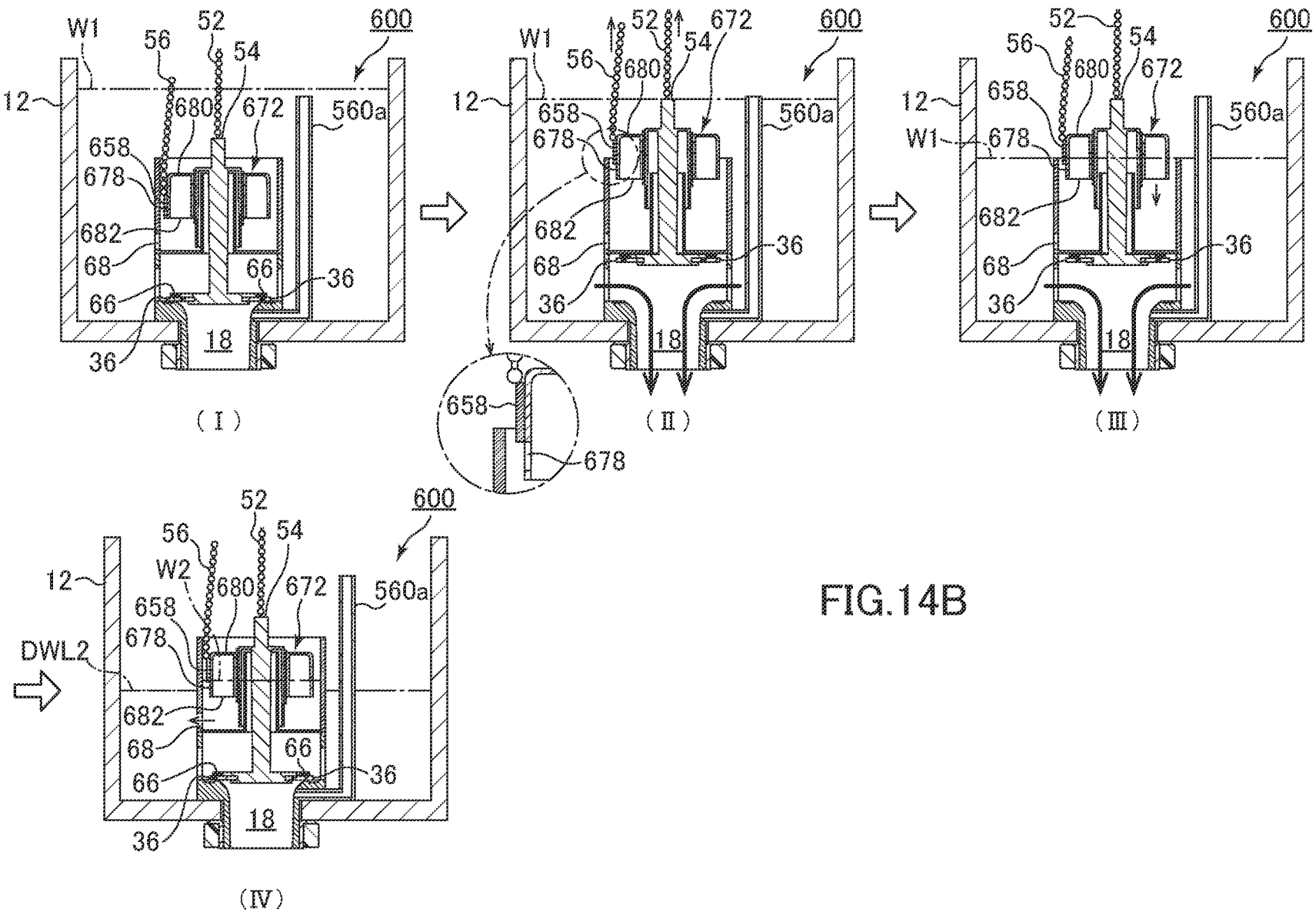
FIG. 14B is a schematic diagram showing a configuration of the discharge valve device according to the seventh embodiment of the present invention and a series of operations from the standby state until the valve is started to open and closed by the small flushing mode.

First, as shown in FIGS. 14A and 14B, in the discharge valve device 600 according to the seventh embodiment of the present invention, a float 672 includes a peripheral wall 676 provided in a lower part of the float and surrounding a part of the lower part of the float 672 to store flush water. Further, the float 672 includes a communication port 678 formed in a part of the peripheral wall 676 and communicating between inside and outside of the float 672. Further, the float 672 includes a partition (switching valve 658 for switching large or small flushing) that slides in a vertical direction to the communication port 678, to be openable and closable. Further, the switching valve 658 closes the communication port 678 of the peripheral wall 676 of the float 672 during a large flushing mode, so that the communication of flush water or air inside and outside the float 672 can be regulated. On the other hand, the switching valve 658 opens the communication port 678 of the peripheral wall 676 of the float 672 during a small flushing mode, to enable the communication of flush water or air inside and outside the float 672.

Next, as shown in FIGS. 14A and 14B, the float 672 includes a top surface 680 that closes an upper region of the peripheral wall 676, and a lower opening 682 formed along a bottom edge of the peripheral wall 676. Accordingly, the float 672 forms a generally cylindrical shape opened downward, and the communication port 678 is provided at a height position between the top surface 680 and the lower opening 682. These structures of the discharge valve device 600 of the present embodiment described above are different from that of the discharge valve device 500 according to the sixth embodiment of the present invention described above.

Next, with reference to FIGS. 14A and 14B, an operation of the discharge valve device 600 according to the seventh embodiment of the present invention will be described. First, a standby state shown in state (I) of FIGS. 14A and 14B is a state where the communication port 678 is closed by the switching valve 658. Then, when the large flushing mode is started from the standby state shown in the state (I) of FIG. 14A, an actuation shaft 54 and a valve body 36 are pulled upward by a first bead chain 52 in state (II) of FIG. 14A. On the other hand, the switching valve 658 closes the communication port 678 of the float 672 without being pulled upward by a second bead chain 56 (see state (II) of FIG. 14A). The state where the communication port 678 of the float 672 is closed by the switching valve 658 is maintained from subsequent state (III) of FIG. 14A to state (VI) of FIG. 14A where the valve body 36 is closed and the large flushing mode ends.

Consequently, in the state (II) of FIG. 14A, the float 672 and the valve body 36 are raised to the highest position, and a discharge opening 18 of a storage tank 12 is opened by the raised valve body 36. Then, the flush water in the storage tank 12 is drained to the discharge opening 18. Thereafter, as shown in the state (III) of FIG. 14A, when a water level W1 in the storage tank 12 decreases close to an upper end of the water storage cylinder 62 and further to a water level lower than the upper end of the water storage cylinder 62, a water pressure due to a water level W2 in the water storage cylinder 62 is higher than a water pressure due to the water level W1 in the storage tank 12, and hence the flush water in the water storage cylinder 62 flows out of the outlet port 68. Then, as shown in the states (IV) and (V) of FIG. 14A, the water level W2 in the water storage cylinder 62 is higher than the water level W1 in the storage tank 12, and the flush water in the water storage cylinder 62 continues to flow out of the outlet port 68. For this reason, as the water level W2 in the water storage cylinder 62 gradually decreases, the float 672 also lowers in conjunction with lowering of the water level W2.

Next, as shown in the state (VI) of FIG. 14A, when the water level W1 in the storage tank 12 outside the water storage cylinder 62 lowers to below an upper end of the outlet port 68 of the water storage cylinder 62, outside of the outlet port 68 of the water storage cylinder 62 is open to the atmosphere. Consequently, a speed at which the flush water in the water storage cylinder 62 flows out of the outlet port 68 is increased, and the water level W2 in the water storage cylinder 62 further lowers. Therefore, the float 672 also lowers, and the actuation shaft 54 and the valve body 36 also lower integrally. Then, when the valve body 36 contacts a valve seat 66, the discharge opening 18 is closed, and draining of flush water from inside of the storage tank 12 to the discharge opening 18 is stopped. Consequently, the supply of flush water from a flush water tank device 502 to a toilet main body 8 by the large flushing mode is finished.

On the other hand, when the small flushing mode is started from the standby state shown in the state (I) of FIG. 14B, the actuation shaft 54 and the valve body 36 are pulled upward by the first bead chain 52 in state (II) of FIG. 14B. Further, when the switching valve 658 is pulled up via the second bead chain 56, the switching valve 658 slides upward to open the communication port 678 of the float 672. A state where the communication port 678 of the float 672 is opened by the switching valve 658 is maintained thereafter until the small flushing mode ends (see state (II) to (IV) of FIG. 14B).

Further, as shown in the state (II) of FIG. 14B, the float 672 and the valve body 36 are raised to the highest position, and the discharge opening 18 of the storage tank 12 is opened by the raised valve body 36, to start draining of flush water from the inside of the storage tank 12 to the discharge opening 18. Thereafter, as shown in the state (III) of FIG. 14B, when the water level W1 in the storage tank 12 decreases close to the upper end of the water storage cylinder 62 and further to a water level lower than the upper end of the water storage cylinder 62, a water pressure due to a water level W2 in the water storage cylinder 62 is higher than a water pressure due to the water level W1 in the storage tank 12 outside the cylinder, and hence the flush water in the water storage cylinder 62 flows out of the outlet port 68.

Here, for the float 672, a state where the communication port 678 is opened by the switching valve 658 is maintained. Accordingly, part of air A in the float 672 is discharged from the communication port 678 of the peripheral wall 676 to the outside of the float 672, and in the float 672, the flush water outside the float 672 partially flows into a lower region of the float 672 by a volume of the discharged air. Therefore, a volume Q602 of air occupying inside of the float 672 during the small flushing mode is smaller than a volume Q601 of air occupying inside of the float 672 during the large flushing mode (Q602<Q601). Consequently, buoyancy of the float 672 during the small flushing mode becomes smaller than in the large flushing mode. Therefore, a lowering time T2 of the float 672 during the small flushing mode is shorter than a lowering time T1 of the float 672 during the large flushing mode (T2<T1). Further, a balance position between the water level W2 and the float 672 in the water storage cylinder 62 during the small flushing mode is also lower than a balance position during the large flushing mode.

Then, as shown in the state (IV) of FIG. 14B, when the valve body 36 contacts the valve seat 66, the discharge opening 18 is closed, to stop draining of flush water from the storage tank 12 to the discharge opening 18. Accordingly, the supply of flush water from the flush water tank device 502 to the toilet main body 8 by the small flushing mode is finished. At this time, a minimum water level DWL2 in the storage tank 12 during the small flushing mode in the state (IV) of FIG. 14B (draining stop water level so-called "dead water line") is located above a minimum water level DWL1 in the storage tank 12 during the large flushing mode in the state (VI) of FIG. 14A. That is, the minimum water level DWL2 during the small flushing mode is higher than the minimum water level DWL1 during the large flushing mode, by which the amount of flush water drained from the storage tank 12 to the discharge opening 18 during the small flushing mode is lower than the amount of flush water drained from the storage tank 12 to the discharge opening 18 during the large flushing mode.

According to the discharge valve device 600 of the seventh embodiment of the present invention described above, as shown in FIG. 14A, when the large flushing mode is executed, the switching valve 658 for switching large and small flushing closes the communication port 678 of the peripheral wall 676 provided in a lower part of the float 672. Accordingly, communication of flush water or air inside and outside the float 672 is regulated, and hence the buoyancy of the float 672 can be set comparatively large by the air A trapped in the float 672. On the other hand, as shown in FIG. 14B, when the small flushing mode is executed, the switching valve 658 opens the communication port 678 of the peripheral wall 676, to enable the communication of the flush water or air inside and outside the float 672. Consequently, during the small flushing mode, part of the air A in the float 672 is discharged from the communication port 678 of the peripheral wall 676 to the outside of the float 672, and in the float 672, the flush water outside the float 672 can partially flow into the lower region in the float 672 by the volume of the discharged air. Therefore, the volume Q602 of air occupying the inside of the float 672 during the small flushing mode is smaller than the volume Q601 of air occupying the inside of the float 672 during the large flushing mode (Q602<Q601). Accordingly, the buoyancy of the float 672 during the small flushing mode can be set smaller than during the large flushing mode. As a result, by changing the buoyancy that acts on the float 672 depending on the selected large flushing mode or small flushing mode, the lowering time of the float 672 and the valve opening time of the valve body 36 can be reliably switched. Further, since the valve opening time of the valve body 36 is not affected by the manufacturing error of the flush water tank device 502 and the flush toilet 4 to which the discharge valve device 600 of the present embodiment is applied, proper flushing can be executed on the flush toilet 4 to which the device is applied.

Further, according to the discharge valve device 600 of the present embodiment, as shown in FIG. 14A, in a state where the communication port 678 of the peripheral wall 676 of the float 672 is closed by the switching valve 658 for switching large and small flushing during the large flushing mode, as the inside of the float 672 is filled with the air A, the flush water outside the float 672 is inhibited from flowing into the float 672 from the lower opening 682. On the other hand, as shown in FIG. 14B, in the state where the communication port 678 of the peripheral wall 676 of the float 672 is opened by the switching valve 658 during the small flushing mode, part of the air in the float 672 is discharged from the communication port 678, so that the flush water outside the float 672 can flow from the lower opening 682 and/or the communication port 678 close into the height of the communication port 678 in the float 672. Accordingly, the buoyancy that acts on the float 672 during the small flushing mode decreases as compared to the buoyancy that acts on the float 672 during the large flushing mode. As a result, by changing the buoyancy that acts on the float 672 depending on the selected large flushing mode or small flushing mode, the lowering time of the float 672 and the valve opening time of the valve body 36 can be reliably switched. Further, since the valve opening time of the valve body 36 is not affected by the manufacturing error of the flush water tank device 502 and the flush toilet 4 to which the discharge valve device 600 of the present embodiment is applied, proper flushing can be also executed on the flush toilet 4 to which the device is applied.

Next, with reference to FIGS. 15A and 15B, a discharge valve device 700 according to an eighth embodiment of the present invention will be described. Here, in the discharge valve device 700 according to the eighth embodiment of the present invention shown in FIGS. 15A and 15B, the same part as in the discharge valve devices 1, 100, 200, 300, 400, 500 and 600 according to the first to seventh embodiments of the present invention described above is denoted with the same sign and is not described.

Figure 15A:
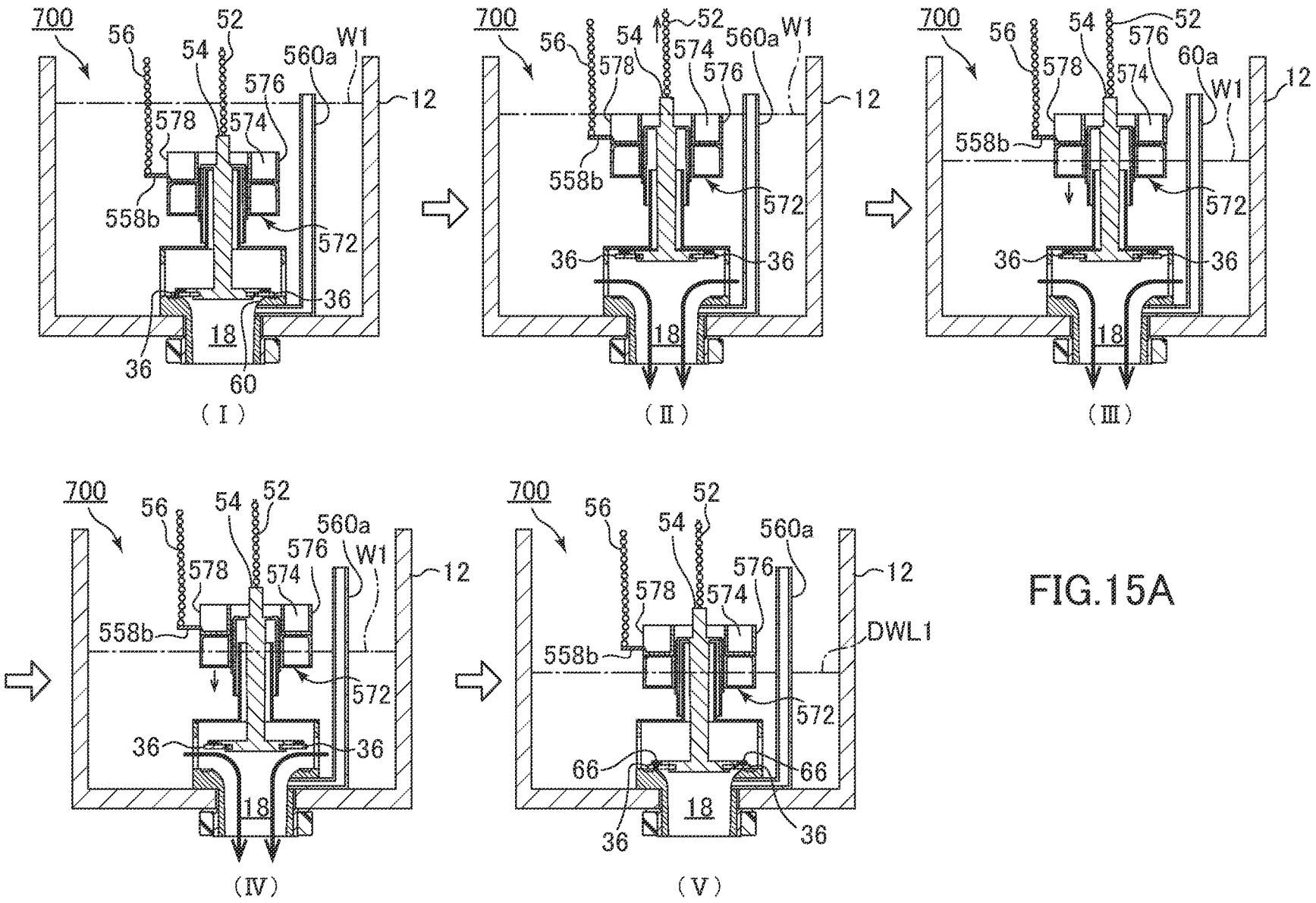
FIG. 15A is a schematic diagram showing a configuration of a discharge valve device according to the eighth embodiment of the present invention and a series of operations from a standby state until a valve is started to open and closed by the large flushing mode.
Figure 15B:
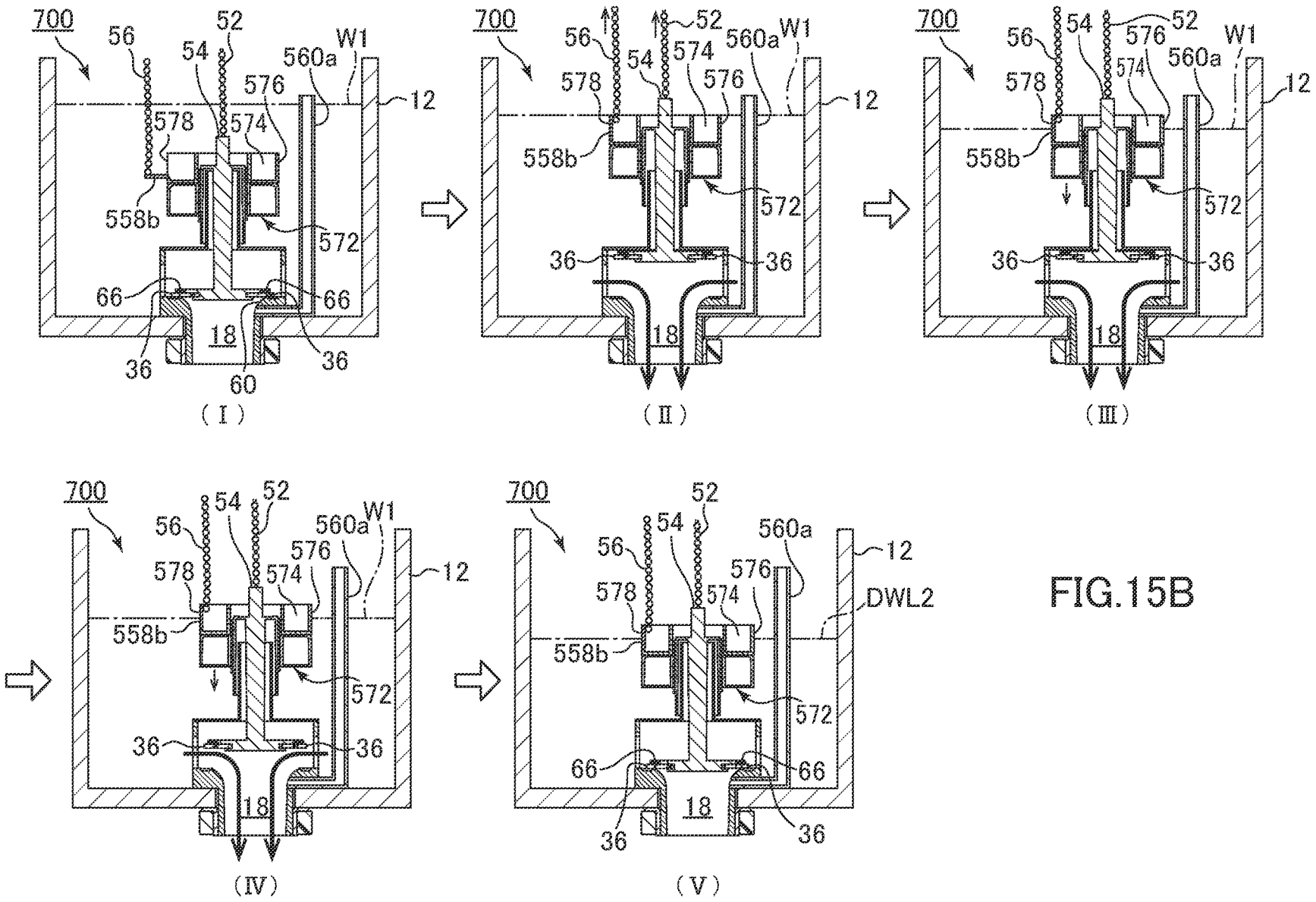
FIG. 15B is a schematic diagram showing a configuration of the discharge valve device according to the eighth embodiment of the present invention and a series of operations from the standby state until the valve is started to open and closed by the small flushing mode.

As shown in FIGS. 15A and 15B, the discharge valve device 700 according to the eighth embodiment of the present invention is common with the structure of the discharge valve device 500 according to the sixth embodiment of the present invention described above in that the device includes the same float as the float 572 including the storing portion 574 and the outlet 578 in the peripheral wall 576 of the discharge valve device 500 according to the sixth embodiment of the present invention described above. However, the discharge valve device 700 of the present embodiment has a structure different from that of the discharge valve device 500 according to the sixth embodiment in that the device does not include a water storage cylinder corresponding to the water storage cylinder 62 of the discharge valve device 500 according to the sixth embodiment of the present invention described above.

Next, a large flushing mode executed by the discharge valve device 700 according to the eighth embodiment of the present invention will be described with reference to FIG. 15A. When the large flushing mode is started from a standby state (I) of FIG. 15A, only a first bead chain 52 is pulled up. Accordingly, an actuation shaft 54 and a valve body 36 of the discharge valve device 700 are pulled up via the first bead chain 52 to linearly move upward, and accordingly the float 572 is also integrally pulled up via the actuation shaft 54 (see state (II) of FIG. 15A). At this time, the second bead chain 56 is not pulled up, and hence a switching valve 558 is rotated to open the outlet 578 of the storing portion 574 of the float 572 without being pulled up by the second bead chain 56 (see state (II) of FIG. 15A). A state where the outlet 578 of the storing portion 574 of the float 572 is opened by the switching valve 558 is maintained thereafter until the large flushing mode ends (see state (II) to (V) of FIG. 15A).

Consequently, in the state (II) of FIG. 15A, the float 572 and the valve body 36 are raised to the highest position, and a discharge opening 18 of a storage tank 12 is opened by the raised valve body 36, thereby draining the flush water in the storage tank 12 from the discharge opening 18 to a water conduit 8*a* of a toilet main body 8. Thereafter, as shown in the states (III) and (IV) of FIGS. 15A, when a water level W1 in the storage tank 12 lowers, the float 572 lowers in conjunction with lowering of the water level W1. At this time, in the storing portion 574 of the float 572, the outlet 578 is opened by the switching valve 558, and any flush water is not stored. In this state, the storing portion does not act as a water weight. Then, when the actuation shaft 54 and the valve body 36 lower integrally with the float 572 and the valve body 36 contacts the valve seat 66 as shown in the state (V) of FIG. 15A, the discharge opening 18 is closed, and the draining of flush water from inside of the storage tank 12 to the discharge opening 18 is stopped. Consequently, supply of flush water from a flush water tank device 502 to the toilet main body 8 by the large flushing mode is finished.

Next, a small flushing mode executed by the discharge valve device 700 according to the eighth embodiment of the present invention will be described with reference to FIG. 15B. When the small flushing mode is started from the standby state (I) of FIG. 15B, for example, each of the first bead chain 52 and the second bead chain 56 is pulled up.

Accordingly, the actuation shaft 54 and the valve body 36 of the discharge valve device 700 are raised and linearly move upward via the first bead chain 52, and accordingly the float 572 is also integrally pulled up via the actuation shaft 54 (see state (II) of FIG. 15B). Further, the switching valve 558 is pulled up via the second bead chain 56, and the outlet 578 of the storing portion 574 of the float 572 is closed by the switching valve 558. A state where the outlet 578 of the storing portion 574 of the float 572 is closed by the switching valve 558 is maintained until the small flushing mode ends (see state (II) to (V) of FIG. 15B).

Further, as shown in the state (II) of FIG. 15B, the float 572 and the valve body 36 are raised to the highest position, and the discharge opening 18 of the storage tank 12 is opened by the raised valve body 36, to start draining of flush water from the inside of the storage tank 12 to the discharge opening 18. Thereafter, as shown in the state (III) of FIG. 15B, when the water level W1 in the storage tank 12 lowers to a water level lower than an upper end of the float 572, the float 572 lowers in conjunction with lowering of the water level W1 in the storage tank 12.

At this time, for the storing portion 574 of the float 572 in which flush water is stored, a state where the outlet 578 is closed by the switching valve 558 is maintained. Consequently, a weight of the storing portion 574 (and the amount of flush water stored in the storing portion 574) during the small flushing mode is larger than a weight of the storing portion 574 (and the amount of flush water stored in the storing portion 574) during the large flushing mode. Therefore, during the small flushing mode, the storing portion 574 of the float 572 acts as the water weight, and hence buoyancy that acts on the float 572 during the small flushing mode decreases as compared to buoyancy during the large flushing mode. Accordingly, a lowering time T2 of the float 572 during the small flushing mode is shorter than a lowering time T1 of the float 572 during the large flushing mode (T2<T1). Further, a balance position between the water level W1 in the storage tank 12 and the float 572 during the small flushing mode is also lower than the balance position during the large flushing mode.

Then, when the actuation shaft 54 and the valve body 36 lower integrally with the float 572 and the valve body 36 contacts the valve seat 66 as shown in the state (V) of FIG. 15B, the discharge opening 18 is closed, to stop draining of flush water from the inside of the storage tank 12 to the discharge opening 18. Accordingly, the supply of flush water from the flush water tank device 502 to the toilet main body 8 by the small flushing mode is finished. At this time, a minimum water level DWL2 in the storage tank 12 during the small flushing mode in the state (V) of FIG. 15B (draining stop water level so-called "dead water line") is located above a minimum water level DWL1 in the storage tank 12 during the large flushing mode in the state (V) of FIG. 15A. That is, the minimum water level DWL2 during the small flushing mode is higher than the minimum water level DWL1 during the large flushing mode, by which the amount of flush water drained from the storage tank 12 to the discharge opening 18 during the small flushing mode is lower than the amount of flush water drained from the storage tank 12 to the discharge opening 18 during the large flushing mode.

According to the discharge valve device 700 of the eighth embodiment of the present invention described above, to start flushing of a flush toilet 4, first, on selecting either flushing mode of the large flushing mode or the small flushing mode, the actuation shaft 54 of the discharge valve device 700 is raised to raise (open) the valve body 36, and the flush water in the storage tank 12 is supplied from the discharge opening 18 to the toilet main body 8 of the flush toilet 4. Then, when the water level W1 in the storage tank 12 decreases depending on the selected large flushing mode or small flushing mode, the float 572 lowers as the water level W1 decreases. Consequently, as the actuation shaft 54 of the discharge valve device 700 lowers, the valve body 36 lowers (closes), and the flush water in the storage tank 12 is supplied from the discharge opening 18 to the toilet main body 8 of the flush toilet 4. At this time, since the buoyancy obtained in the float 572 during the small flushing mode decreases as compared to the buoyancy obtained during the large flushing mode, the lowering time T2 of the float 572 during the small flushing mode can be shorter than the lowering time T1 of the float 572 during the large flushing mode (T2<T1). This can make the lowering time of the float 572 and the valve opening time of the valve body 36 during the small flushing mode shorter than the lowering time of the float 572 and the valve opening time of the valve body 36 during the large flushing mode. As a result, changing the buoyancy that acts on the float 572 depending on the selected large flushing mode or small flushing mode can change the balance position between the water level W1 in the storage tank 12 and the float 572, and can change the lowering time T1, T2 of the float 572 with the decrease in water level W1 in the storage tank 12. Therefore, a flow rate per unit time of flush water (hereinafter referred to as "instantaneous flow rate") [L/min] that affects flushing performance can be maintained comparatively high even in the small flushing mode in which the flush water amount is smaller than in the large flushing mode. Further, closing sound generated when the valve body 36 closes the discharge opening can be reduced.

Next, with reference to FIGS. 16A and 16B, a discharge valve device 800 according to a ninth embodiment of the present invention will be described. Here, in the discharge valve device 800 according to the ninth embodiment of the present invention shown in FIGS. 16A and 16B, the same part as in the discharge valve devices 1, 100, 200, 300, 400, 500, 600 and 700 according to the first to eighth embodiments of the present invention described above is denoted with the same sign and is not described.

Figure 16A:
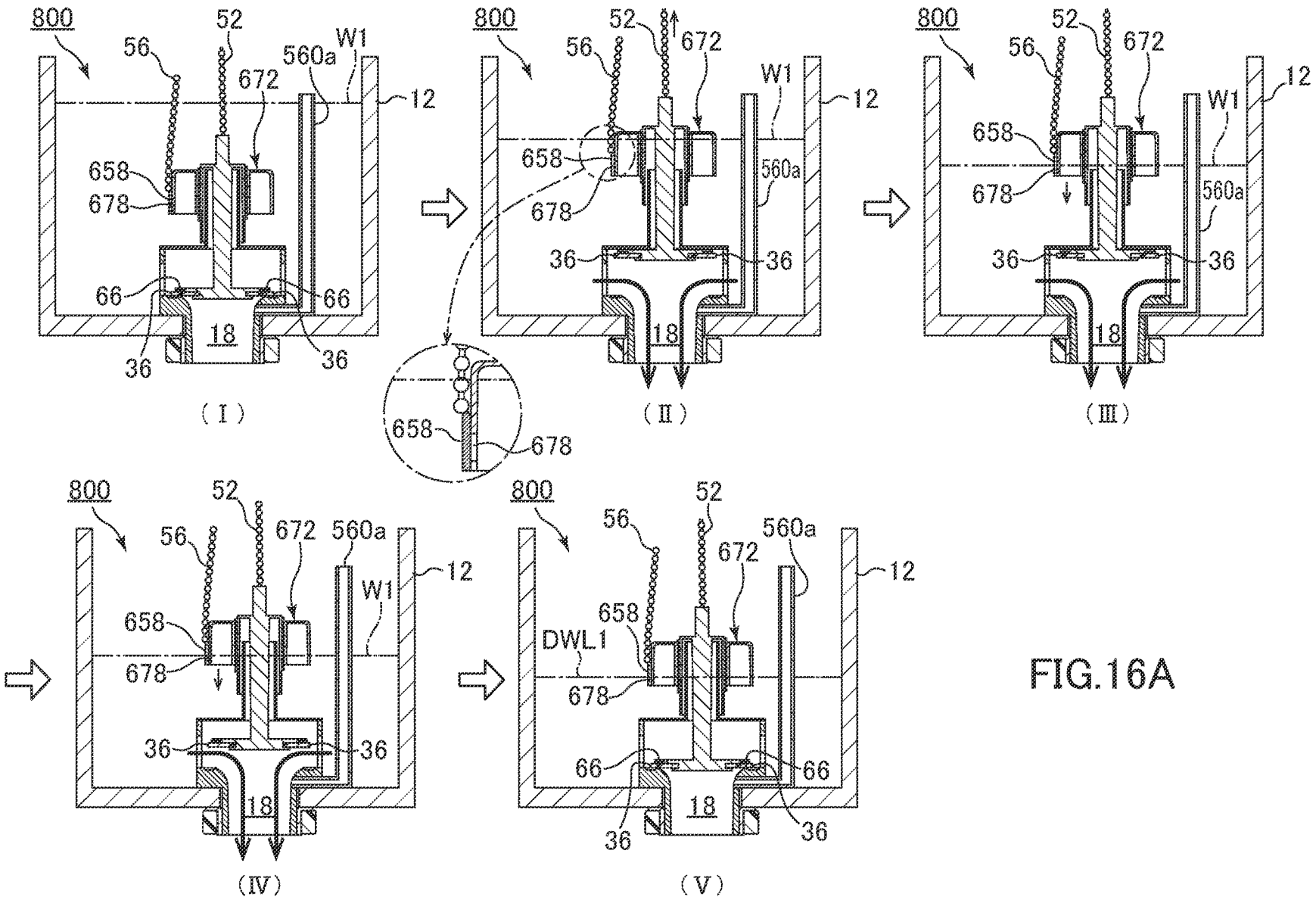
FIG. 16A is a schematic diagram showing a configuration of a discharge valve device according to the ninth embodiment of the present invention and a series of operations from a standby state until a valve is started to open and closed by the large flushing mode.
Figure 16B:
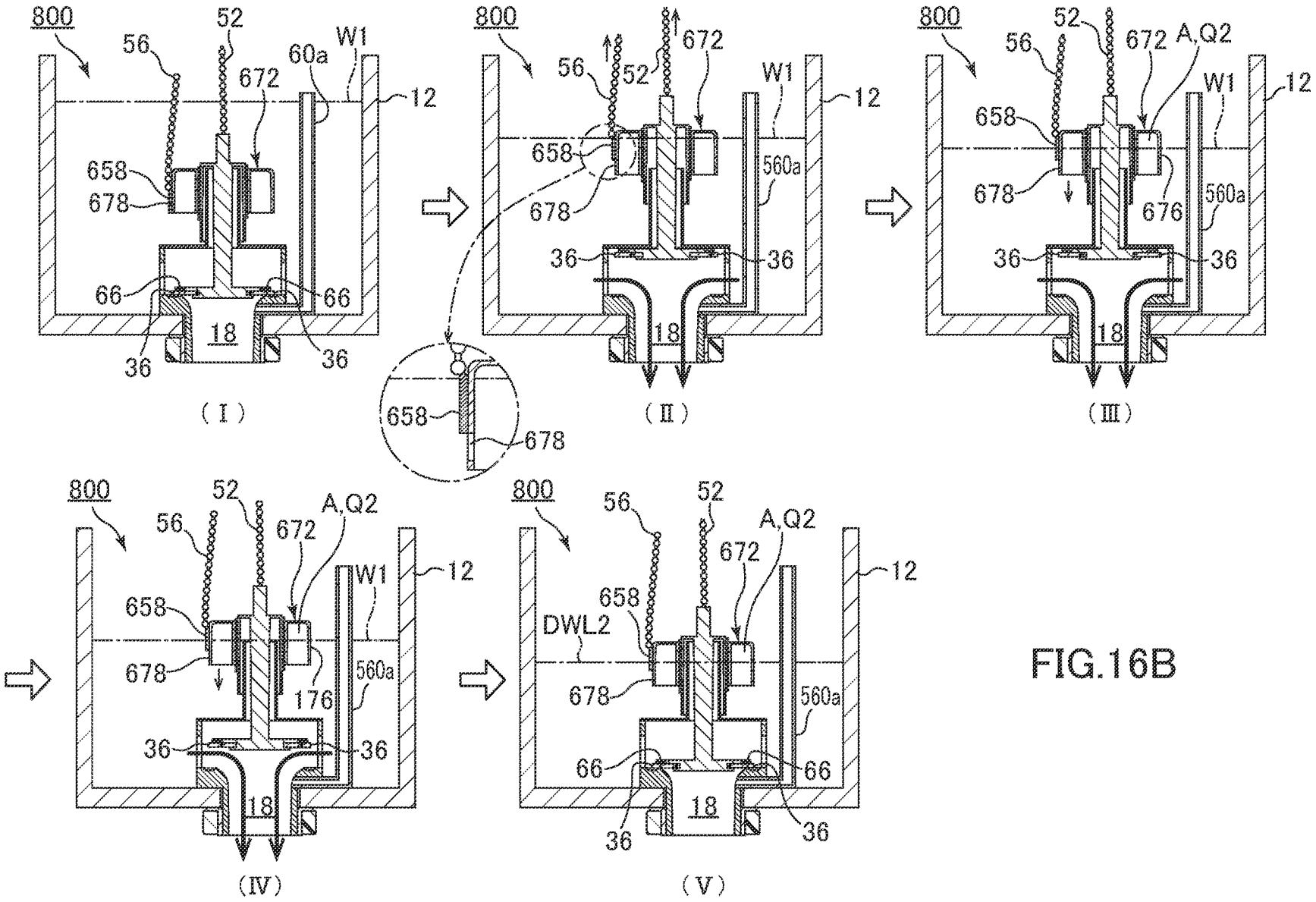
FIG. 16B is a schematic diagram showing a configuration of the discharge valve device according to the ninth embodiment of the present invention and a series of operations from the standby state until the valve is started to open and closed by the small flushing mode.

As shown in FIGS. 16A and 16B, the discharge valve device 800 according to the ninth embodiment of the present invention is common in structure with the discharge valve device 600 according to the seventh embodiment of the present invention described above in that the device includes the same float as the float 672 including the communication port 678 of the discharge valve device 600 according to the seventh embodiment of the present invention described above. However, the discharge valve device 800 of the present embodiment is different in structure from the discharge valve device 600 of the seventh embodiment in that the device does not include a water storage cylinder corresponding to the water storage cylinder 62 of the discharge valve device 600 according to the seventh embodiment of the present invention described above.

Next, a large flushing mode executed by the discharge valve device 800 according to the ninth embodiment of the present invention will be described with reference to FIG. 16A. When the large flushing mode is started from a standby state (I) of FIG. 16A, only a first bead chain 52 is pulled up. Accordingly, an actuation shaft 54 and a valve body 36 of the discharge valve device 800 are pulled up and linearly move upward via the first bead chain 52, and accordingly the float 672 is also integrally pulled up via the actuation shaft 54 (see state (II) of FIG. 16A). At this time, a second bead chain 56 is not pulled up, and hence a switching valve 658 closes the communication port 678 of the float 672 without being pulled up by the second bead chain 56 (see state (II) of FIG. 16A). A state where the communication port 678 of the float 672 is closed by the switching valve 658 is maintained thereafter until the large flushing mode ends (see state (II) to (V) of FIG. 16A).

Consequently, in the state (II) of FIG. 16A, the float 672 and the valve body 36 are raised to the highest position, and a discharge opening 18 of a storage tank 12 is opened by the raised valve body 36. In this state, the flush water in the storage tank 12 is drained from the discharge opening 18 to a water conduit 8*a* of a toilet main body 8. Thereafter, as shown in the states (III) and (IV) of FIG. 16A, as a water level W1 in the storage tank 12 lowers, the float 672 lowers in conjunction with lowering of the water level W1. At this time, the communication port 678 of the float 672 is closed by the switching valve 658, and a pressure in the float 672 is higher than a water pressure in the storage tank 12 outside the float 672. Therefore, flush water outside the float 672 cannot flow into the float 672 from the communication port 678 of the float 672 and a lower opening 682. Then, when the actuation shaft 54 and the valve body 36 lower integrally with the float 672 and the valve body 36 contacts a valve seat 66 as shown in the state (V) of FIG. 16A, the discharge opening 18 is closed, and draining of flush water from inside of the storage tank 12 to the discharge opening 18 is stopped. Consequently, the supply of flush water from a flush water tank device 502 to the toilet main body 8 by the large flushing mode is finished.

On the other hand, when a small flushing mode is started from a standby state shown in state (I) of FIG. 16B, the actuation shaft 54 and the valve body 36 are pulled upward by the first bead chain 52 in state (II) of FIG. 16B. Further, when the switching valve 658 is pulled up via the second bead chain 56, the switching valve 658 slides upward, to open the communication port 678 of the float 672. A state where the communication port 678 of the float 672 is opened by the switching valve 658 is maintained thereafter until the small flushing mode ends (see state (II) to (V) of FIG. 16B).

Further, as shown in the state (II) of FIG. 16B, the float 672 and the valve body 36 are raised to the highest position, and the discharge opening 18 of the storage tank 12 is opened by the raised valve body 36, to start draining of flush water from the inside of the storage tank 12 to the discharge opening 18. Thereafter, as shown in the state (III) of FIG. 16B, when the water level W1 in the storage tank 12 lowers to a water level lower than an upper end of the float 672, the float 672 lowers in conjunction with lowering of the water level W1 in the storage tank 12.

Here, for the float 672, a state where the communication port 678 is opened by the switching valve 658 is maintained. Accordingly, part of air A in the float 672 is discharged from the communication port 678 of a peripheral wall 676 to outside of the float 672, and in the float 672, the flush water outside the float 672 partially flows into a lower region of the float 672 by a volume of the discharged air and flush water. Therefore, a volume Q602 of air occupying inside of the float 672 during the small flushing mode is smaller than a volume Q601 of air occupying inside of the float 672 during the large flushing mode (Q602<Q601). Consequently, buoyancy of the float 672 during the small flushing mode becomes smaller than during the large flushing mode. Therefore, a lowering time T2 of the float 672 during the small flushing mode is shorter than a lowering time T1 of the float 672 during the large flushing mode (T2<T1). Further, a balance position between the water level W1 in the storage tank 12 and the float 672 during the small flushing mode is also lower than the balance position during the large flushing mode.

Then, as shown in the state (V) of FIG. 16B, when the valve body 36 contacts the valve seat 66, the discharge opening 18 is closed, and the draining of flush water from the inside of the storage tank 12 to the discharge opening 18 is stopped. Consequently, the supply of flush water from the flush water tank device 502 to the toilet main body 8 by the small flushing mode is finished. At this time, a minimum water level DWL2 (draining stop water level so-called "dead water line") in the storage tank 12 during the small flushing mode in the state (V) of FIG. 16B is located above a minimum water level DWL1 in the storage tank 12 during the large flushing mode in the state (V) of FIG. 16A. That is, the minimum water level DWL2 during the small flushing mode is higher than the minimum water level DWL1 during the large flushing mode, by which an amount of flush water drained from the storage tank 12 to the discharge opening 18 during the small flushing mode is lower than an amount of flush water drained from the storage tank 12 to the discharge opening 18 during the large flushing mode.

According to the discharge valve device 800 of the ninth embodiment of the present invention described above, to start flushing of the flush toilet 4, first, on selecting either flushing mode of the large flushing mode or the small flushing mode, the actuation shaft 54 of the discharge valve device 800 is raised, to raise (open) the valve body 36. The flush water in the storage tank 12 is supplied from the discharge opening 18 to the toilet main body 8 of the flush toilet 4. Then, when the water level W1 in the storage tank 12 decreases depending on the selected large flushing mode or small flushing mode, the float 672 lowers as the water level W1 decreases. Accordingly, as the actuation shaft 54 of the discharge valve device 800 lowers, the valve body 36 lowers (closes), and the flush water in the storage tank 12 is supplied from the discharge opening 18 to the toilet main body 8 of the flush toilet 4. At this time, the buoyancy obtained in the float 672 during the small flushing mode decreases as compared to the buoyancy obtained during the large flushing mode, and hence the lowering time T2 of the float 672 during the small flushing mode can be shorter than the lowering time T1 of the float 672 during the large flushing mode (T2<T1). This can make the lowering time of the float 672 and the valve opening time of the valve body 36 during the small flushing mode shorter than the lowering time of the float 672 and the valve opening time of the valve body 36 during the large flushing mode. As a result, changing the buoyancy that acts on the float 672 depending on the selected large flushing mode or small flushing mode can change the balance position between the water level W1 in the storage tank 12 and the float 672 and can change the lowering time T1, T2 of the float 672 with the decrease in water level W1 in the storage tank 12. Therefore, a flow rate per unit time of flush water (hereinafter referred to as "instantaneous flow rate") [L/min] that affects flushing performance can be maintained comparatively high even in the small flushing mode in which the flush water amount is smaller than in the large flushing mode. Further, closing sound generated when the valve body 36 closes the discharge opening can be reduced.

Although the present disclosure has been explained with reference to specific, preferred embodiments, one of ordinary skill in the art will recognize that modifications and improvements can be made while remaining within the scope and spirit of the present disclosure. The scope of the present disclosure is determined solely by appended claims.

What is claimed is:

1. A discharge valve device provided in a flush water tank configured to supply flush water to a flush toilet, the discharge valve device comprising:

a valve body configured to open and close a discharge opening provided in a bottom of the flush water tank;

an actuation shaft including a lower end provided with the valve body, the actuation shaft being configured to open and close the discharge opening by moving up and down the valve body;

a water storage cylinder configured to store a part of flush water in the flush water tank, the water storage cylinder including an outlet port configured to cause flush water in the water storage cylinder to flow outside of the water storage cylinder, the actuation shaft being inserted into the water storage cylinder in a vertical direction; and a float disposed in the water storage cylinder, the float being configured to cause buoyancy obtained by the flush water in the water storage cylinder to act on the actuation shaft, wherein when the float lowers with a decrease in water level in the water storage cylinder, the actuation shaft and the valve body are configured to be lowered in conjunction with the float and then the valve body is configured to close the discharge opening, during a period from when the valve body opens to when the valve body closes, either flushing mode of a large flushing mode or a small flushing mode is selectively performed, in the large flushing mode the flush water in the flush water tank is supplied from the discharge opening to the flush toilet in a first flush water amount, and in the small flushing mode the flush water is supplied in a second flush water amount smaller than the first flush water amount, and the water storage cylinder or the float is configured to change a lowering speed of the float with the decrease in water level in the water storage cylinder depending on the selected large flushing mode or small flushing mode, wherein a first total outflow amount of the flush water in the water storage cylinder flowing out from the outlet port to the flush water tank in the large flushing mode is larger than a second total outflow amount of the flush water in the water storage cylinder flowing out from the outlet port to the flush water tank in the small flushing mode.

2. The discharge valve device according to claim 1, wherein the water storage cylinder is configured to increase a total opening area of the outlet port during the small flushing mode as compared to a total opening area of the outlet port during the large flushing mode, when the valve body is opened, and a flush water amount per unit time of the flush water in the water storage cylinder flowing out from the outlet port to the flush water tank in the small flushing mode is larger than in the large flushing mode.

3. The discharge valve device according to claim 2, wherein the outlet port includes a first outlet port and a second outlet port, and the water storage cylinder causes the flush water in the flush water tank to flow out from the first outlet port to the flush water tank in the large flushing mode, whereas the water storage cylinder causes the flush water in the water storage cylinder to flow out from both the first outlet port and the second outlet port to the flush water tank in the small flushing mode.

4. The discharge valve device according to claim 3, wherein the second outlet port is disposed above the first outlet port.

5. The discharge valve device according to claim 2, wherein the water storage cylinder includes a partition that closes a part of the outlet port, and the partition closes a part of the outlet port so that the total opening area of the outlet port during the large flushing mode is smaller than the total opening area of the outlet port during the small flushing mode.

6. The discharge valve device according to claim 5, wherein the partition includes a communication hole that communicates between inside of the water storage cylinder and inside of the flush water tank in a state where the outlet port is closed, the communication hole including an opening cross-sectional area smaller than an opening cross-sectional area of the outlet port, and the partition causes the flush water in the water storage cylinder to flow out from the communication hole into the flush water tank in the state where the outlet port is closed in the large flushing mode, whereas the partition opens the outlet port and causes the flush water in the water storage cylinder to flow out from the whole outlet port into the flush water tank in the small flushing mode.

7. The discharge valve device according to claim 1, wherein the water storage cylinder includes a first outlet port configured to cause the flush water in the water storage cylinder to flow out to the flush water tank in the large flushing mode, and a second outlet port configured to cause the flush water in the water storage cylinder to flow out to the flush water tank in the small flushing mode, when the valve body is opened, a total opening area of the first outlet port is the same as a total opening area of the second outlet port, and the second outlet port is disposed above the first outlet port, and the water storage cylinder is configured to increase a second flush water amount per unit time of the flush water in the water storage cylinder flowing out from the second outlet port to the flush water tank in the small flushing mode as compared to a first flush water amount per unit time of the flush water in the water storage cylinder flowing out from the first outlet port to the flush water tank in the large flushing mode.

8. The discharge valve device according to claim 1, wherein the water storage cylinder includes a water storage cylinder body including the outlet port, and a small tank communicatively connected to the water storage cylinder body, the small tank includes a communication opening that communicates with the water storage cylinder body, and a partition that opens and closes the communication opening, and the partition opens the communication opening to communicate between the water storage cylinder body and the small tank in the large flushing mode, whereas the partition closes the communication opening to separate the water storage cylinder body and the small tank in the small flushing mode.

9. The discharge valve device according to claim 8, wherein the partition is provided rotatably with respect to the communication opening, rotates in a direction to open the communication opening in the large flushing mode, and rotates in a direction to close the communication opening in the small flushing mode.

10. The discharge valve device according to claim 9, wherein the communication opening includes a locking portion that is provided at a rim of the communication opening and that rotatably supports the partition, and the locking portion restricts rotation of the partition, when the partition rotates in the direction to close the communication opening and contacts the locking portion in the small flushing mode.

11. The discharge valve device according to claim 10, wherein the partition further includes a water weight portion configured to store flush water, the small tank further includes an auxiliary outlet port that formed in a bottom surface of the small tank, the auxiliary outlet port being configured to cause the flush water in the small tank to flow outside, and in a state where the partition abuts on the locking portion, the water weight portion is to store flush water and the auxiliary outlet port of the small tank is opened, and when the flush water in the small tank flows out from the auxiliary outlet port, the partition rotates in a direction apart from the locking portion and causes the flush water in the water weight portion to flow outside.

12. The discharge valve device according to claim 11, wherein the partition at an initial position has a state where the partition is not in contact with the locking portion and the communication opening is opened and any flush water is not stored in the water weight portion, in a standby period in which any flushing mode is not executed and a period in which the large flushing mode is executed, the partition is maintained at the initial position, to close the auxiliary outlet port of the small tank, and flush water is storable in the small tank, whereas in a period in which the small flushing mode is executed, the partition rotates from the initial position and contacts the locking portion, to maintain a state where the communication opening is closed, and then when the flush water in the small tank flows out from the auxiliary outlet port, the partition causes the flush water in the water weight portion to flow outside while rotating toward the initial position and then returns to the initial position.

13. The discharge valve device according to claim 8, wherein a top edge of the water storage cylinder body and a top edge of the small tank are flush with each other, and in a state where the communication opening is closed by the partition, an upper end of the partition protrudes upward from the top edge of the communication opening or the top edge of the small tank.

14. The discharge valve device according to claim 1, wherein the float is configured to decrease buoyancy obtained during the small flushing mode as compared to buoyancy obtained during the large flushing mode.

15. The discharge valve device according to claim 14, wherein the float includes a storing portion for storing flush water in a part of the float, and the storing portion is configured so that the amount of flush water stored during the small flushing mode is larger than the amount of flush water stored during the large flushing mode.

16. The discharge valve device according to claim 15, wherein the storing portion is provided in an upper part of the float and includes a peripheral wall surrounding a part of the upper part of the float to store flush water, and a partition provided to open and close an outlet formed in a part of the peripheral wall, the partition opens the outlet of the peripheral wall and allows flush water in the storing portion to flow out of the outlet during the large flushing mode, whereas the partition closes the outlet of the peripheral wall and maintains a state where flush water is stored in the storing portion to make the storing portion a water weight during the small flushing mode.

17. The discharge valve device according to claim 14, wherein the float includes a peripheral wall provided in a lower part of the float and surrounding a part of the lower part of the float to store flush water, a communication port formed in a part of the peripheral wall to communicate inside and outside the float, and a partition provided to open and close the communication port, the partition closes the communication port of the peripheral wall to regulate communication of flush water or air inside and outside the float during the large flushing mode, whereas the partition opens the communication port of the peripheral wall to enable the communication of flush water or air inside and outside the float during the small flushing mode.

18. The discharge valve device according to claim 17, wherein the float includes a top surface that closes an upper region of the peripheral wall, and a lower opening formed along a bottom edge of the peripheral wall, the float forms a generally cylindrical shape opened downward, and the communication port is provided at a height position between the top surface and the lower opening.

19. A flush water tank device comprising the discharge valve device according to claim 1.

20. A flush toilet comprising the flush water tank device according to claim 19.

* * * * *